United States Patent [19]

Morigaki et al.

[11] Patent Number: 4,994,359

[45] Date of Patent: Feb. 19, 1991

[54] SILVER HALIDE COLOR PHOTOGRAPHIC LIGHT-SENSITIVE MATERIAL

[75] Inventors: Masakazu Morigaki; Kiyoshi Nakazyo, both of Ashigara, Japan

[73] Assignee: Fuji Photo Film Co., Ltd., Kanagawa, Japan

[21] Appl. No.: 386,717

[22] Filed: Jul. 31, 1989

[30] Foreign Application Priority Data

Aug. 2, 1988 [JP] Japan ..... 63-192958

[51] Int. Cl.[5] ..... G03C 7/26; G03C 1/38

[52] U.S. Cl. ..... 430/551; 430/491; 430/555

[58] Field of Search ..... 430/551, 555, 491, 631, 430/634

[56] References Cited

U.S. PATENT DOCUMENTS

| | | | |
|---|---|---|---|
| 4,504,577 | 3/1985 | Yoshida et al. | 430/634 |
| 4,588,677 | 5/1986 | Ishikawa et al. | 430/491 |
| 4,741,994 | 5/1988 | Ichijima et al. | 430/551 |
| 4,853,319 | 8/1989 | Krishnamurthy et al. | 430/555 |
| 4,900,659 | 2/1990 | Crawley et al. | 430/555 |

*Primary Examiner*—Richard L. Schilling
*Attorney, Agent, or Firm*—Birch, Stewart, Kolasch & Birch

[57] ABSTRACT

The present invention relates to a silver halide color photographic light-sensitive material comprising (i) at least one 5-pyrazolone magenta coupler possessing an elimination group represented by general formula (I) in coupling positions, and (ii) at least one compound represented by general formula (A):

Formula (I)

(I)

wherein $L_1$ and $L_2$ each represents a methylene group or an ethylene group;

l and m each represents 0 to 1;

$R_1$ represents a hydrogen atom, an alkyl group, an alkenyl group, an aryl group or a heterocyclic group;

$R_2$ represents a group linked to A by a carbon atom, an oxygen atom, a nitrogen atom or a sulfur atom;

A represents a carbon atom or a sulfur atom;

n represents 1 when A is a carbon atom, and 1 or 2 when A is a sulfur atom;

B represents a carbon atom, an oxygen atom, a nitrogen atom or a sulfur atom;

X represents an atomic group necessary for forming a ring;

$R_1$ and $R_2$ may be mutually bonded and form a ring; and when B is a carbon atom or a nitrogen atom, B and $R_2$ may be mutually bonded and form a ring;

Formula (A)

(A)

wherein $R_{00}$ represents an organic radical; and $R_{01}$ and $R_{02}$ may be the same or different and each represents a hydrogen atom or an alkyl group;

Y and Y' may be the same or different and each represents wherein M, M', $R_{03}$ and $R_{04}$ are defined in the specification.

23 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material containing a 2-equivalent 5-pyrazolone type magenta coupler. More particularly, the invention relates to a photographic material which contains a 2-equivalent 5-pyrazolone type magenta coupler and has improved developability and storability.

BACKGROUND OF THE INVENTION

Silver halide color photographic light-sensitive materials are first subjected to image-wise exposure and then to development in an aromatic amine color developing agent to form a color image through the reaction of developing agent oxides that are produced as a result of this process and the color image forming couplers (referred to below as "couplers"). Normally, a combination of a yellow coupler, a cyan coupler and a magenta coupler is used in color photographic light-sensitive materials.

Pyrazolone couplers, pyrazolobenzimidazole couplers, indazolone couplers and pyrazoloazole couplers containing pyrazolotriazoles are known as magenta couplers. Further, 4-equivalent couplers are known which, because of equivalent properties with respect to silver, theoretically require 4 moles of silver halide in order to form 1 mole of dye, and 2-equivalent couplers are known which require 2 moles of silver halide.

2-equivalent couplers, which have a lower consumption of silver halide required for development, are advantageous for practical purposes and are the subject of considerable research and development work.

However, when one considers the preservation of photographic records, which is the basic purpose of color photographs, one finds that the image retention characteristics are not yet satisfactory and the light-fastness of the magenta color image in particular is much poorer than that of the yellow and the cyan color images. Therefore, magenta color couplers have been the object of much research and many proposals for their improvement have been set forth. Further, with regard to the fastness of images as affected by heat and humidity, there have been improvements in the fastness of cyan images and there are also increasingly strong demands for the improved fastness of magenta images.

Moreover, in view of the customers' demands and for the sake of protecting the environment, there have recently been strong calls for guaranteeing a satisfactory color density and image retention even when conducting the so-called rapid processing in which the development time is short, conducting development processing which involves essentially no benzyl alcohol, conducting a washing treatment using little or no water, and conducting processing in which there are, considerable changes in the ratios of the components contained therein and in the amounts of the components occurring during operating conditions.

2-equivalent 5-pyrazolone type magenta couplers are not well suited for practical purposes since they are also difficult to synthesize, the stability of the couplers per se is poor, and they display many side effects when used in photographic materials.

The present inventors having conducted intensive studies on arylthio elimination type 5-pyrazolone magenta couplers which are easy to synthesize, and they have recently developed 2-alkoxyphenylthio elimination type 5-pyrazolone magenta couplers which have been proposed in U.S. Pat. No. 4,413,054 and 4,351,897 and JP-A-60-57839, etc (the term "JP-A" as used herein means an "unexamined published Japanese patent application"). However, when the color developing solution contains large amounts of polyvalent cations having a valence of 2 or more, especially calcium ions, these arylthio elimination type 5-pyrazolone magenta couplers cause a reduction of the color density and desensitization results. Addition of the compounds proposed in JP-A-59-157632 in order to prevent this results in the deterioration of the image retention characteristics and staining in conditions of exposure to light, heat or humidity. Also, there is the drawback that yellow stain occurs in the white background of unexposed portions of the photographic material. Also, the method proposed in JP-A-60-159850 is undesirable for practical purposes since manufacturing costs are high with this method.

Moreover, these arylthio elimination type 5-pyrazolone magenta couplers have the further drawback that unexposed portions of the photographic material turn a magenta color with the lapse of time following development processing.

SUMMARY OF THE INVENTION

Accordingly, a first object of the present invention is to provide a color photographic light-sensitive material having satisfactory color density which can be achieved even with development processing in which the development processing time is short, or with development processing using a developing solution that is essentially free of benzyl alcohol.

A second object of the present invention is to provide a color photographic light-sensitive material which does not provoke a deterioration of the photographic qualities even on development processing with a developing solution possessing a large amount of polyvalent cations having a valence of 2 or more, in particular calcium ions, wherein the image retention characteristics are excellent and there is little occurrence of yellow stain in the unexposed portions of the photographic material even if it is stored in conditions in which it is exposed to light, heat and humidity.

A third object of the present invention is to achieve the second object of the present invention by a practical, low-cost means.

A fourth object of the present invention is to provide color photographic light-sensitive materials wherein there is little magenta staining of the unexposed portions of the photographic materials.

As the result of much research which the present inventors have conducted using a variety of additives and using a variety of 2-equivalent 5-pyrazolone type magenta couplers possessing arylthio leaving groups in order to resolve the problems noted above, it was first learned that the objects of the invention are achieved by combining newly-developed couplers related to 2-acylaminoarylthio elimination type 5-pyrazolone couplers having specific structures and compounds which are represented by general formula (A) and which include the compounds proposed in the abovenoted JP-A-59-157632 (corresponding to U.S. Pat. No. 4,504,577). Unexpectedly, the degree of improvement is one which was completely unforeseeable on the basis of combinations with other couplers, and the storability is also excellent.

In more detail, the objects of the present invention are achieved by using a silver halide color photographic light-sensitive material comprising a support having thereon at least one silver halide light-sensitive emulsion layer, which photographic light-sensitive material contains (i) at least one 5-pyrazolone coupler possessing an elimination group represented by general formula (I) noted below in the coupling positions, and (ii) at least one compound represented by general formula (A) noted below.

Formula (I) (I)

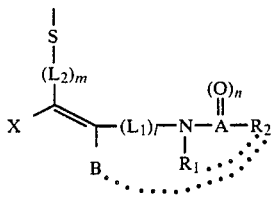

wherein $L_1$ and $L_2$ each represents a methylene or ethylene group; l and m each represents 0 or 1; $R_1$ represents a hydrogen atom, an alkyl group, an aryl group or a heterocyclic group; $R_2$ represents a group that is linked to A by a carbon atom, an oxygen atom, a nitrogen atom or a sulfur atom; A represents a carbon atom or a sulfur atom; n represents 1 when A is a carbon atom, and 1 or 2 when A is a sulfur atom; B represents a carbon atom, an oxygen atom, a nitrogen atom or a sulfur atom; X represents an atomic group necessary for forming a ring; $R_1$ and $R_2$ may be mutually bonded and form a ring; and when B is a carbon atom or a nitrogen atom, B and $R_2$ may be mutually bonded and form a ring;

Formula (A) (A)

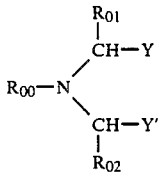

wherein $R_{00}$ represents an organic radical, and $R_{01}$ and $R_{02}$ which may be the same or different, each represents a hydrogen atom or an alkyl group; Y and Y' may be the same or different and each represents

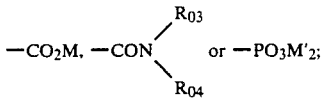

M represents a hydrogen atom, a sodium atom, a potassium atom, an ammonium ion, a quaternary amine, a protonated amine compound, an alkyl group, an aryl group or a heterocyclic group; M' represents a hydrogen atom, a sodium atom, a potassium atom, an ammonium ion, a quaternary amine or a protonated amine compound; $R_{03}$ and $R_{04}$ may be the same or different and each represents a hydrogen atom or an alkyl, aryl, acyl, sulfonyl or heterocyclic group. $R_{03}$ and $R_{04}$ may be mutually bonded and form a 5–7 membered ring.

DETAILED DESCRIPTION OF THE INVENTION

In the present invention, where the acyl group, the sulfonyl group, the sulfonamido, etc., are not specifically defined, they include aliphatic and aromatic groups thereof, and where the heterocyclic group is not specifically defined it preferably is a 5- to 7-membered heterocyclic group containing at least one S, O and N atom as a hetero atom.

There now follows a detailed description of the substituents in general formula (I).

$L_1$ and $L_2$ each represents a substituted or unsubstituted methylene or ethylene group. The groups which may be substituted thereon include halogen atoms (fluorine, chlorine, bromine, etc.), aliphatic groups (e.g., 1-22C straight chain or branched chain alkyl, aralkyl, alkenyl, alkynyl, cycloalkyl or cycloalkenyl), aryl groups (e.g., phenyl, naphthyl), heterocyclic groups (e.g., 2-furyl, 3-pyridyl), alkoxy groups (e.g., methoxy, ethoxy, cyclohexyloxy), aryloxy groups (e.g., phenoxy, p-methoxyphenoxy, p-methylphenoxy), alkylamino groups (e.g., ethylamino,dimethylamino), alkoxycarbonyl groups (e.g., methoxycarbonyl, ethoxycarbonyl), carbamoyl groups (e.g., N,N-dimethylcarbamoyl), anilino groups (e.g., phenylamino, N-ethylanilino), sulfamoyl groups (e.g., N,N-diethylsulfamoyl), alkylsulfonyl groups (e.g., methylsulfonyl), arylsulfonyl groups (e.g., tolylsulfonyl), alkylthio groups (e.g., methylthio, octylthio), arylthio groups (e.g., phenylthio, 1-naphthylthio), acyl groups (e.g., acetyl, benzoyl), acylamino groups (e.g., acetamido, benzamido), imido groups (e.g., succinimide, phthalimide), ureido groups (e.g., phenylureido, N,N-dibutylureido), sulfamoylamino groups (e.g., N,N-dipropylsulfamoylamino), alkoxycarbonylamino groups (e.g., methoxycarbonylamino), sulfonamido groups (e.g., methanesulfonamide), a hydroxyl group and a cyano group, etc. Preferably, $L_1$ and $L_2$ are unsubstituted methylene and ethylene groups. l and m each represents 0 or 1 and are preferably 0.

$R_1$ represents a hydrogen atom, an alkyl group, an aryl group or a heterocyclic group. In more detail, $R_1$ represents a hydrogen atom, an aliphatic group such as a 1-22C straight chain or branched chain alkyl group, an alkenyl group or a cycloalkyl group, an aryl group such as a phenyl or a naphthyl group or a heterocyclic group such as a 2-furyl, 2-thienyl, 2-pyrimidinyl or 4-pyridyl group. These may also have the substituents thereon that were defined for $L_1$ and $L_2$. Preferably, $R_1$ is a hydrogen atom or an alkyl group.

$R_2$ represents a group that is linked to A by a carbon, oxygen, nitrogen or sulfur atom. In more detail, $R_2$ represents a group that is linked by a carbon atom such as an alkyl group, an aryl group, a heterocyclic group (linked by a carbon atom), an acyl group, an alkoxycarbonyl group or a carbamoyl group (linked by a carbon abom); a group that is linked by an oxygen atom such as an alkoxy group or an aryloxy group; a group that is linked by a nitrogen atom such as an alkylamino, anilino, acylamino, ureido, sulfamoylamino, alkoxycarbonylamino or sulfonamido group; or a group that is linked by a sulfur atom such as an alkylthio group or an arylthio group. Like $R_1$, $R_2$ may also have the substituents thereon that were defined for $L_1$ and $L_2$. Preferably, $R_2$ is an alkyl, aryl, alkylamino or anilino group.

A represents a carbon atom or a sulfur atom and is preferably a carbon atom.

n is 1 when A is a carbon atom and is 1 or 2 when A is a sulfur atom.

B represents a carbon, oxygen, nitrogen or sulfur atom and is preferably a carbon or nitrogen atom and still more preferably a carbon atom.

X represents a group of atoms necessary for forming a ring and is preferably a group that is necessary for forming a saturated or unsaturated 5, 6 or 7 membered ring and is constituted by atoms selected from among carbon, oxygen, nitrogen and sulfur atoms. More preferably, X is a group that is needed for forming an unsaturated 5 or 6 membered ring and is constituted by atoms selected from among carbon, oxygen and nitrogen atoms. These rings may also have a substituents thereon that were defined for $L_1$ and $L_2$ and other rings may be condensed onto the ring containing X.

$R_1$ and $R_2$ may be bonded to one another and form a ring and may preferably form a 5- or 6-membered saturated or unsaturated ring. Such rings may also have the substituent thereon that was defined for $L_1$ and $L_2$.

When B is a carbon atom or a nitrogen atom, B and $R_2$ may be bonded to one another to form a ring and they may suitably form a 5- or 6-membered saturated or unsaturated ring, a 5- or 6-membered saturated ring being preferred. Such rings may also have a substituent thereon that was defined for $L_1$ and $L_2$.

A first preferred pyrazolone coupler is represented by the following general formula:

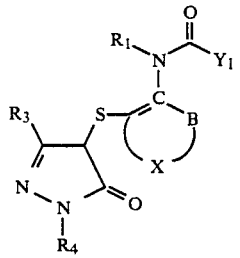

wherein $Y_1$ in this general formula represents Ra or $Z_1$Rb; Ra represents a substituted or an unsubstituted aryl or a heterocyclic group or a substituent possessing a secondary or tertiary group represented by

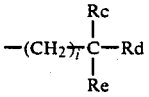

and i represents 0 or 1; $Z_1$ represents an oxygen atom, a sulfur atom or NRf; Rb is a substituted or an unsubstituted alkyl, aryl or heterocyclic group; Rc and Rd each represents halogen atoms or a member selected from the group consisting of Rb and $Z_2$Rg; Re is a hydrogen atom or a group as defined for Rc and Rd; Rf is a hydrogen atom or a group as defined for Rb; $Z_2$ represents an oxygen atom or a sulfur atom or NRh; Rg is a group as defined for Rf; Rh is a group as defined for Rf; Rc may bond with Rd and/or Re to form one or two carbon rings or hetero rings and these may also possess substituents. $R_1$, X and B signify the same groups, atomic groups and atoms as noted earlier; $R_3$ is an anilino, acylamino, ureido, carbamoyl, alkoxy, allyloxycarbonyl, alkoxycarbonyl or N-heterocyclic group and preferably these groups are groups containing oil-solubilizing groups. $R_4$ is a substituted or an unsubstituted aryl group and is preferably a substituted phenyl group, more preferably a 2,4,6-trichlorophenyl group.

Preferred pyrazolone couplers of this general formula can be represented by the following general formula in which $R_1$, $R_3$, $R_4$, Rc, Rd, Re, X and B signify the same atoms, atomic groups or groups as noted above and i is 0 or 1;

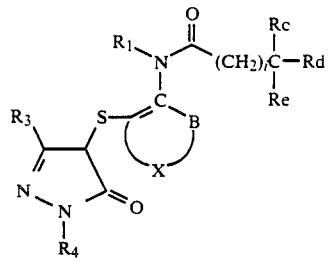

A second preferred pyrazolone coupler is represented by the following general formula:

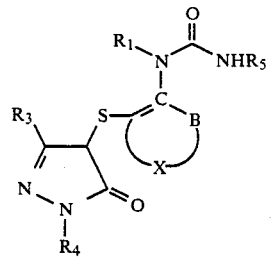

wherein $R_5$ represents a substituted or an unsubstituted alkyl, aryl or heterocyclic group; $R_1$, $R_3$, $R_4$, X and B signify the same groups, atomic groups, and atoms as noted above. Preferably, $R_3$ is a group represented by—NH-$Y_2$ and $R_4$ is a 2,4,6-trichlorophenyl group. $Y_2$ is a substituted or an unsubstituted aryl, arylcarbonyl or arylaminocarbonyl group.

A third preferred pyrazolone coupler is represented by the following general formula:

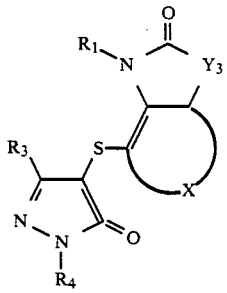

wherein $R_1$, $R_3$, $R_4$ and X signify the same atoms, groups and atomic groups as noted above. $Y_3$ represents a substituted or an unsubstituted methylene or ethylene group or

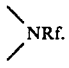

(Examples of substituents for the substituented methylene and ethylene groups include those which are recited in the definition of $L_1$ and $L_2$.) Rf signifies the same atoms and groups as noted above. A still more preferred pyrazolone coupler of this general formula is represented by the following general formula:

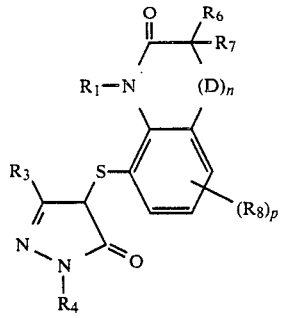

wherein $R_1$, $R_3$ and $R_4$ each signifies the same atoms and groups as noted above. $R_6$ and $R_7$ each represents alkyl or aryl groups and $R_8$ represents the substituents as defined for $L_1$ and $L_2$. D represents a methylene group or an oxygen, nitrogen or sulfur atom and n represents an integer from 0 to 2 when it is a methylene group and is 1 in the other cases. p is an integer from 0 to 3.

The phrase "coupler moiety" discussed hereinbelow is the portion excluding the coupling elimination group. The term "coupler" refers to the entire body including both the coupler moiety and the coupling elimination group.

The coupling moiety reacts with an oxidized color development agent to form a dye and more specifically a magenta dye which is a pyrazolone coupler that is well-known and in common use in the photographic industry. Representative examples of suitable pyrazolone coupler moieties that may be cited include the substances disclosed in U.S. Pat. Nos. 4,413,054, 4,443,536, 4,522,915, 4,336,325, 4,199,361, 4,351,897, and 4,385,111, JP-A-60-170854, JP-A-60-194452 and JP-A-60-194451, U.S. Pat. Nos. 4,407,936, 3,419,391 and 3,311,476, UK Patent No. 1,357,372 and U.S. Pat. Nos. 2,600,788, 2,908,573, 3,062,653, 3,519,429, 3,152,896, 2,311,082, 2,343,703 and 2,369,489 and in the inventions cited in these patents. When the coupling elimination groups are substituted on the pyrazolone coupler moieties of these patents, it is possible to effect replacement with the coupling elimination groups represented by general formula (I) of the present invention. The pyrazolone couplers of the invention can also be used together with other pyrazolone couplers disclosed in the patents noted above.

Examples of preferred coupler moieties are represented in the following general formula:

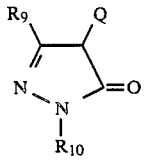

wherein Q represents a coupling elimination group of the invention; $R_9$ is an anilino, acylamino, ureido, carbamoyl, alkoxy, aryloxycarbonyl, alkoxycarbonyl or N-heterocyclic group; $R_{10}$ is a substituted or an unsubstituted aryl group and is preferably a phenyl group with at least one substituent selected from among halogen atoms and alkyl, alkoxy, alkoxycarbonyl, acylamino, sulfamido, sulfonamido and cyano groups. The carbon atoms and the nitrogen atoms of these substituents may be unsubstituted or substituted by groups which do not reduce the coupler's effects. $R_9$ is preferably an anilino group and is more preferably an anilino group represented by the following general formula:

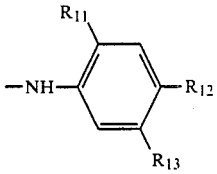

wherein $R_{11}$ is a 1–30C alkoxy group, aryloxy group or halogen atom (preferably a chlorine atom); $R_{12}$ and $R_{13}$ are respectively hydrogen atoms, halogen atoms (e.g., chlorine, bromine, fluorine), alkyl groups (e.g., 1–30C alkyl groups), alkoxy groups(e.g., 1–30C alkoxy groups) or acylamino, sulfonamido, sulfamoyl, sulfamido, carbamoyl, diacylamino, aryloxycarbonyl, alkoxycarbonyl, alkoxysulfonyl, aryloxysulfonyl, alkanesulfonyl, arylsulfonyl, alkylthio, arylthio, alkoxycarbonylamino, alkylureido, acyl, nitro or carboxyl groups. For example, $R_{12}$ and $R_{13}$ may each be a hydrogen atom or a ballast group.

$R_{10}$ is preferably a substituted phenyl group. The substituents thereof include halogen atoms (e.g., chlorine, bromine, fluorine), 1–22C alkyl groups (e.g., methyl, ethyl, propyl, t-butyl, tetradecyl), 1–22C alkoxy groups (e.g., methoxy, ethoxy, dodecyloxy), 1–23C alkoxycarbonyl groups (e.g., methoxycarbonyl, ethoxycarbonyl, tetradecyloxycarbonyl), acylamino groups (e.g., α-(3-pentadecylphenoxy)-butylamide) and/or amino groups. More preferably, $R_{10}$ is a 2,4,6-trichlorophenyl group.

More specifically, $R_{12}$ and $R_{13}$ include hydrogen atoms, halogen atoms (e.g., chlorine, bromine, fluorine), 1–30C straight chain or branched chain alkyl groups (e.g., methyl, trifluoromethyl, ethyl, t-butyl, tetradecyl), 1–30C alkoxy groups (e.g., methoxy, ethoxy, 2-ethylhexyloxy, tetradecyloxy), acylamino groups (e.g., acetamido, benzamido, butylamido, tetradecaneamido, α-(2,4-di-t-pentylphenoxy)acetamide, α-(2,4-di-t-pentylphenoxy)butylamido, α-(4-hydroxy-3-t-butylphenoxy)tetradecaneamido, 2-oxopyrrolidin-1-yl, 2-oxy-5-tetradecylpyrrolin-1-yl, N-methyltetradecaneamido, t-butylcarbonamido), sulfonamido groups (e.g., methanesulfonamido, benzenesulfonamido, p-toluenesulfonamido, p-dodecylbenzenesulfonamido, N-methyltetradecylsulfonamido, hexadecanesulfonamido), sulfamoyl groups (e.g., N-methylsulfamoyl, N-hexadecylsulfamoyl, N,N-dimethylsulfamoyl, N-(3-(dodecyloxy)propyl)sulfamoyl, N-(4-(2,4-di-t-pentylphenoxy)butyl)sulfamoyl, N-methyl-N-tetradecylsulfamoyl, N-dodecylsulfamoyl), sulfamido groups (e.g., N-methylsulfamido, N-octadecylsulfamido), carbamoyl groups (e.g., N-methylcarbamoyl, N-octadecylcarbamoyl, N-(4-(2,4-di-t-pentylphenoxy)butyl)carbamoyl, N-methyl-N-tetradecylcarbamoyl, N,N-dioctylcarbamoyl), diacylamino groups (e.g., N-succinimido, N-phthalimido, 2,5-dioxo-1-oxazolidinyl, 3-dodecyl-2,5-dioxo-1-imidazolyl, N-acetyl-N-dodecylamino), aryloxycarbonyl groups (e.g., phenoxycarbonyl, p-dodecyloxyphenoxycarbonyl), 2–30C alkoxycarbonyl groups (e.g., methoxycarbonyl, tetradecyloxycarbonyl, ethoxycarbonyl, benzyloxycarbonyl, dodecyloxycarbonyl), 1–30C alkoxysulfonyl groups (e.g., methoxysulfonyl, octyloxysulfonyl, tetradecyloxysulfonyl, 2-ethylhexyloxysulfonyl), aryloxysulfonyl groups (e.g., phenoxysulfonyl, 2,4-di-t-pentylphenoxysulfonyl), 1–30C alkanesulfonyl groups (e.g., methanesulfonyl, octanesulfonyl, 2-ethylhexanesulfonyl, hexadecanesulfonyl), arylsulfonyl groups (e.g., benzenesulfonyl, 4-nonylbenzenesulfonyl, p-toluenesulfonyl), 1–22C alkylthio groups (e.g., ethylthio, octylthio, benzylthio, tetradecylthio, 2-(2,4-di-t-pentylphenoxy)ethylthio), arylthio groups (e.g., phenylthio, p-tolylthio), alkoxycarbonylamino groups (e.g., ethoxycarbonylamino, benzyloxycarbonylamino, hexadecyloxycarbonylamino), alkylureido groups (e.g., N-methylureido, N,N-dimethylureido, N-methyl-N-dodecylureido, N-hexadecylureido, N,N-dioctadecylureido, N,N-dioctyl-N'-ethylureido), acyl groups (e.g., acetyl, benzoyl, octadecanoyl, p-dodecaneamidobenzoyl, cyclohexanecarbonyl), nitro groups, cyano groups and carboxyl groups.

The alkoxy and aryloxy groups of $R_{11}$ further include the case where the alkoxy groups are methoxy, ethoxy, propoxy, butoxy, 2-methoxyethoxy, sec-butoxy, hexyloxy, 2-ethylhexyloxy, 2-(2,4-di-t-pentylphenoxy)ethoxy and 2-dodecyloxyethoxy groups and the aryloxy groups are phenoxy, $\alpha$ and $\beta$-naphthyloxy and 4-tolyloxy groups.

A monomer containing a pyrazolone coupler with the elimination group represented by general formula (I) may serve to form a copolymer with a non-color-forming ethylenic monomer which does not couple with the oxidation products of primary aromatic amine developing agents.

Representative examples of non-color-forming ethylenic monomers which do not couple with the oxidation products of primary aromatic amine developing agents include acrylic acid, $\alpha$-chloroacrylic acid, $\alpha$-alkylacrylic acid (e.g., methacrylic acid) and esters or amides derived from these acrylic acids (e.g., acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, and $\beta$-hydroxy methacrylate), methylene bisacrylamide, vinyl esters (e.g., vinyl acetate, vinyl propionate and vinyl laurate), acrylonitrile, methacrylonitrile, aromatic vinyl compounds (e.g., styrene and derivatives thereof, vinyltoluene, divinylbenzene, vinylacetophenone and sulfostyrene), itaconic acid, citraconic acid, crotonic acid, vinylidene chloride, vinyl alkyl ethers (e.g., vinyl ethyl ether), maleic acid, maleic anhydride, maleic acid esters, N-vinyl-2-pyrrolidone, N-vinylpyridine and 2 or 4-vinylpyridine, etc. Two or more non-coloring unsaturated ethylenic monomers may be used together. For example, one can have n-butyl acrylate and methylcrylate, styrene and methacrylic acid, methacrylic acid and acrylamide or methyl acrylate and diacetone acrylamide, etc.

As is well-known in the field of polymer color couplers, it is possible to select noncoloring unsaturated ethylenic monomers for copolymerization with solid, water-soluble monomers in such a manner as to have good effects on the physical and/or chemical properties of the copolymer that is formed, e.g., solubility, compatibility with photographic colloid composition binders, for example, gelatin and the pliability and thermal stability, etc. of the copolymer.

Polymer couplers used in the invention may be water-soluble or water-insoluble, but within the various substances polymer coupler latexes are particularly preferred.

Below, specific examples of coupling elimination groups Q that are represented by general formula (I) are given, although there is no limitation to these examples.

(Q-1)

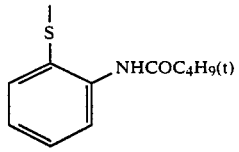

(Q-2)

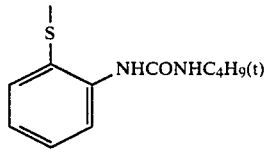

(Q-3)

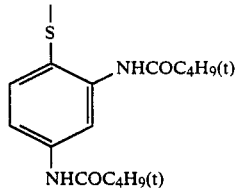

(Q-4)

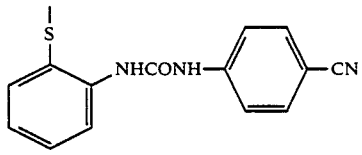

(Q-5)

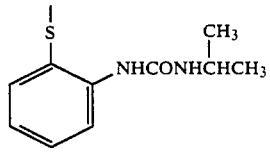

(Q-6)

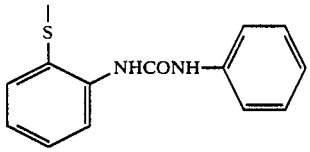

(Q-7)

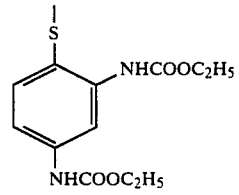

-continued
(Q-8)
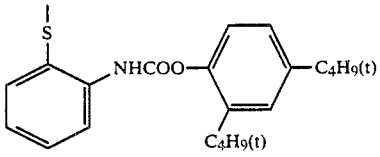
(Q-9)
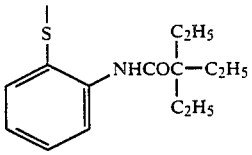
(Q-10)
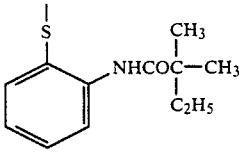
(Q-11)
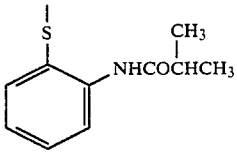
(Q-12)
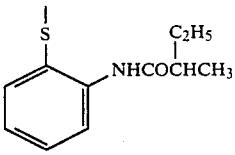
(Q-13)
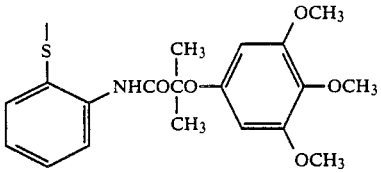
(Q-14)
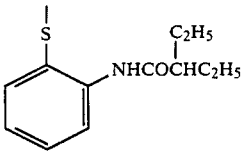
(Q-15)
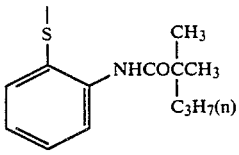
(Q-16)
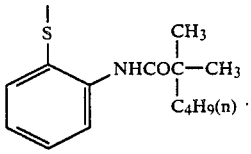
-continued
(Q-17)
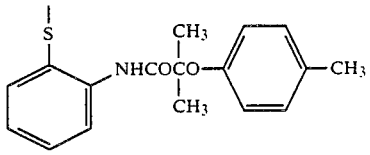
(Q-18)
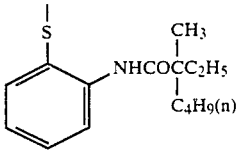
(Q-19)
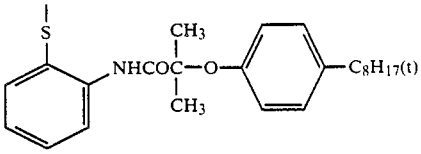
(Q-20)
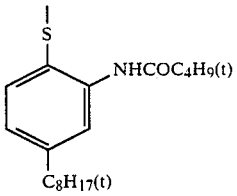
(Q-21)
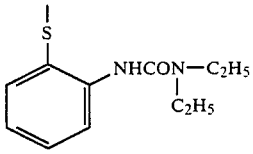
(Q-22)
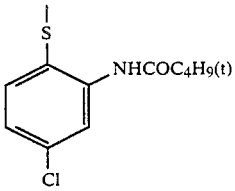
(Q-23)
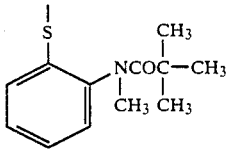
(Q-24)
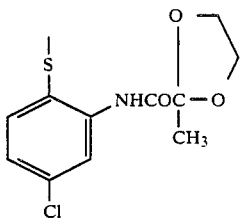

-continued
(Q-25)
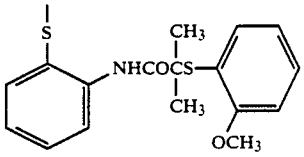
(Q-26)
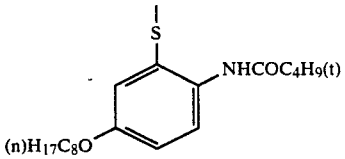
(Q-27)
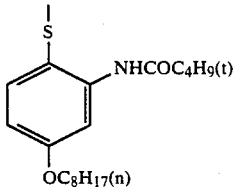
(Q-28)
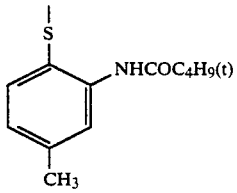
(Q-29)
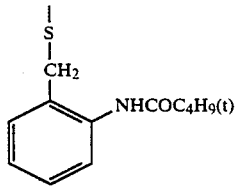
(Q-30)
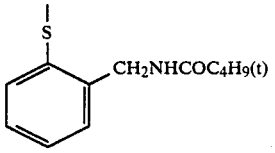
(Q-31)
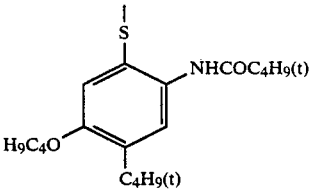
(Q-32)
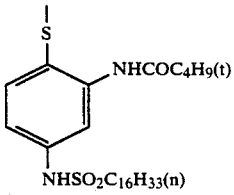
-continued
(Q-33)
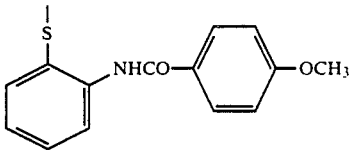
(Q-34)
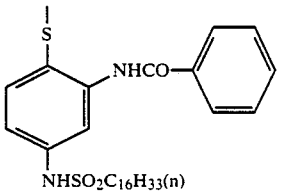
(Q-35)
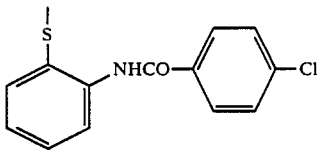
(Q-36)
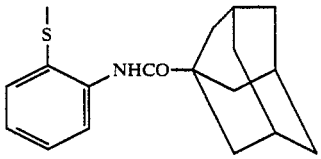
(Q-37)
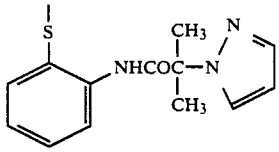
(Q-38)
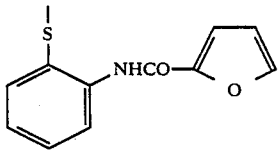
(Q-39)
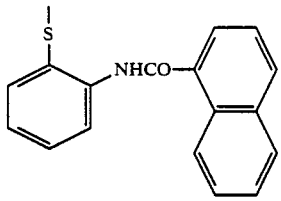
(Q-40)
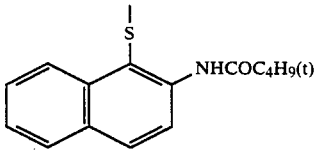

-continued
(Q-41)
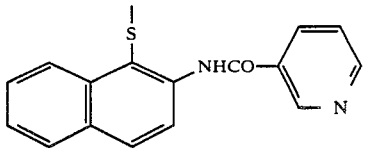
(Q-42)
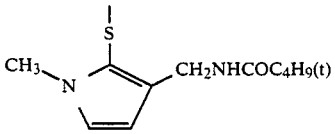
(Q-43)
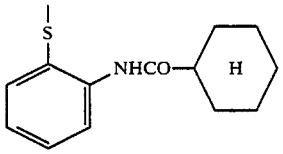
(Q-44)
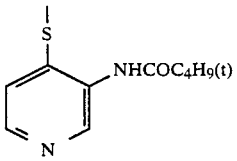
(Q-45)
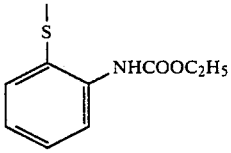
(Q-46)
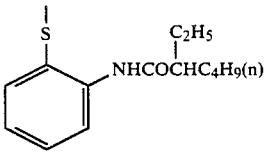
(Q-47)
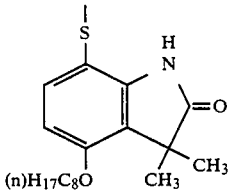
(Q-48)
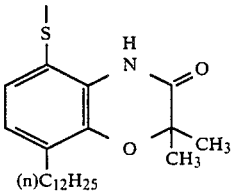
-continued
(Q-49)
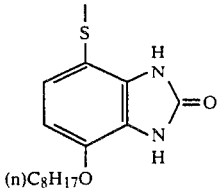
(Q-50)
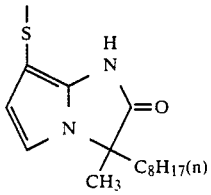
(Q-51)
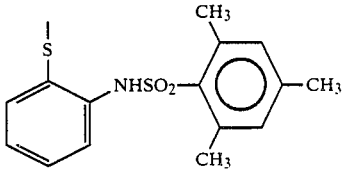
(Q-52)
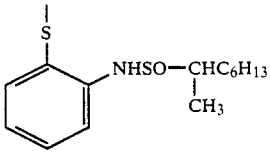
(Q-53)
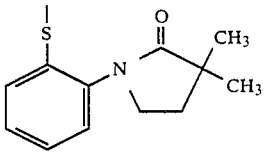
(Q-54)
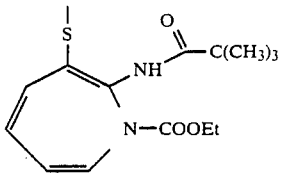
(Q-55)
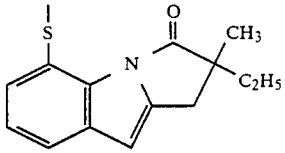
(Q-56)
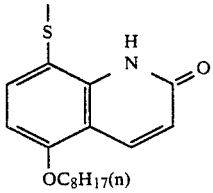

-continued
(Q-57)
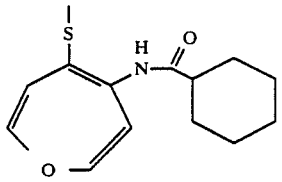
(Q-58)
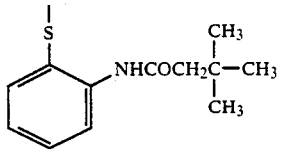
-continued
(Q-59)
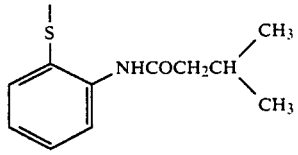
(Q-60)
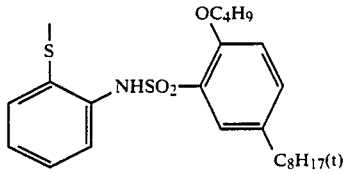
Specific examples of the couplers of the present invention will now be given, although the invention is not limited to these representative examples.
(M-1)
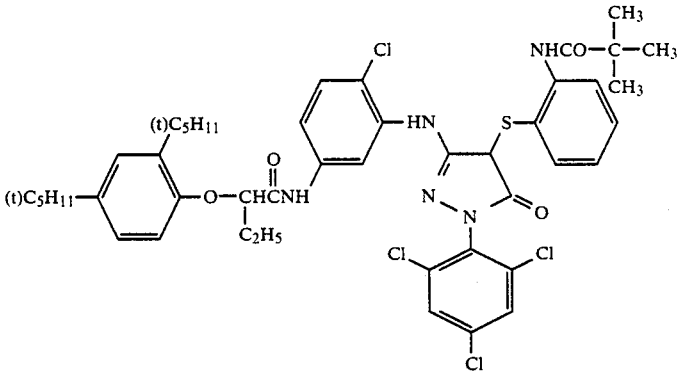
(M-2)
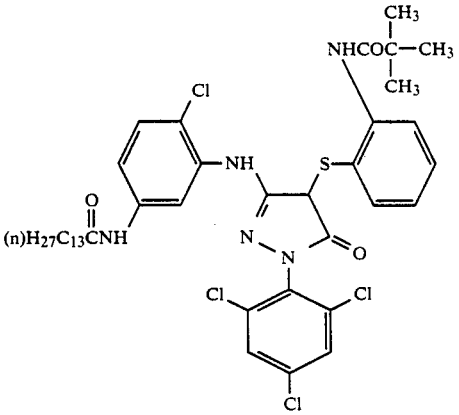
(M-3)
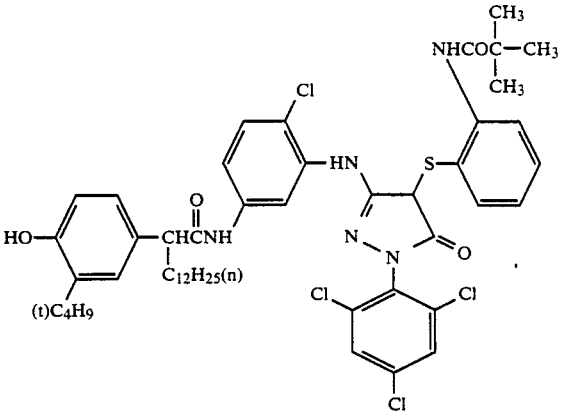

-continued
(M-4)
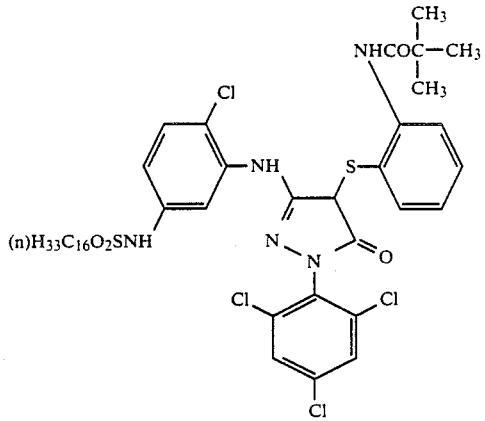
(M-5)
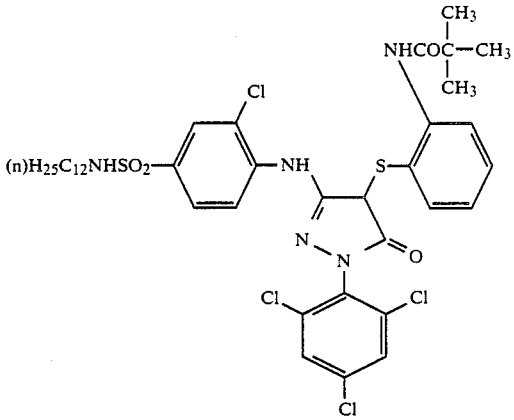
(M-6)
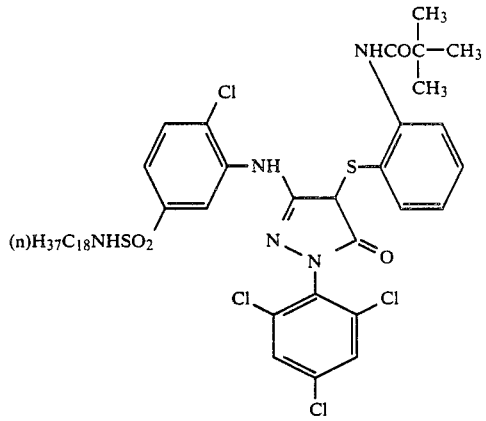
(M-7)
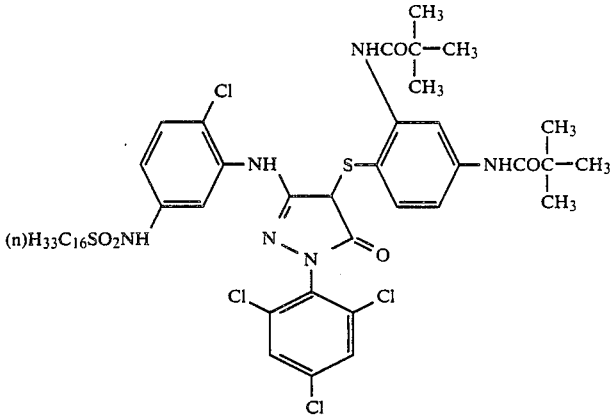

-continued
(M-8)
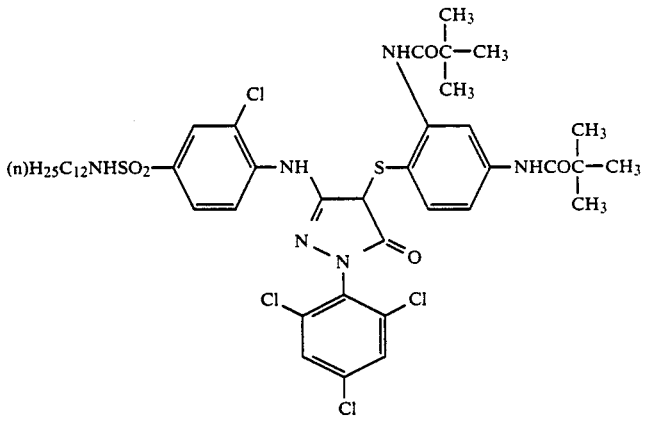
(M-9)
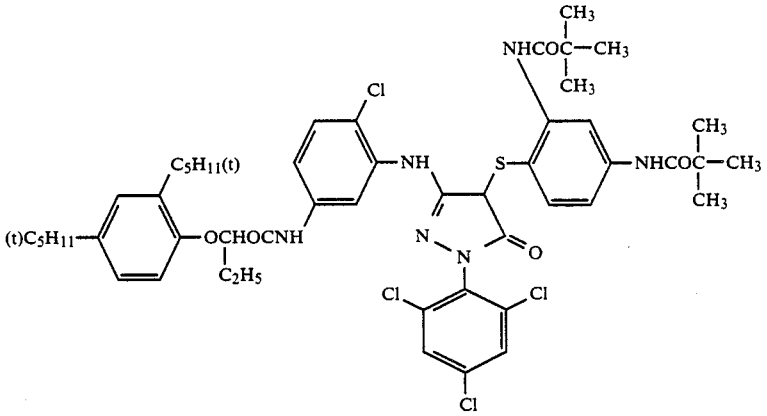
(M-10)
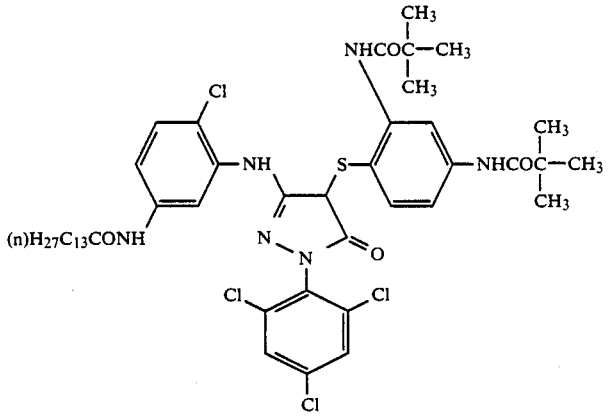
(M-11)
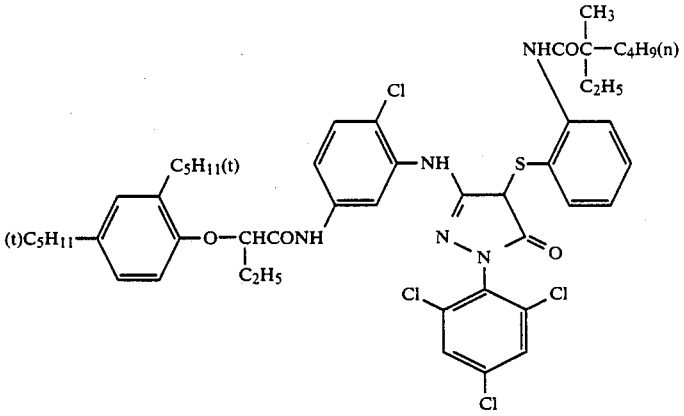

-continued
(M-12)
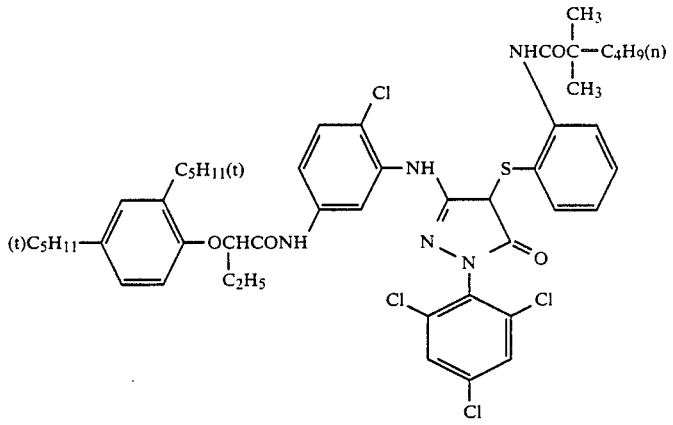
(M-13)
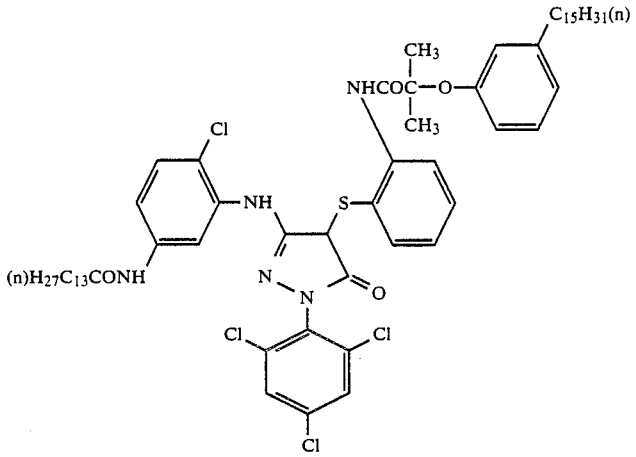
(M-14)
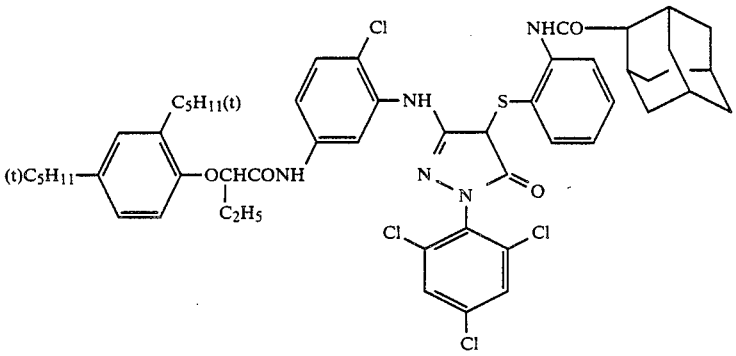

-continued
(M-15)
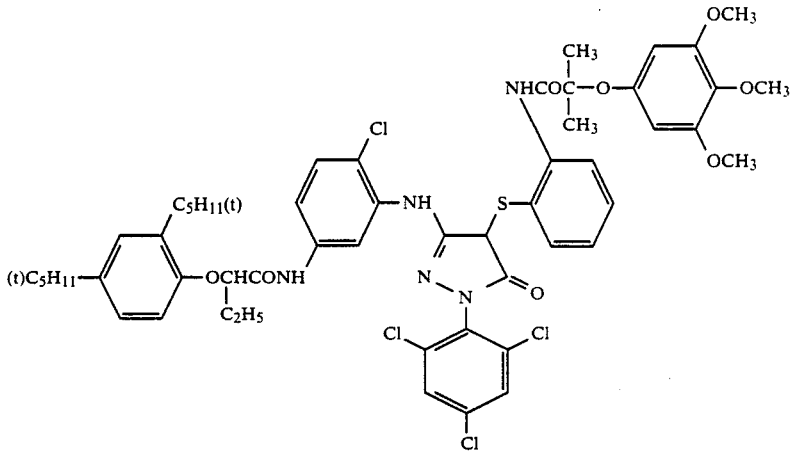
(M-16)
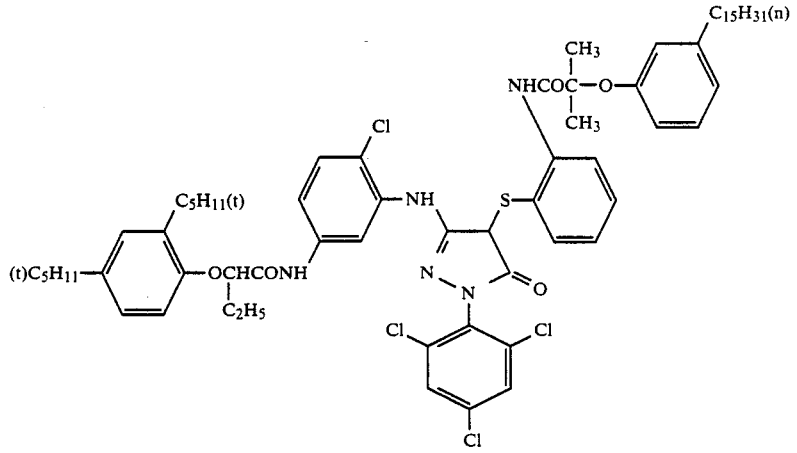
(M-17)
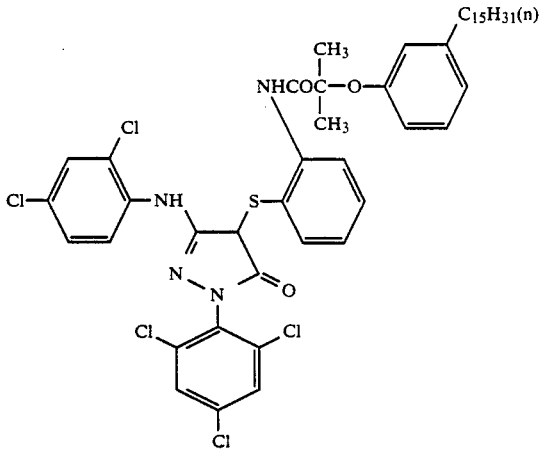

-continued
(M-18)
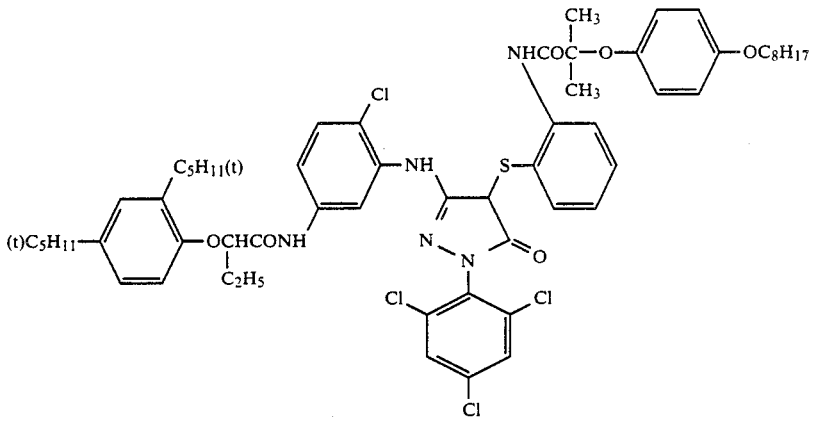
(M-19)
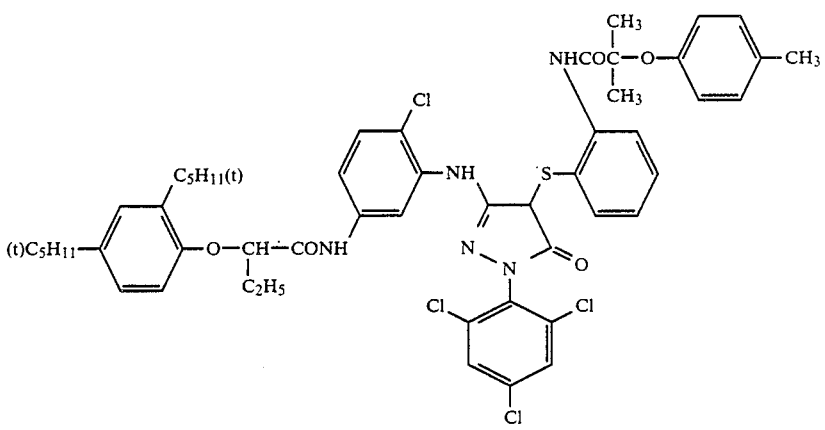
(M-20)
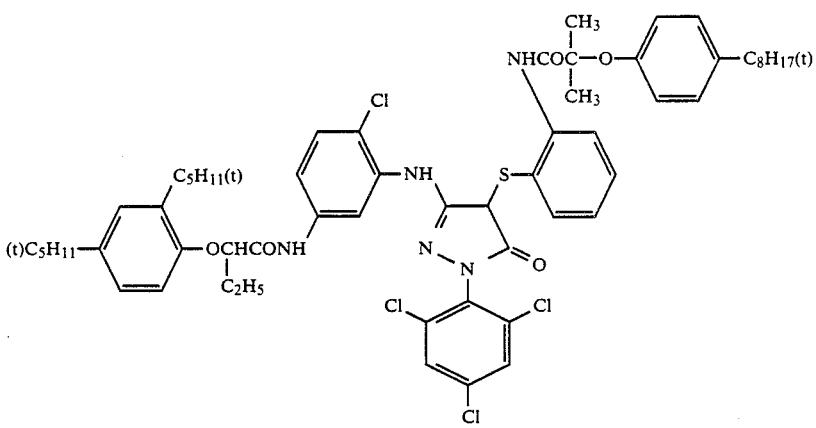
(M-21)
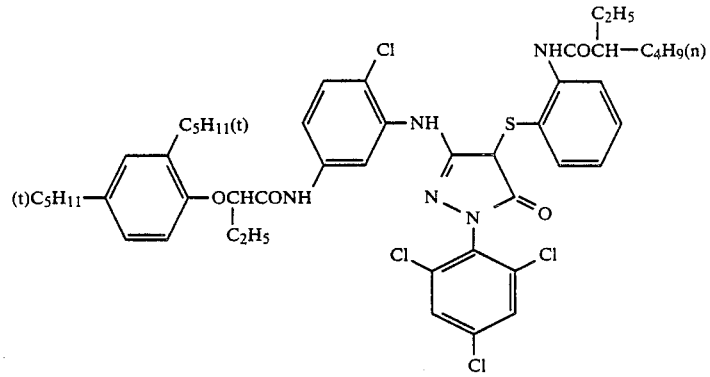

-continued
(M-22)
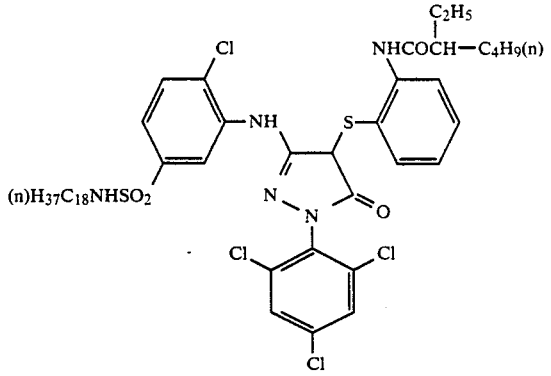
(M-23)
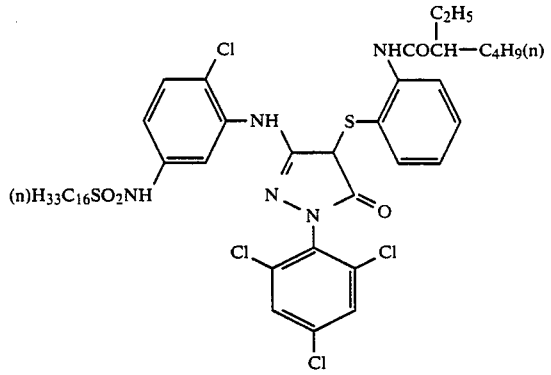
(M-24)
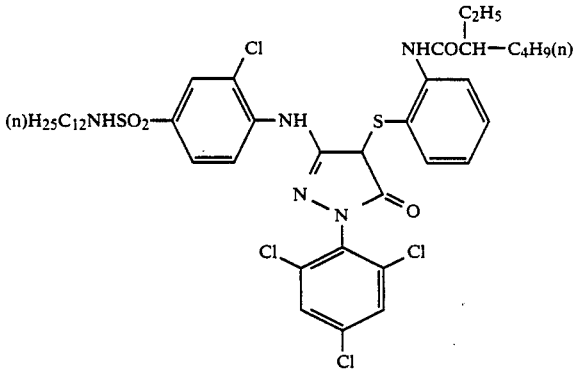
(M-25)
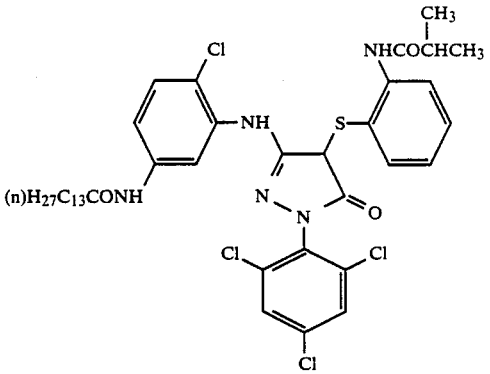

-continued
(M-26)
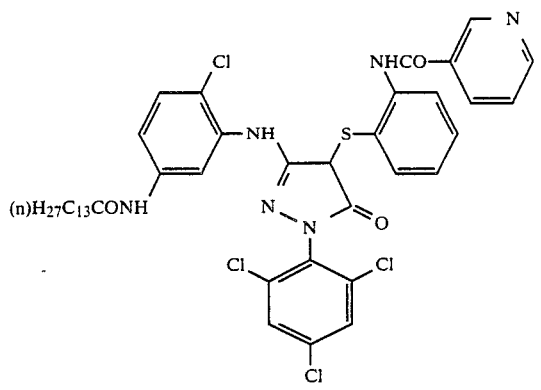
(M-27)
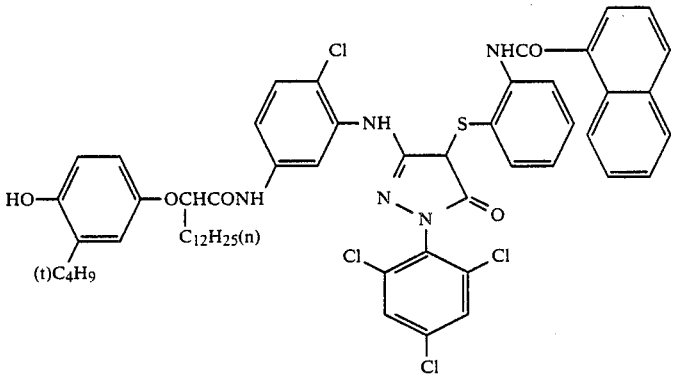
(M-28)
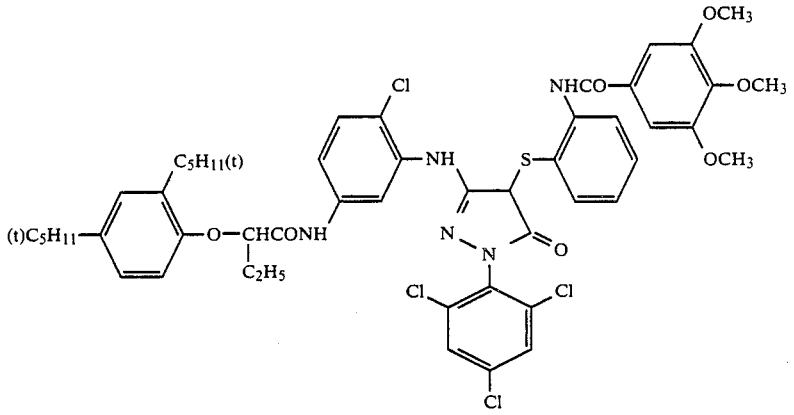
(M-29)
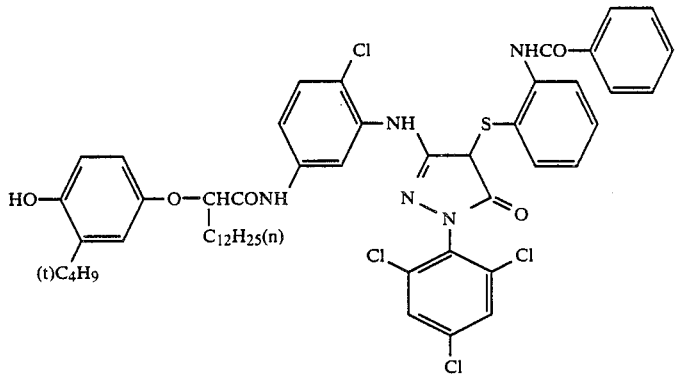

-continued
(M-30)
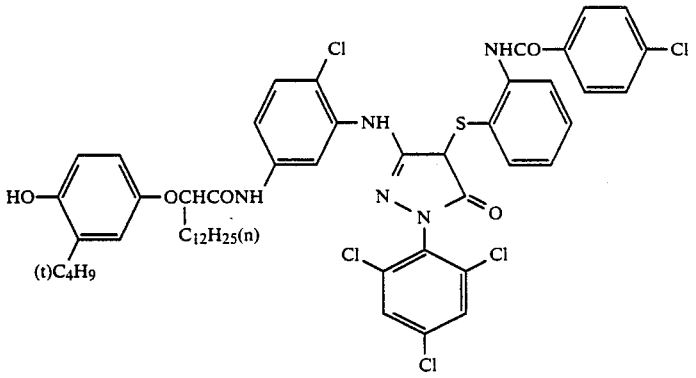
(M-31)
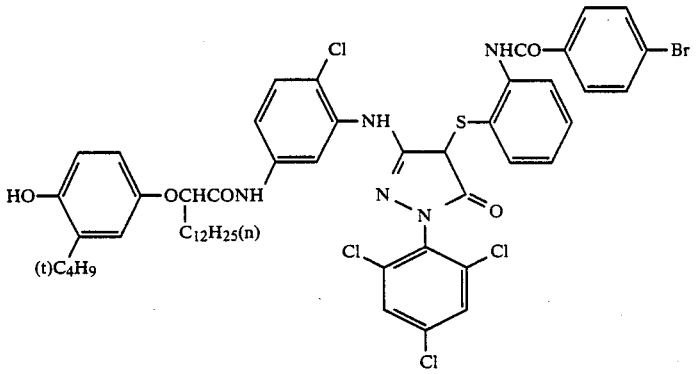
(M-32)
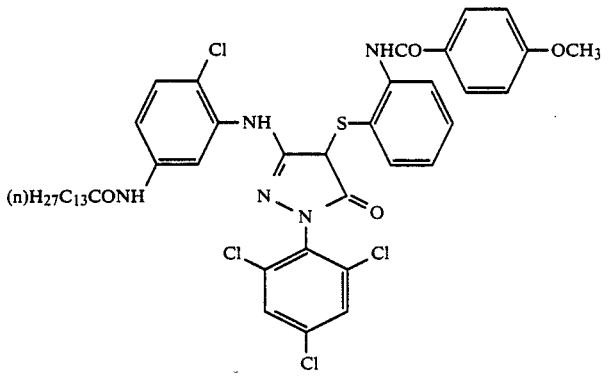
(M-33)
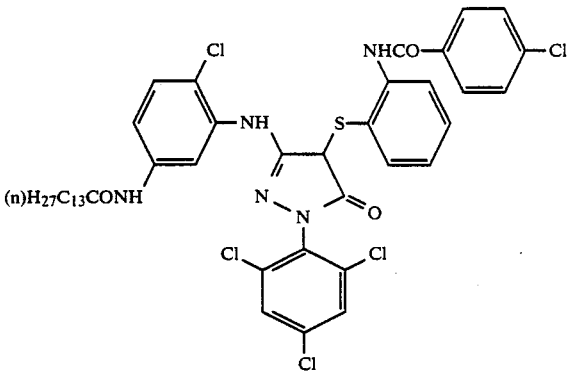

-continued
(M-34)
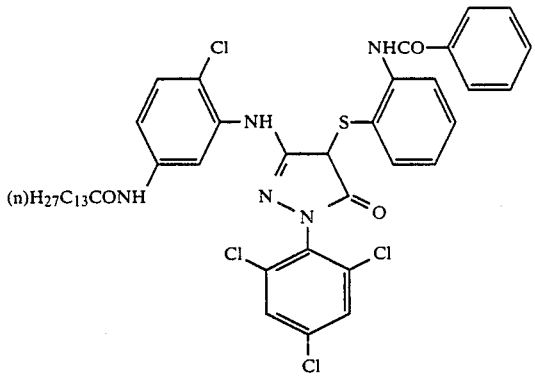
(M-35)
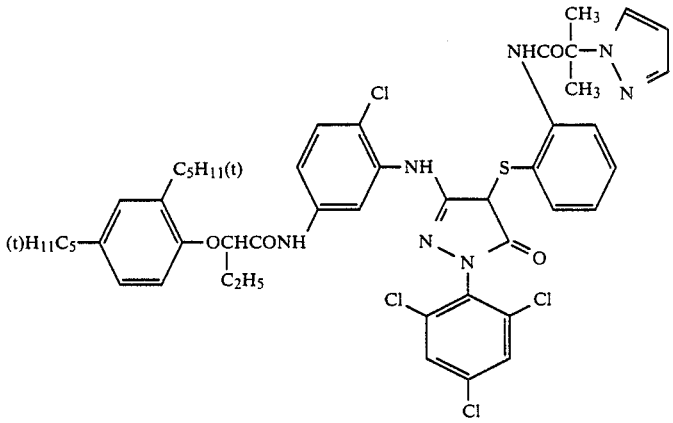
(M-36)
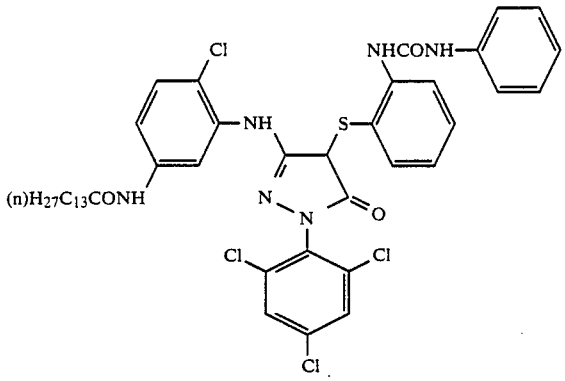
(M-37)
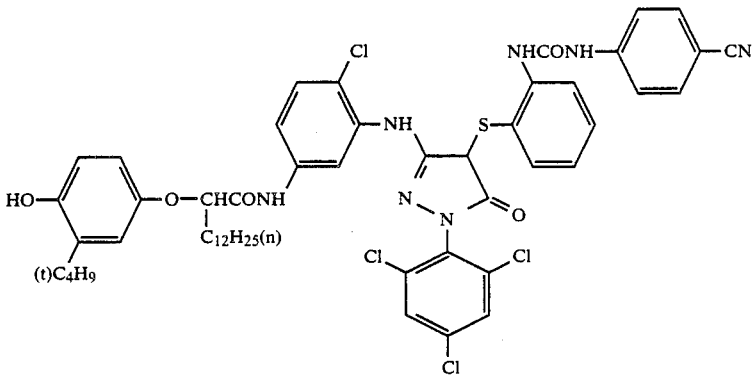

-continued
(M-38)
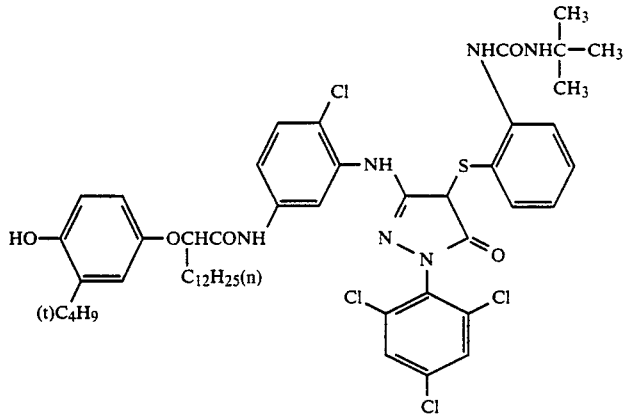
(M-39)
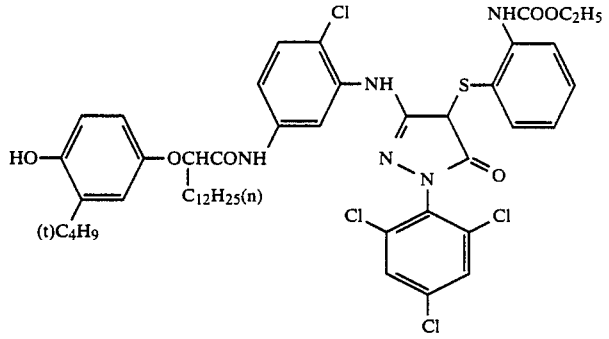
(M-40)
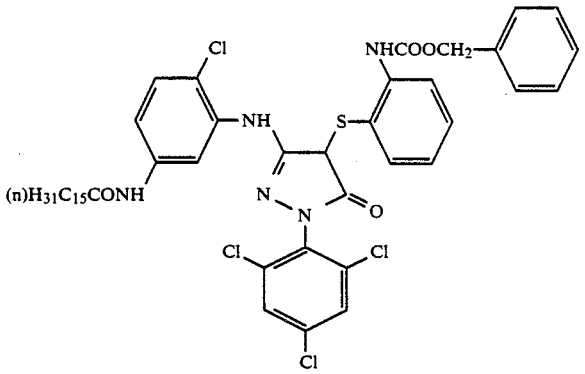
(M-41)
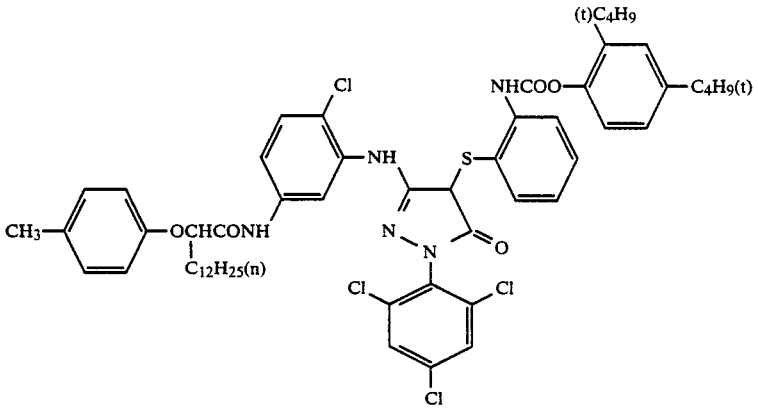

-continued
(M-42)
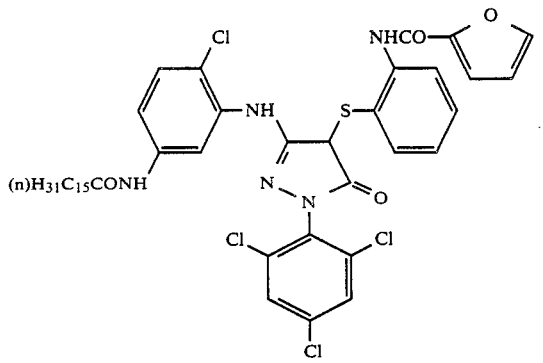
(M-43)
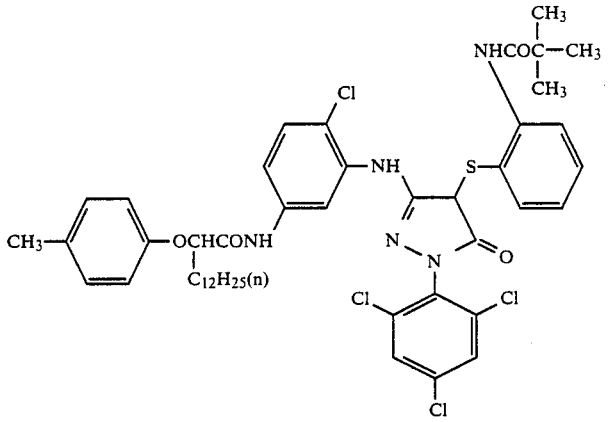
(M-44)
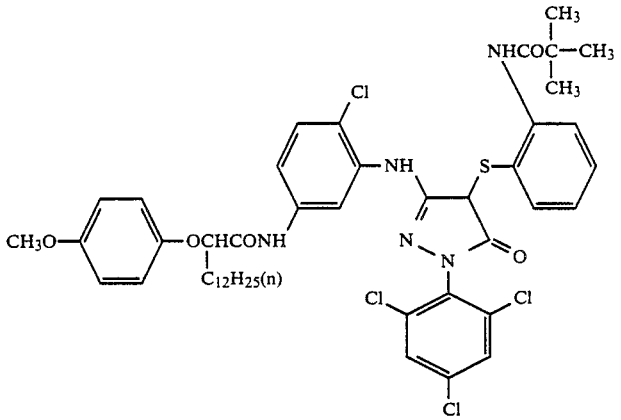
(M-45)
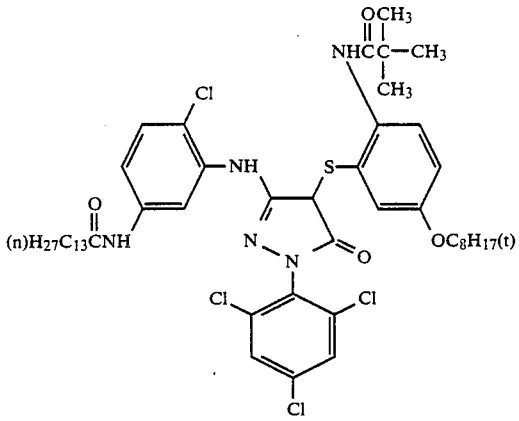

-continued
(M-46)
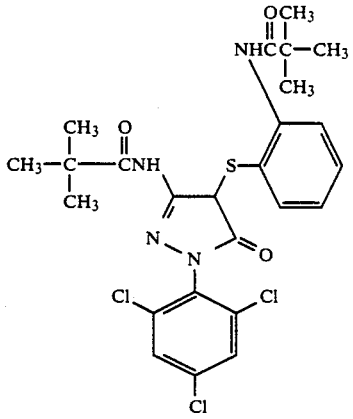
(M-47)
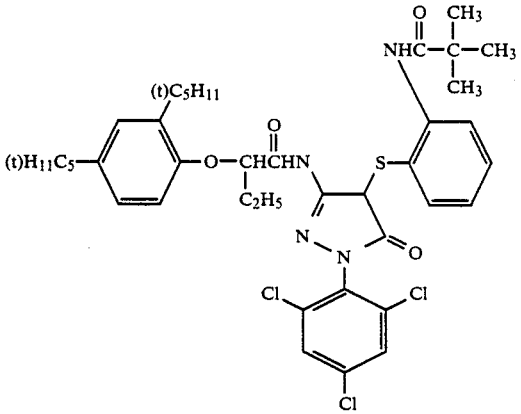
(M-48)
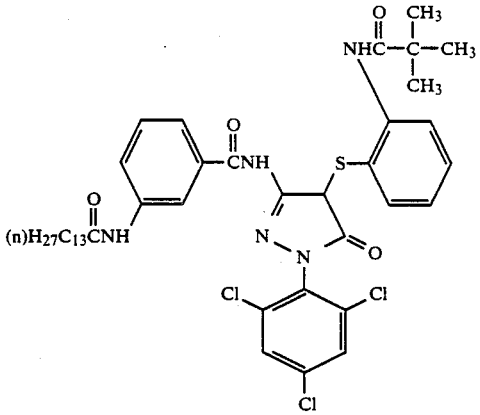
(M-49)
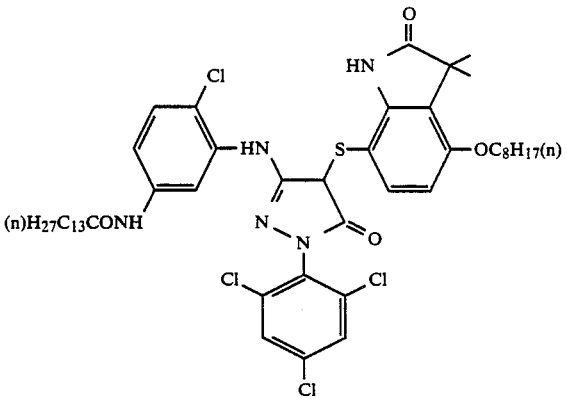

-continued
(M-50)
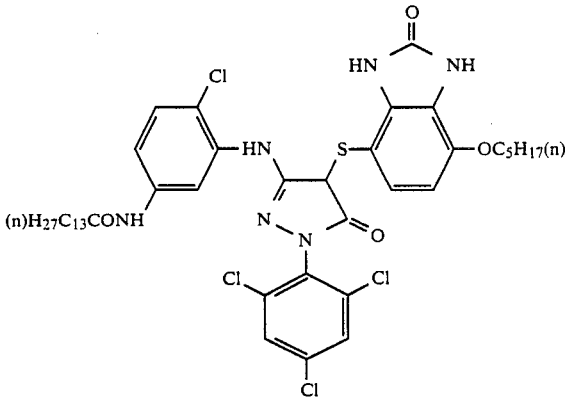
(M-51)
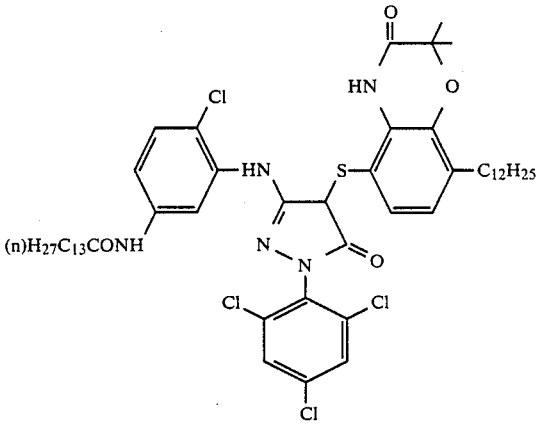
(M-52)
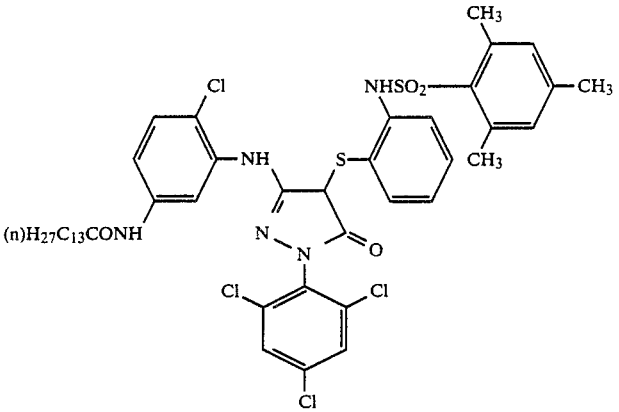
(M-53)
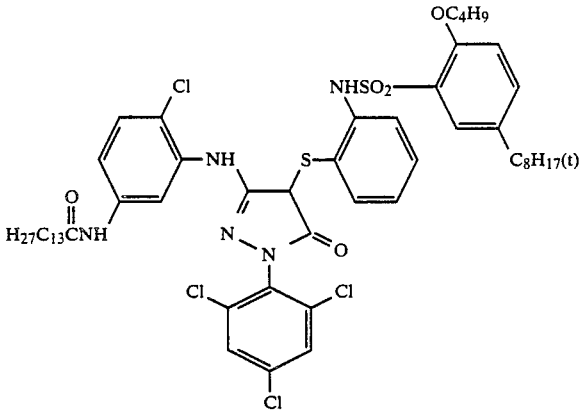

-continued
(M-54)
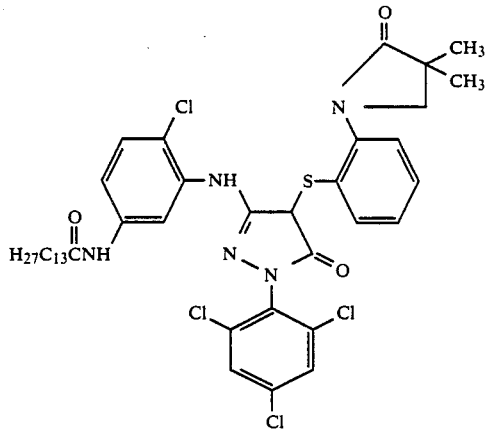
(M-55)
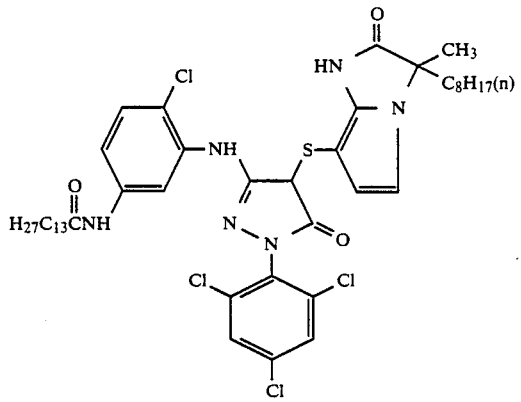
(M-56)
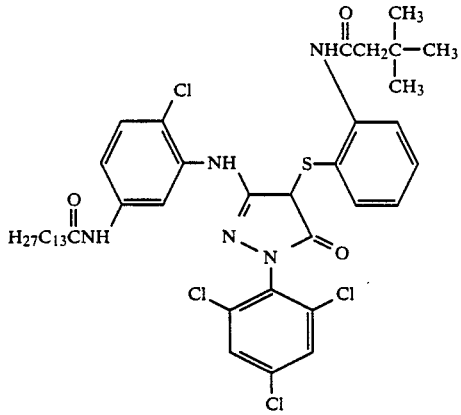
(M-57)
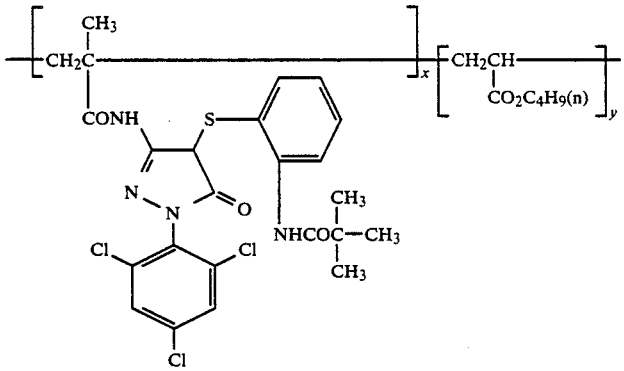
x:y = 50:50
(weight ratio: the same hereinafter)

-continued
(M-58)
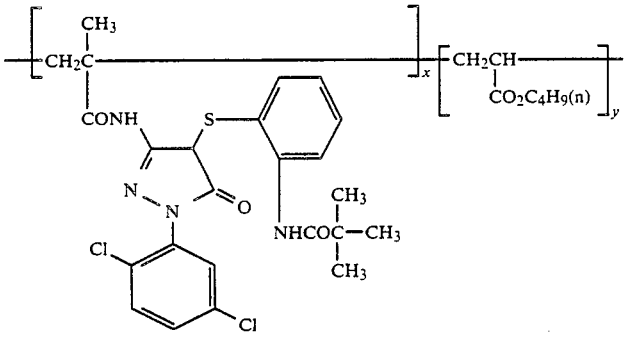
x:y = 60:40
(M-59)
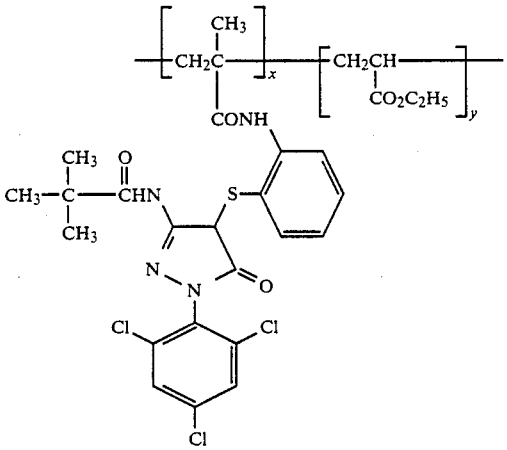
x:y = 45:55
(M-60)
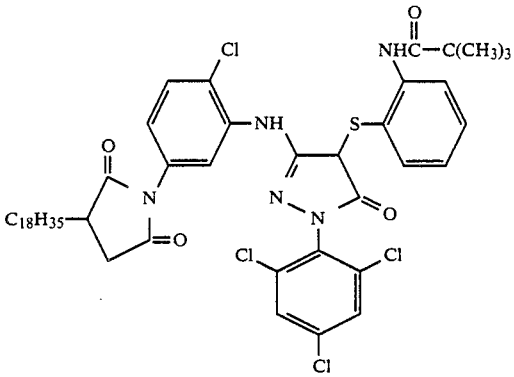
(M-61)
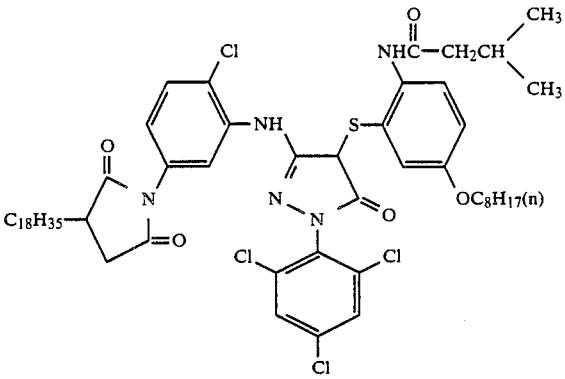

-continued
(M-62)
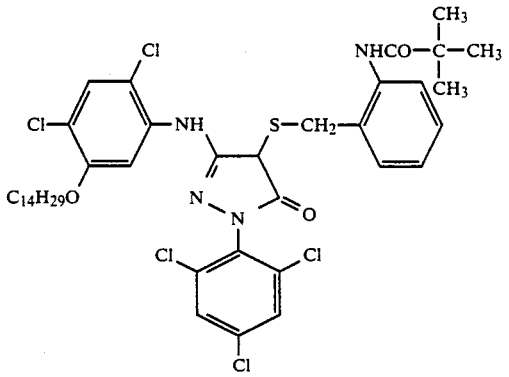
(M-63)
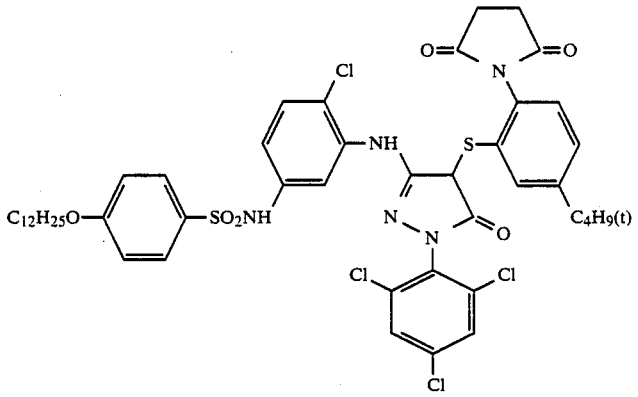
(M-64)
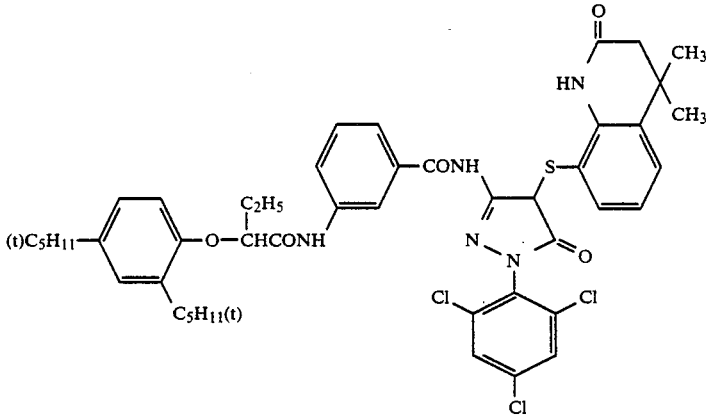
(M-65)
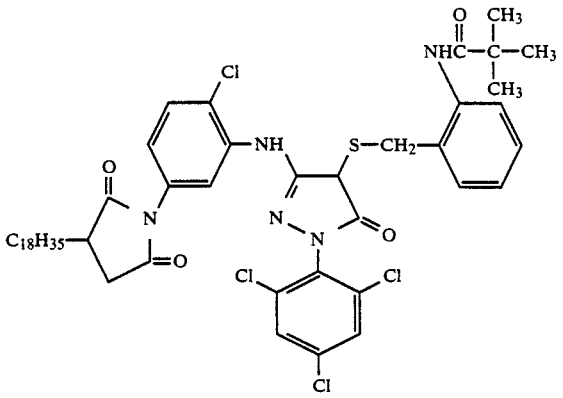

-continued (M-66)

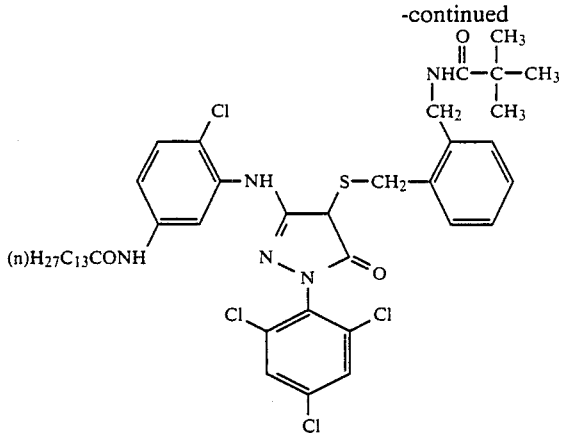

Magenta couplers with the elimination groups of the invention represented by general formula (I) can be synthesized by the method taught in Laid-open PCT International Patent No. WO-88-4795 or methods in accordance with this method.

The magenta coupler of the present invention is used preferably in an amount of from $1\times10^{-3}$ to 1 mol, more preferably from 0.1 to 0.5 mol per mol of silver halide in the silver halide emulsion layer.

Compounds represented by general formula (A) will now be described in further detail. $R_{00}$ represents an organic radical. An "organic radical" means a monovalent group resulting from the removal of one hydrogen atom from an organic compound and it can be, e.g.,

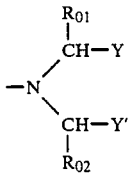

(wherein each symbol has the same meaning as in formula (A)), a substituted or an unsubstituted alkyl group, a substituted or an unsubstituted aryl group or a substituted or an unsubstituted heterocyclic group. Y and Y' may be the same or different and each represents $-CO_2M$,

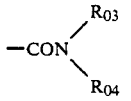

or $-PO_3M'_2$. M here represents a hydrogen atom, a sodium atom, a potassium atom, an ammonium ion, a quaternary amine (e.g., tetramethylammonium, tetrabutylammonium, trimethylbenzylammonium, N-methylpyridinium), a protonated amine compound (e.g., ethylammonium, triethylammonium, anilinium), an alkyl group (which represents a straight chain, branched chain or cyclic alkyl group, e.g., methyl, ethyl, propyl, isobutyl, benzyl, cyclohexyl, octyl, hexadecyl, and may be further substituted by substitution groups), an aryl group (e.g., phenyl, naphthyl, 4-hexadecyloxyphenyl, 2,4-dimethylphenyl, 3-chlorophenyl, 4-tetradecaneamidophenyl, 4-octyloxycarbonylphenyl) or a heterocyclic group (e.g., piperidyl, pyridyl, pyrrolidyl, furyl). M' represents a hydrogen atom, a sodium atom, a potassium atom, an ammonium ion, a quaternary amine (e.g., tetramethylammonium, tetrabutylammonium, trimethylacetylammonium, N-methylpyridinium) or a protonated amine compound (e.g., ethylammonium, triethylammonium, anilinium). $R_{03}$ and $R_{04}$ may be the same or different and each represents a hydrogen atom, an alkyl group (which represents a straight chain, branched chain or cyclic alkyl group, e.g., methyl, ethyl, propyl, isobutyl, benzyl, cyclohexyl, octyl, hexadecyl, and may be further substituted by a substituent), aryl group (e.g., phenyl, naphthyl, 4-chlorophenyl, 4-hexadecyloxyphenyl, 2,4-dimethylphenyl, 3-chlorophenyl, 4-tetradecaneamidophenyl, 4-octyloxycarbonylphenyl), an acyl group (e.g., acetyl, benzoyl), a sulfonyl group (e.g., ethanesulfonyl, benzenesulfonyl) or a heterocyclic group (e.g., piperidyl, pyridyl, pyrrolidyl, furyl). $R_{03}$ and $R_{04}$ may be mutually bonded to form a 5 to 7 membered ring.

Of the compounds represented by general formula (A), the compounds represented by the following general formula (A-1) are preferable and the following general formula (A-2) are more preferable from the point of view of the effects of the invention:

(A-1)

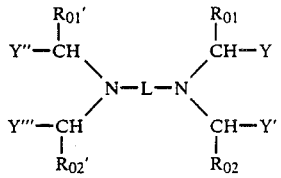

wherein $R_{01}$, $R_{02}$, Y and Y' in general formula (A-1)have the same meanings as in general formula (A). $R'_{01}$ and $R'_{02}$ have the same meanings as $R_{01}$ and $R_{02}$. Y'' and Y''' have the same meanings as Y and Y'.

L indicates a single bond or a divalent group which may have one or more groups represented by formula (C):

(C)

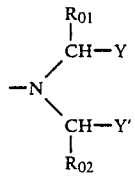

(wherein each symbol has the same meanings as defined in formula (A)).

Examples of the divalent groups include

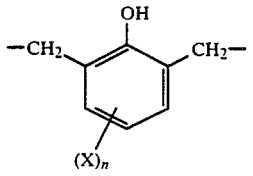

(wherein X represents an alkyl, aryl, acylamino, sulfonamido, heterocyclic amino, alkyloxycarbonyl, aryloxycarbonyl, sulfamoyl, carbamoyl, sulfonyl, urethane, ureido, heterocyclic, acyl, alkoxy, aryloxy, sulfo, carboxyl, hydroxy, nitro or cyano group or halogen atom (these groups may have one or more groups represented by the general formula (C)); n represents 0, 1 or 2; when n is 2, the two Xs may be the same or different), an alkylene group (including branched alkylene group),

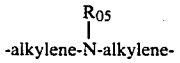

(wherein $R_{05}$ represents a substituted or unsubstituted alkyl, acyl or heterocyclic group).

Compounds represented by formula (A-1) may be in a form of polymer obtained by polymerization at X of the compound represented by formula (A-1).

More preferred compounds within the compounds represented by general formula (A-1) are the compounds represented by formula (A-2):

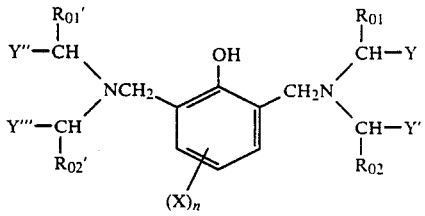

(A-2)

wherein each symbols are the same as defined in formula (A-1), and the most preferred compounds within the compounds represented by formula (A-2) are compounds wherein the total number of carbon atoms of X is 6 or more. More preferably, n is 1 and X is in the p-position with respect to the hydroxyl group on the benzene ring.

With respect to the compounds represented by general formula (A-1), the case where the total number of carbon atoms of $R_{01}$, $R_{02}$, $R'_{01}$, $R'_{02}$ and L is 5 or more is preferred.

In the present invention the number of the groups represented by general formula (C) is preferably from 2 to 6 in a molecule (other than a polymer molecule).

Specific examples of the compounds of the present invention represented by general formula (A) will now be given, although the compounds employable in the invention are not limited to these examples.

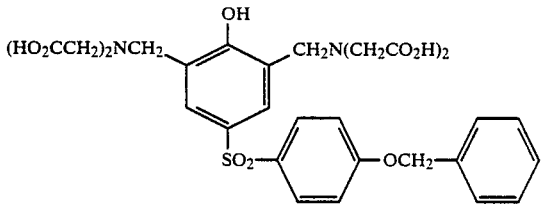

(A-1)

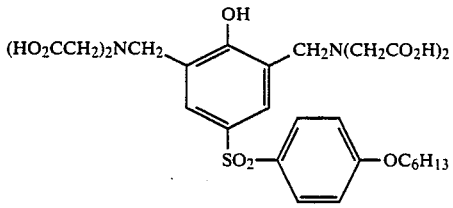

(A-2)

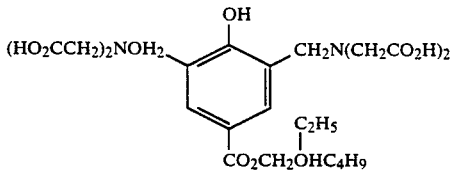

(A-3)

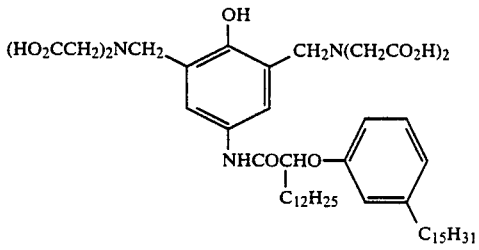

(A-4)

-continued
(A-5)
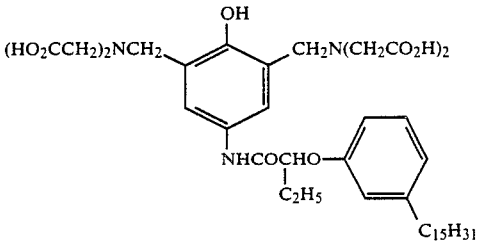
(A-6)
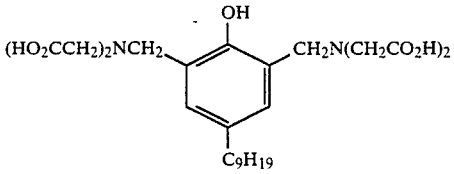
(A-7)
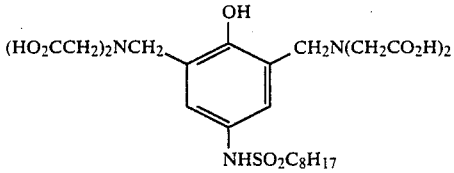
(A-8)
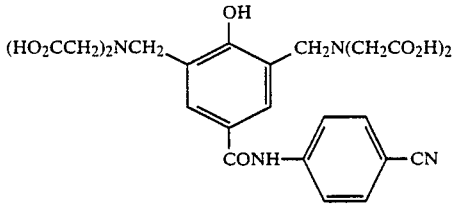
(A-9)
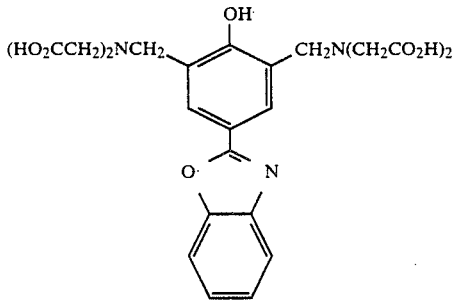
(A-10)
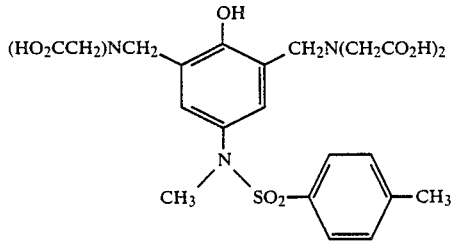
(A-11)
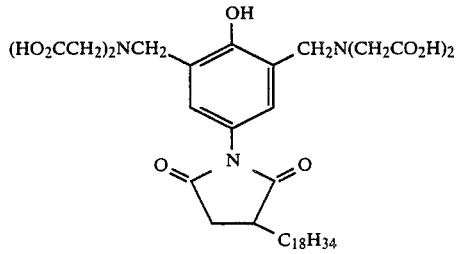

-continued
(A-12)
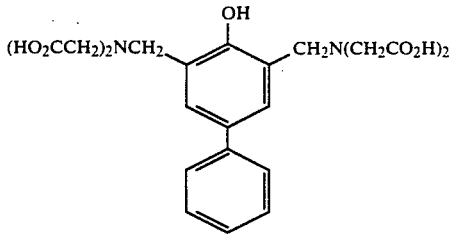
(A-13)
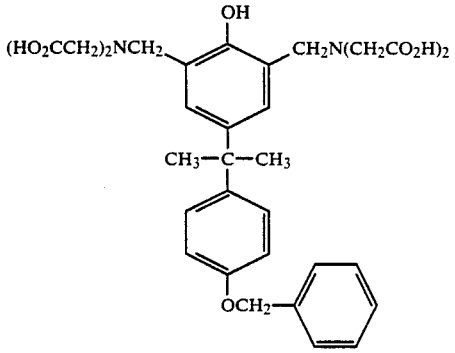
(A-14)
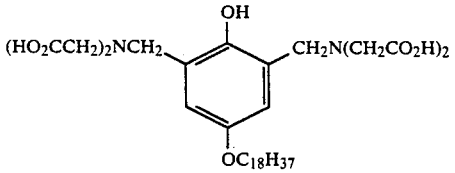
(A-15)
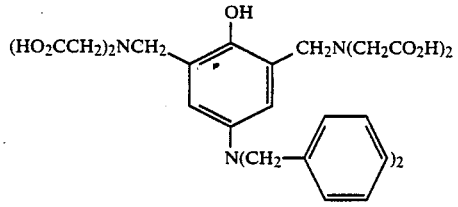
(A-16)
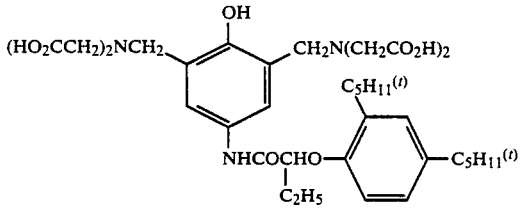
(A-17)
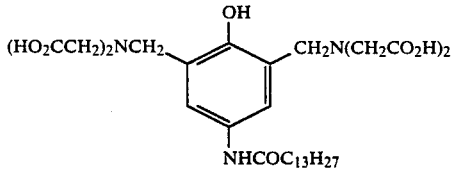
(A-18)
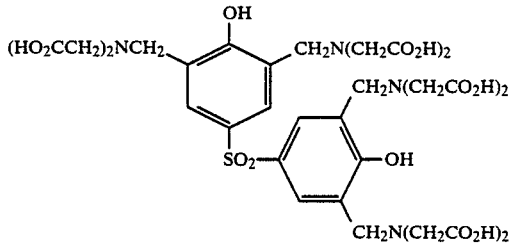

-continued
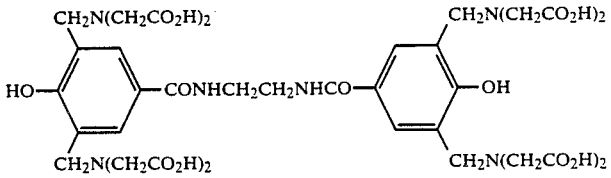
(A-19)
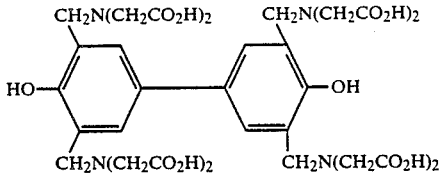
(A-20)
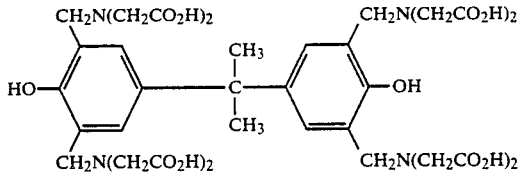
(A-21)
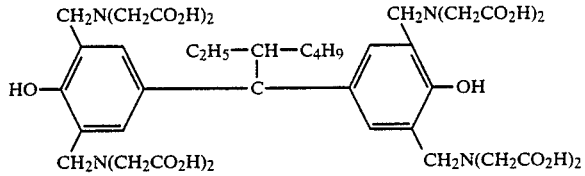
(A-22)
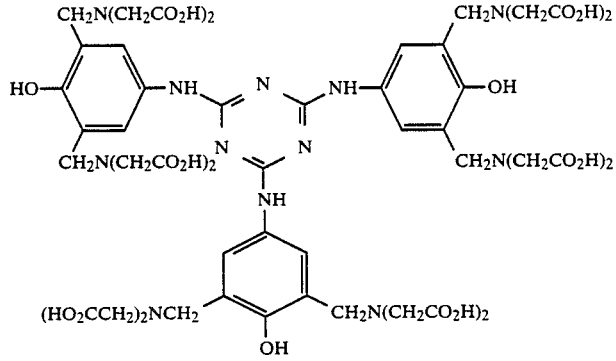
(A-23)
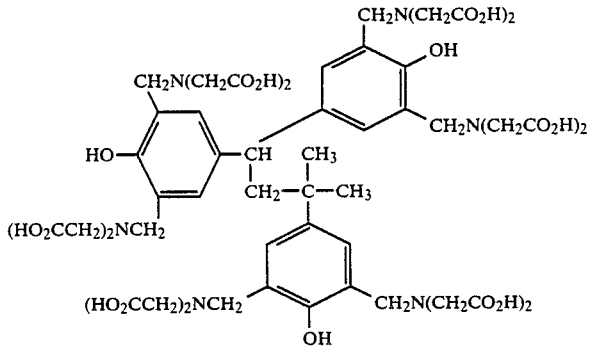
(A-24)
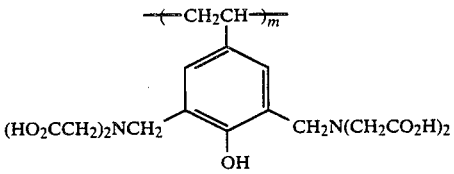
(A-25)
(molecular weight: 80,000)

-continued
(A-26)
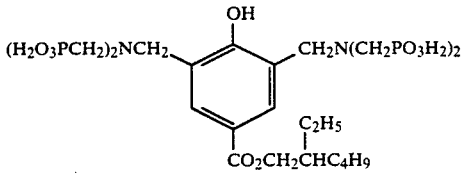
(A-27)
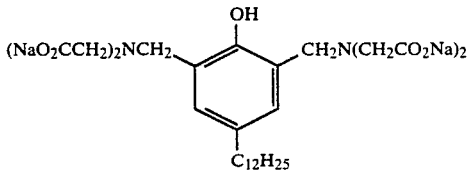
(A-28)
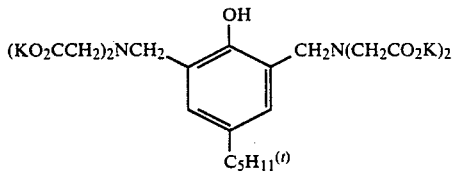
(A-29)
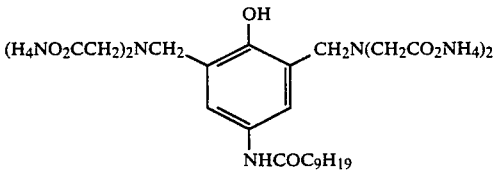
(A-30)
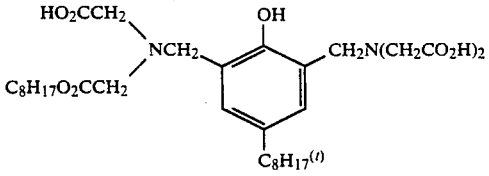
(A-31)
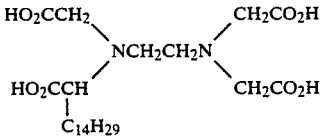
(A-32)
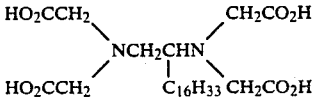
(A-33)
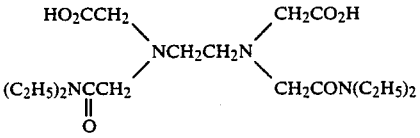
(A-34)
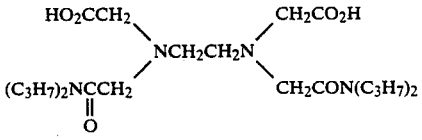
(A-35)
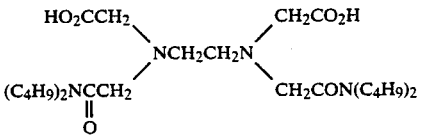

-continued
(A-36)
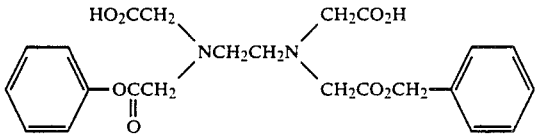
(A-37)
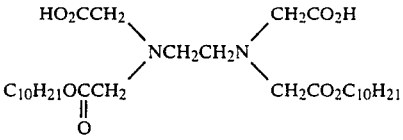
(A-38)
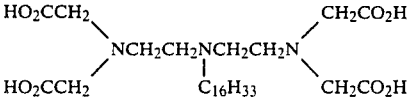
(A-39)
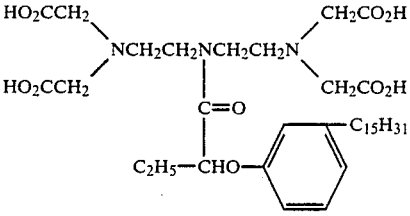
(A-40)
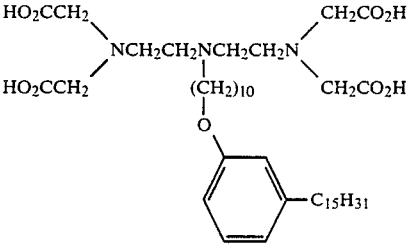
(A-41)
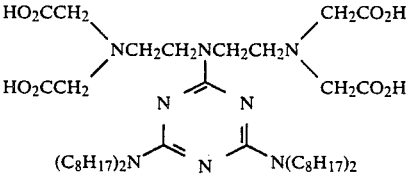
(A-42)
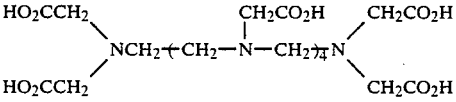
(A-43)
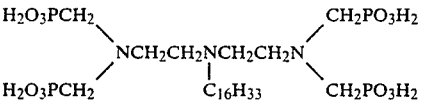
(A-44)
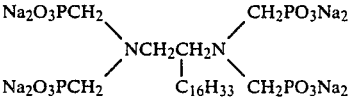
(A-45)
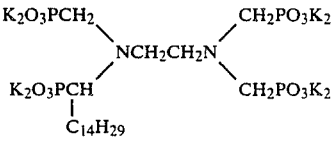

-continued (A-46)

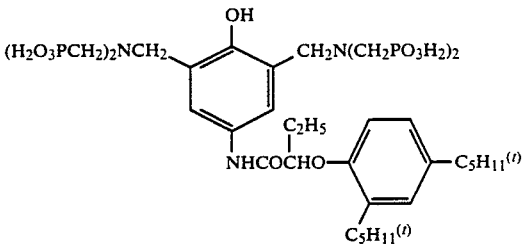

(A-47)

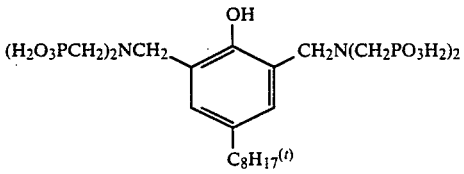

(A-48)

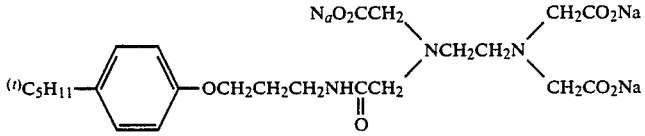

(A-49)

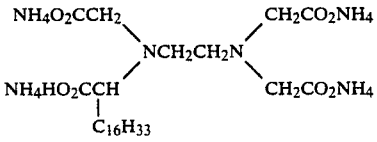

(A-50)

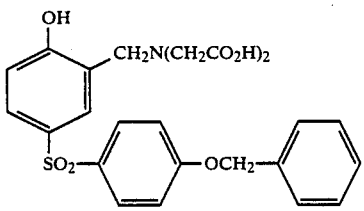

(A-51)

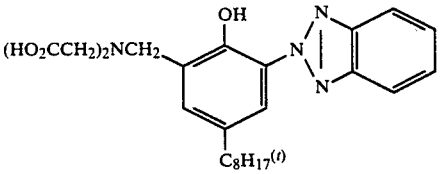

(A-52)

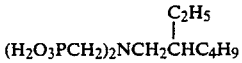

The compounds of the present invention represented by general formula (A) can be synthesized by following the method taught in JP-A-59-157632.

The compounds of the present invention represented by general formula (A) can be added to a photographic material in the form of an alkali salt (e.g., sodium hydroxide, potassium hydroxide) aqueous solution or if required can be added and dissolved in an organic solvent (e.g., methanol, ethanol, ethyl acetate). The present compounds can also be added after dissolution in a high boiling point organic solvent and emulsification and dispersion in a hydrophilic organic binder. The compounds of the present invention represented by general formula (A) may be used alone or in a mixture. The amount of the compounds of the present invention represented by general formula (A) varies considerably depending on the type of photographic material and, although there is no restriction to this, normally 0.01 to 5 g/m$^2$ of the compound is used and preferably 0.1 to 1 g/m$^2$ is used. When the amount exceeds 5 g/m$^2$ color development and preservability of the photographic material tends to be poor.

The compound of the present invention represented by general formula (A) may be added to any layer of the photographic material in the photographic material manufacturing stage. For example, the compound may be incorporated to a hydrophilic layer, preferably an emulsion layer, more preferably, a magenta coupler-containing layer or a layer adjacent thereto. It is most preferred that the compound is incorporated into both of these layers. Furthermore, the compound may be incorporated into a nonlight-sensitive layer, a support and a backing layer.

In order to improve color developability and fastness of color images and in order to prevent staining it is preferable to use compounds represented by the following general formula (B) together with the compounds of the invention represented by general formula (B):

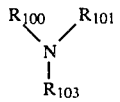

(B)

wherein $R_{100}$ represents a substituted or an unsubstituted alkyl or alkenyl group and $R_{101}$ represents a hydrogen atom or a Substituted or an unsubstituted alkyl or alkenyl group. $R_{103}$ represents a substituted or an unsubstituted aryl group. $R_{100}$ and $R_{101}$ may be bonded together and form a 5- to 7-membered hydrocarbon or heterocyclic ring. $R_{100}$ and/or $R_{101}$ may bond to $R_{103}$ to form a 5- to 7-membered hydrocarbon or heterocyclic ring. It is noted, however, that neither $R_{100}$ nor $R_{101}$ is a tertiary alkyl group.

Examples of substituents of the substituted alkyl and alkenyl groups represented by $R_{100}$ or $R_{101}$ include an alkoxy group, a sulfamoyl group and a carbamoyl group, and examples of substituents of the aryl group represented by $R_{103}$ include an alkyl group, an alkoxy group, a substituted amino group, an N-atom-containing heterocyclic group, a halogen atom, an alkylthio group and an aryl group.

Representative examples of these compounds will now be given but the compounds employable in the invention are not limited to these representative compounds.

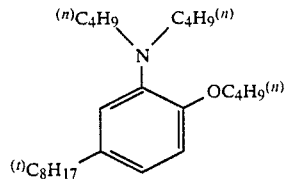

(B-1)

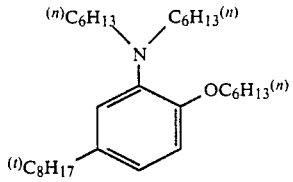

(B-2)

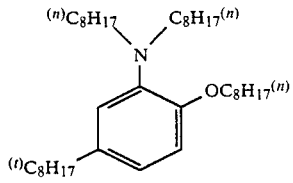

(B-3)

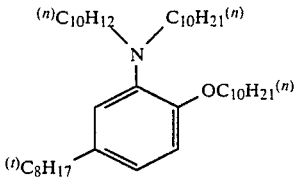

(B-4)

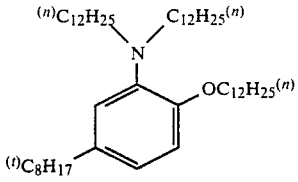

(B-5)

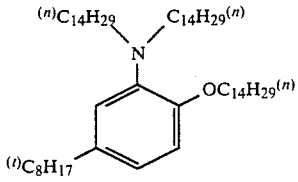

(B-6)

-continued
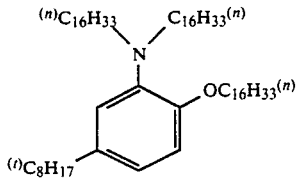
(B-7)
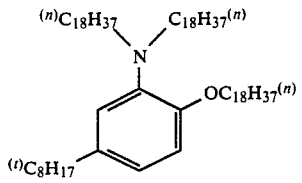
(B-8)
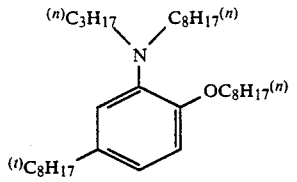
(B-9)
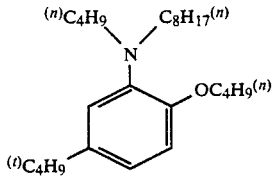
(B-10)
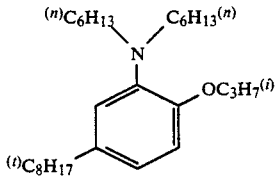
(B-11)
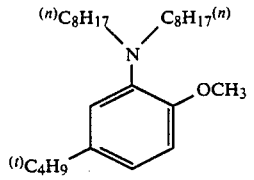
(B-12)
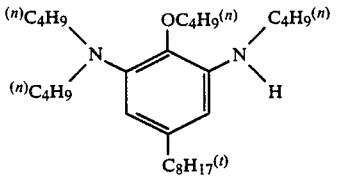
(B-13)
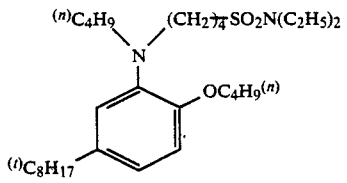
(B-14)

-continued
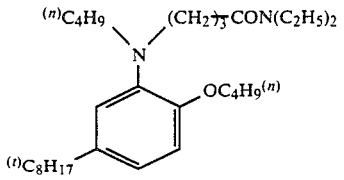
(B-15)
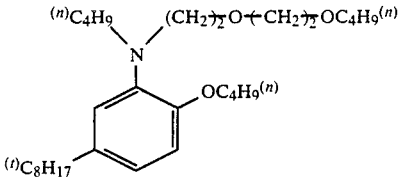
(B-16)
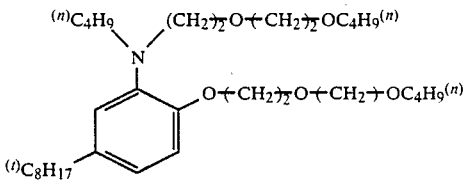
(B-17)
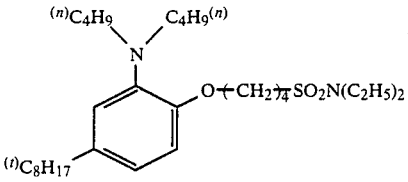
(B-18)
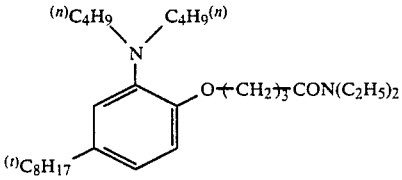
(B-19)
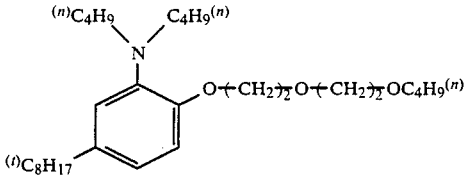
(B-20)
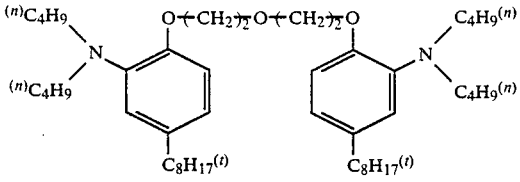
(B-21)
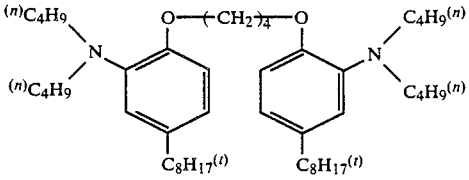
(B-22)

-continued
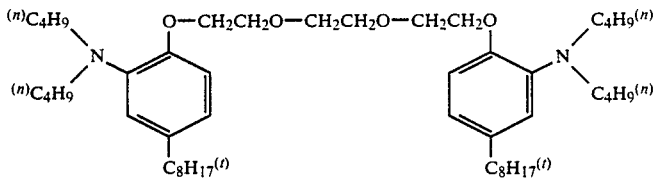
(B-23)
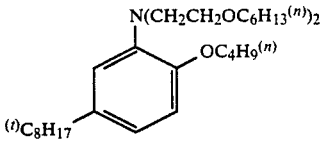
(B-24)
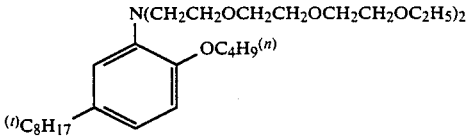
(B-25)
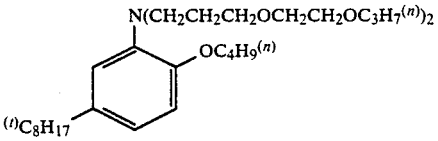
(B-26)
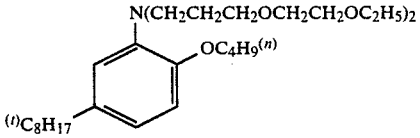
(B-27)
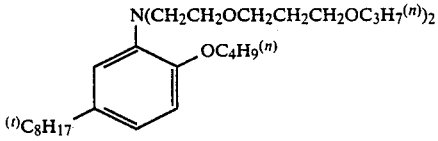
(B-28)
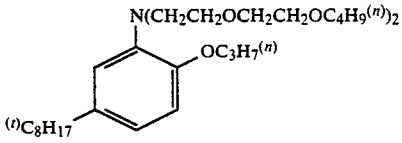
(B-29)
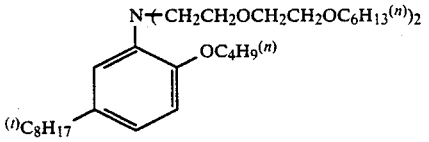
(B-30)
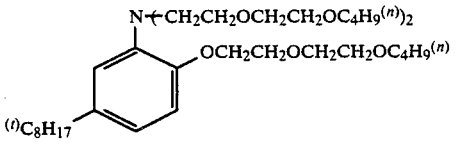
(B-31)
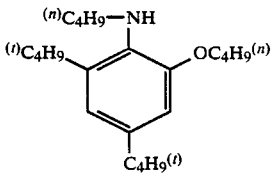
(B-32)

-continued
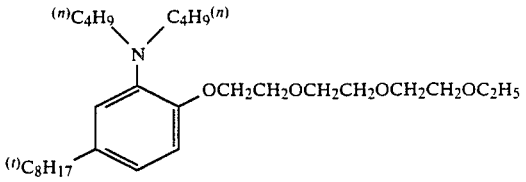
(B-33)
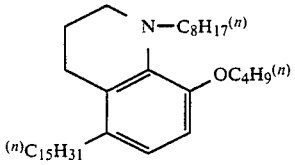
(B-34)
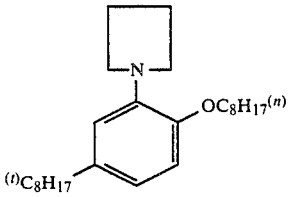
(B-35)
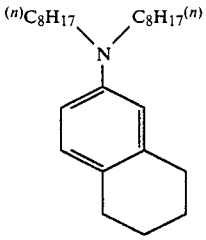
(B-36)
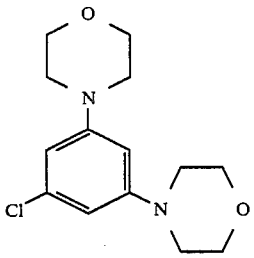
(B-37)
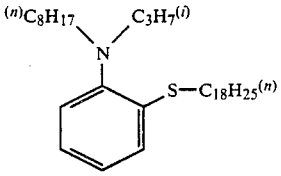
(B-38)
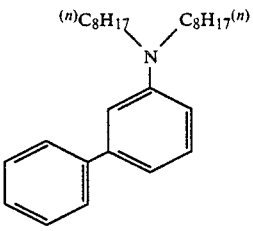
(B-39)

-continued
(B-40)
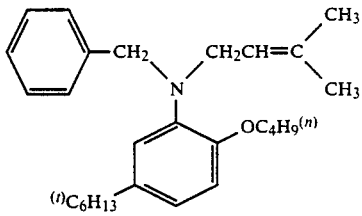
(B-41)
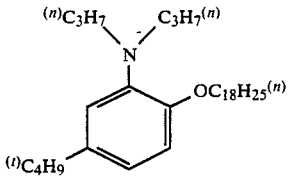
(B-42)
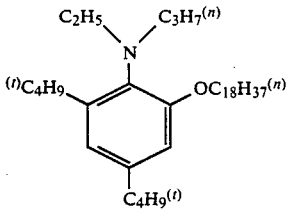
(B-43)
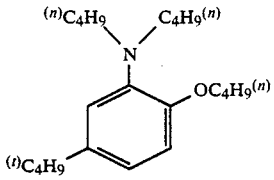
(B-44)
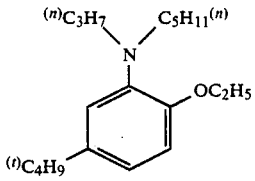
(B-45)
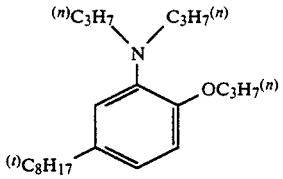
(B-46)
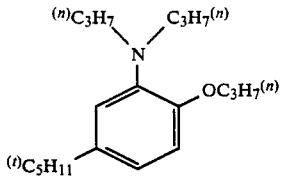
(B-47)
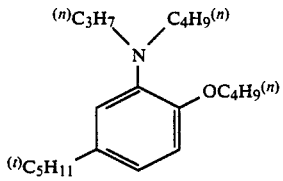

-continued

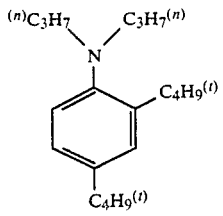

(B-48)

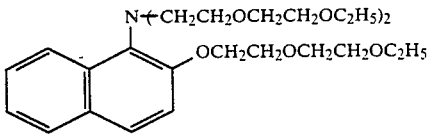

(B-49)

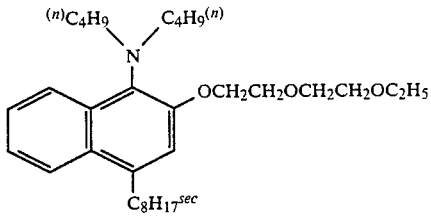

(B-50)

The compounds of the present invention represented by general formula (B) can be synthesized according on the synthesis method disclosed in J. Org. Chem., 37, 137 ('72), J. Org. Chem., 42, 2082 ('77), Chem. Left., 1265 ('74) and J. Am. Chem. Soc., 96, 7812 ('74), etc.

The addition of the compounds of the present invention represented by general formula (B) is preferably in the range 5 to 500 mol % relative to the 2-equivalent magenta coupler of the invention, a range of 30 to 300 mol % being particularly preferred. When the amount exceeds 500 mol % color developability tends to be deteriorated.

The compound represented by formula (B) is incorporated into the layer as described for the compound represented by formula (A). The compounds represented by formulae (A) and (B), respectively, may be incorporated into the same layer or into different layers. It is preferred that the compound represented by formula (B) is co-emulsified with the magenta coupler and incorporated into an emulsion layer. It is also preferred that the compound represented by formula (A) is incorporated into a silver halide emulsion, on the other hand the compound represented by formula (B) is incorporated into a coupler-emulsified dispersion, and the emulsion and the dispersion are mixed to provide an emulsion layer coating.

The color photographic light-sensitive material of the invention can be constituted by coating at least one layer each of a blue-sensitive silver halide emulsion, a green-sensitive silver halide emulsion and a red-sensitive silver halide emulsion on a support. This is the usual order of coating the layers on a support for ordinary color photographic paper but the order may be different from this. If these photographic emulsion layers contain silver halide emulsions sensitive to these respective wavelength regions, the so-called color couplers which form dyes that are in a complementary color relation to the sensitizing light, i.e., yellow for blue, magenta for green and cyan for red, produce color reproduction that can be effected by the color subtraction process. However, the structure may be one in which the correspondences between the photographic layers and the hues produced by the couplers are different from what is described here.

Silver halide consisting of silver chloride or silver chlorobromide containing essentially no silver iodide can suitably used in the present invention. What is meant by "essentially no silver iodide" is that the silver iodide content is not more than 1 mol % and is preferably 0.2 mol % or less. The halogen composition may be different or may be the same in different grains in an emulsion but it is easier to achieve homogeneity of grain properties if one uses an emulsion in which the grains have the same halogen composition. With regard to the halogen composition distribution inside the silver halide emulsion grains, one can suitably select and use grains such as grains with a so-called uniform structure in which the composition is the same in all parts of the grains, or grains with a so-called laminate structure in which the halogen composition in the core inside a grain and the surrounding shell (one or a plurality of layers) have different halogen compositions or grains whose interiors and outer surfaces contain portions in which there is a non-stratified variation of the halogen composition (in the case of such variation at the grain surface, the structure being one in which portions having different compositions are joined on edges, corners or faces). For the purpose of achieving high sensitivity, rather than using grains with a uniform structure, it is advantageous to use one of the latter two types, which are also preferable from the point of view of pressure resistance. When silver halide grains with such structures are used, there may be a clear boundary at the boundaries between different portions or the boundary may be unclear due to the formation of mixed crystals because of the differences in the compositions. Also, one may take positive measures to bring about a continuous structural change.

The halogen compositions of the silver chlorobromide emulsions that are employed may be compositions with any desired silver bromide/silver chloride ratio. This ratio may be varied over a wide range in accordance with purposes and one may suitably employ silver halide with a silver chloride ratio of 2% or more.

So-called "high silver chloride" emulsions which have a high silver chloride content may be suitably used in order to produce photographic material that is suited to rapid processing. The silver chloride content of such high silver chloride emulsions is preferably 90 mol % or more, 95 mol % or more being even more preferred.

Of these high silver chloride emulsions, it is preferable to have emulsions with a structure possessing a silver bromide locallized phase in a laminar form or in a non-laminar form such as noted above in the silver halide grain interiors and/or at their surfaces. The halogen composition in such a locallized phase is preferably one with a silver bromide content of at least 10 mol %, a composition with a silver bromide content of over 20 mol % being more preferable. This locallized phase may be present in the interior of the grains or at the edges or corners or on the faces of the grain surfaces and one suitable example that one may cite is wherein the layers are produced by epitaxial growth on grain corner portions.

On the other hand, in order to prevent as much as possible any lowering of speed when the photographic material is subjected to pressure, it is preferable to use grains having a uniform structure with little grain halogen composition distribution, even in high silver chloride emulsions with a silver chloride content of 90 mol % or more.

Increasing the silver chloride content of the silver halide emulsions still further is effective from the point of view of reducing the amount of replenisher development processing solution. In this case, it is preferable to use a practically pure silver chloride emulsion having a silver chloride content of 98 to 100 mol %.

The silver halide grains contained in the silver halide emulsions used in the invention preferably have an average grain size (the numerical average of equivalent circle diameters of the projected area of the grains) of 0.1 to 2 μm.

Preferably, the emulsion used is a so-called monodisperse emulsion having a grain size distribution such that the variation coefficient (a value obtained by dividing the grain size standard deviation with the average grain size) is 20% or less and preferably not more than 15%. In order to afford a good degree of latitude in this case, two or more of the monodisperse emulsions are preferably blended and coated to form one layer or coated as several layers.

Grains having a cubic, tetradecahedral, octahedral or similar regular crystal form, grains having a spherical, tabular or similar irregular crystal form or grains having a shape that is a composite of such forms may be employed as the silver halide grains of the photographic emulsion. The grains may also be a mixture containing different crystal forms. Within these various forms, it is preferable in the invention to use grains which contain 50% or more, preferably 70% or more and more preferably 90% or more of grains having a regular crystal form.

Apart from these materials, one may also suitably use emulsions in which, in terms of the projected area, have tabular grains with an average aspect ratio (equivalent circle diameter/thickness) of 5 or more, or preferably 8 or more which represents more than 50% of the total grains.

Silver chlorobromide emulsions used in the invention can be prepared by the methods described by P. Glafkides in "Chimie et Physique Photographique" (Paul Montel Company, 1967), G. F. Duffin in "Photographic Emulsion Chemistry" (Focal Press, 1966) and V. L. Zelikman et al. in "Making and Coating Photographic Emulsion" (Focal Press, 1964), etc. In other words, the method may be an acid process or a neutral process or an ammonia process, etc. The process in which the soluble silver salts and the soluble halogen salts are reacted may be a single jet process, a double jet process or a combination of such processes. It is also possible to use a process in which the grains are formed in an atmosphere in which there is an excess of silver ions (the so-called reverse mixing process). One form of a double jet process that may be employed is the so-called controlled double jet process in which the pAg in the liquid phase for forming a silver halide is maintained at a constant level. This process makes it possible to produce a silver halide emulsion in which the crystal form is regular and the grain size is nearly uniform.

A variety of polyvalent metal impurities may be introduced in the emulsion grain forming stage or in the physical ripening stage of the silver halide emulsion that is used in the invention. Salts of cadmium, zinc, lead, copper and thallium, etc. and salts or complex salts of Group VIII (of the Periodic Table) elements such as iron, ruthenium, rhodium, palladium, osmium, iridium and platinum may be cited as examples of compounds that may be employed. Group VIII elements are particularly suitable for use. The amounts of such compounds which are added vary over a wide range depending on the intended object but are preferably $10^{-9}$ to $10^{-2}$ moles relative to the silver halide emulsion.

The silver halide emulsion used in the invention may be subjected to normal chemical sensitization or to spectral sensitization.

For chemical sensitization, processes such as sulfur sensitization as typified by the addition of an unstable sulfur compound, noble metal sensitization as typified by gold sensitization and reduction sensitization may be used alone or in combination. The compounds used in chemical sensitization are preferably those disclosed on page 18, lower right-hand column, page 22, upper right-hand column of the Specification of JP-A-62-215272.

Spectral sensitization is effected in order to render the various layers of the photosensitive material of the invention sensitive to required wavelength regions. Preferably, in the invention, spectral sensitization is effected by the addition of spectral sensitization dyes for adsorption of light of the wavelength region corresponding to the spectral sensitivity desired. The substances described by F. M. Harmer in "Heterocyclic Compounds—Cyanine Dyes and Related Compounds" (John Wiley & Sons (New York, London), 1964) may be cited as examples of spectral sensitization dyes that are employed in this process. Examples of specific compounds that may be suitably employed are disclosed on page 22, upper right-hand column, to page 38 of the abovenoted Specification of JP-A-62-215272.

The silver halide emulsion used in the invention may further contain a variety of compounds or their precursors for the purpose of preventing fogging during the photographic material manufacturing stages, storage or photographic processing or for achieving a stable photographic performance. Such compounds are usually called photographic stabilizers and specific examples thereof that may be suitably employed are shown on pages 39 to 72 of the abovenoted Specification of JP-A-62-215272.

The emulsion used in the invention may be either a so-called surface latent image type emulsion in which the latent images are formed mainly on the grain surfaces or a so-called internal latent image type emulsion in which the latent images are formed mainly in the interior of the grains.

Normally, yellow couplers, magenta couplers and cyan couplers which couple with the oxides of aromatic amine developing agents to produce the respective colors yellow, magenta and cyan are used in a color photographic material.

Acylacetamide derivatives such as benzoylacetoanilide and pivaloylacetoaniline are preferred as yellow couplers for use in the invention.

Of these substances, substances represented by the following general formulas (Y-1) and (Y-2) are suitable as yellow couplers:

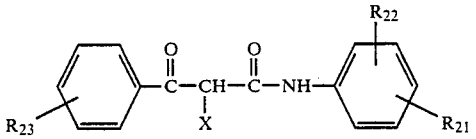

[Y-1]

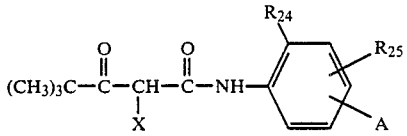

[Y-2]

wherein X represents a hydrogen atom or a coupling elimination group; $R_{21}$ represents a 8–32C diffusion-resistant group; $R_{22}$ represents a hydrogen atom, 1 or more halogen atoms, or a lower alkyl (preferably having 1–4C), lower alkoxy (preferably having 1–4C) or 8–32C diffusion-resistant group; $R_{23}$ represents a hydrogen atom or a substitution group. When there are two or more $R_{23}$s, they may be the same or different. $R_{24}$ represents a halogen atom, an alkoxy group a trifluoromethyl group or an aryl group. $R_{25}$ represents a hydrogen atom, a halogen atom or an alkoxy group. A represents $-NHCOR_{26}$, $-NHSO_2R_{26}$, $-SO_2NHR_{26}$, $-COOR_{26}$, $$-SO_2\underset{\underset{R_{27}}{|}}{N}-R_{26},$$

wherein $R_{26}$ and $R_{27}$ each represents an alkyl group, an aryl group or an acyl group.

Details of pivaloylacetoanilide yellow couplers are disclosed in the Specifications of U.S. Pat. Nos. 4,622,287, column 3 line 15 to column 8 line 39, and 4,623,616, column 14 line 50 to column 19 line 41.

Details of benzoylacetoanilide yellow couplers are disclosed in U.S. Pat. Nos. 3,408,194, 3,933,501, 4,046,575, 4,133,958 and 4,401,752, etc.

The compounds (Y-1) to (Y-39) disclosed in column 37 to column 54 of the abovenoted U.S. Pat. No. 4,622,287 may be cited as specific examples of pivaloylacetoanilide yellow couplers, (Y-1), (Y-4), (Y-6), (Y-7), (Y-15), (Y-21), (Y-22), (Y-23), (Y-35), (Y-36), (Y-37), (Y-38) and (Y-39), etc. with these being preferred.

One may also cite the examples of compounds (Y-1) to (Y-33) on column 19 to column 24 of the abovenoted U.S. Pat. No. 4,623,616, (Y-2), (Y-7), (Y-8), (Y-12), (Y-20), (Y-21), (Y-23) and (Y-29), etc. with these being suitable.

Apart from these examples, one may also cite as suitable substances the typical specific example (34) disclosed in column 6 of the Specification of U.S. Pat. No. 3,408,194, the compounds (16) and (19) disclosed in column 8 of the Specification of U.S. Pat. No. 3,933,501, compound (9) disclosed in columns 7 to 8 of the Specification of U.S. Pat. No. 4,046, 575, compound (1) disclosed in columns 5 to 6 of the Specification of U.S. Pat. No. 4,133,958, compound 1 disclosed in column 5 of the Specification of U.S. Pat. No. 4,401,752 and the compounds (a) and (h) indicated below:

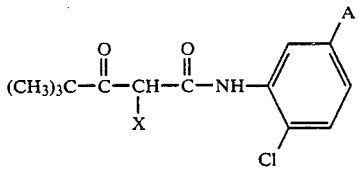

| Compound | A | X |
|---|---|---|
| a | $-COOCH(CH_3)COOC_{12}H_{25}$ | 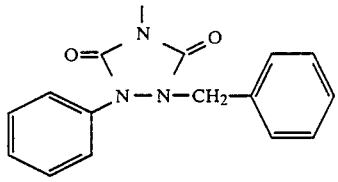 |
| b | $-COOCH(C_4H_9)COOC_{12}H_{25}$ | 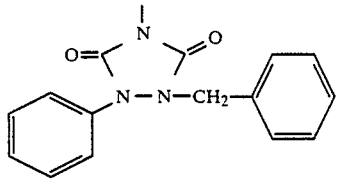 |

-continued

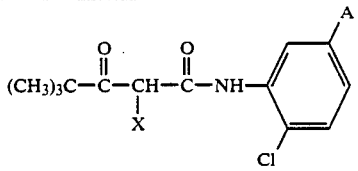

| Compound | A | X |
|---|---|---|
| c | 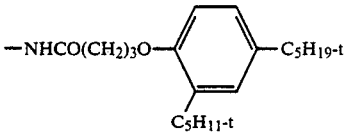 | 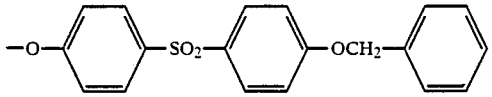 |
| d | 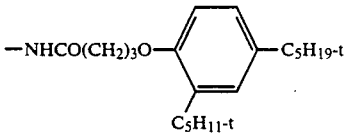 | 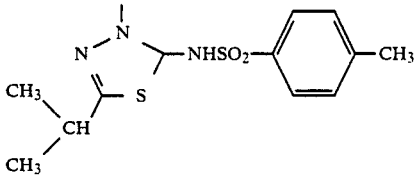 |
| e | 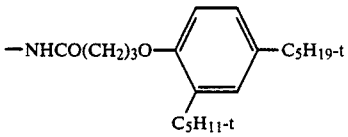 | 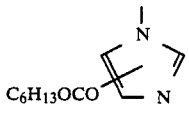 |
| f | $-NHSO_2C_{12}H_{25}$ | 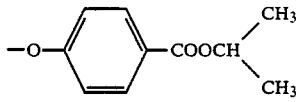 |
| g | $-NHSO_2C_{16}H_{33}$ | 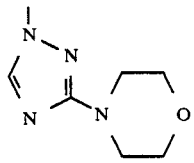 |
| h | 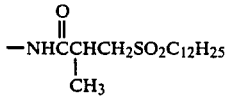 | 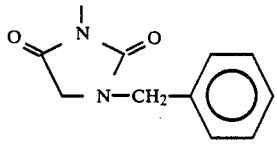 |

Among these couplers, the couplers in which the elimination atoms are nitrogen atoms are particularly preferred.

Other magenta couplers that are employable together with the pyrazolone magenta couplers that are used in the invention include, for example, oil-protected type couplers, indazolone couplers, cyanoacetyl couplers and preferably pyrazoloazole couplers, such as pyrazolotriazole or 5-pyrazolone couplers. Within the 5-pyrazolone type couplers, couplers in which the 3 position is substituted by an arylamino or an acylamino group are preferable from the point of view of the hue of the dye and the density of the color produced. Typical examples of such couplers are disclosed in U.S. Pat. Nos. 2,311,082, 2,343,703, 2,600,788, 2,908,573, 3,062,653, 3,152,896 and 3,936,015, etc. The nitrogen atom elimination groups disclosed in U.S. Pat. No. 4,310,619 and the arylthio elimination groups disclosed in U.S. Pat. No. 4,351,897 are preferred as elimination groups for the 2-equivalent 5-pyrazolone couplers. Good color density is also achievable with the 5-pyrazolone couplers possessing the ballast groups disclosed in European Patent No. 73,636.

The pyrazolobenzimidazoles disclosed in U.S. Pat. No. 2,369,879 and, preferably, the pyrazolo(5,1-c)-(1,2,4)triazoles disclosed in U.S. Pat. No. 3,725,067, the pyrazolotetrazoles disclosed in *Research Disclosure* 24220 (June 1984) and the pyrazolopyrazoles disclosed in *Research Disclosure* 24230 (June 1984) may be cited as pyrazoloazole couplers. All of the above couplers may be polymer couplers.

Specific examples of the couplers are represented by the following general formulas (M-1), (M-2) and (M-3):

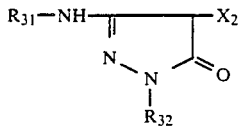

[M-1]

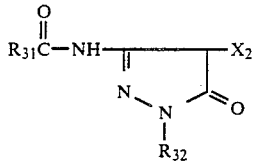

[M-2]

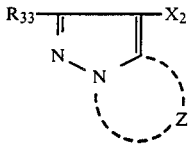

[M-3]

wherein $R_{31}$ represents a 8–32C diffusion-resistant group and $R_{32}$ represents a phenyl or a substituted phenyl group; $R_{33}$ represents a hydrogen atom or a substituent; Z represents a group of nonmetal atoms necessary for forming a 5-membered azole ring containing 2 to 4 nitrogen atoms and substituents (including condensed rings) may be substituted to this azole ring.

$X_2$ represents a hydrogen atom or a group that is capable of eliminating. Details of substituents of $R_{33}$ and the azole ring substitution groups are disclosed in, e.g., column 2 line 41 to column 8 line 27 of the Specification of U.S. Pat. No. 4,540,654.

Within the pyrazoloazole couplers, the imidazo-(1,2-b)pyrazoles disclosed in U.S. Pat. No. 4,500,630 are preferred and the pyrazolo(1,5-b)(1,2,4)triazoles disclosed in U.S. Pat. No. 4,540,654 are particularly preferred since there is little yellow side absorption and good light fastness of the coupler dye.

Apart from these couplers, pyrazolotriazole couplers with branched alkyl groups directly connected to the 2, 3 or 6 positions of the pyrazolotriazole ring as disclosed in JP-A-61-65245, pyrazoloazole couplers containing sulfonamido groups in their molecules as disclosed in JP-A-61-65246, pyrazoloazole couplers with alkoxyphenylsulfonamido ballast groups as disclosed in JP-A-61-147254 and pyrazolotriazole couplers with an alkoxy group or aryloxy group in the 6 position as suitable for use.

Specific examples of these couplers are as follows.

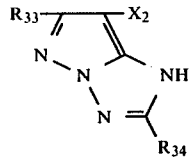
| Compound | $R_{33}$ | $R_{34}$ | $X_2$ |
|---|---|---|---|
| M'-1 | $CH_3$— | 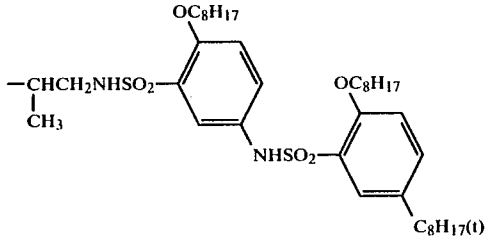 | Cl |
| M'-2 | $CH_3$— | 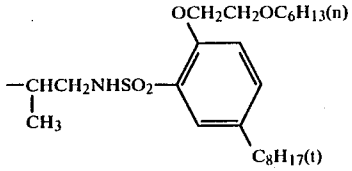 | Cl |
| M'-3 | $CH_3$— | 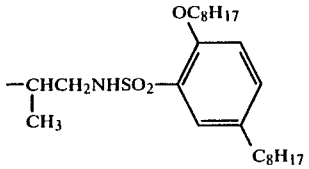 | 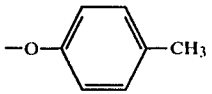 |
| M'-4 | 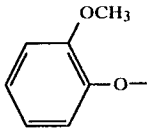 | 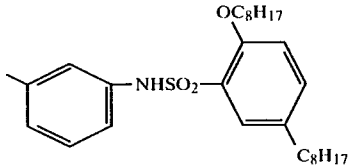 | 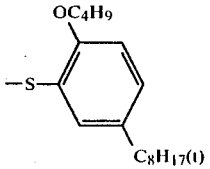 |

-continued
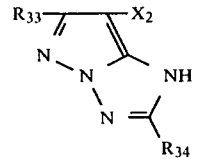
| Compound | $R_{33}$ | $R_{34}$ | $X_2$ |
|---|---|---|---|
| M'-5 | $CH_3$— | 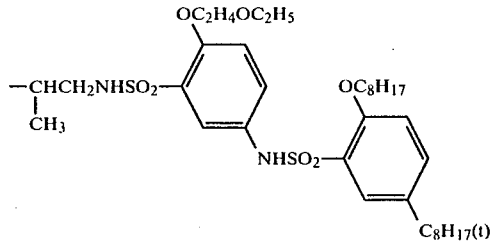 | Cl |
| M'-6 | $CH_3$— | 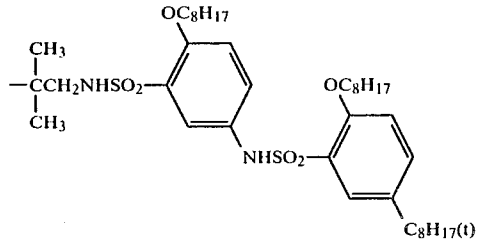 | Cl |
| M'-7 | 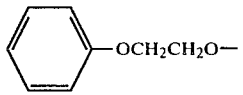 | 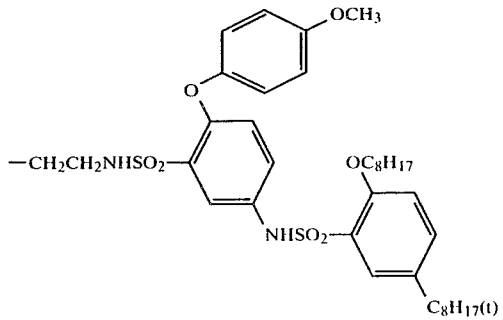 | 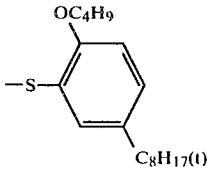 |
| M'-8 | $CH_2CH_2O$— | as above | as above |

-continued
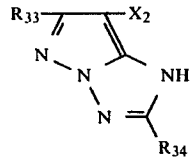
| Compound | $R_{33}$ | $R_{34}$ | $X_2$ |
|---|---|---|---|
| M'-9 | 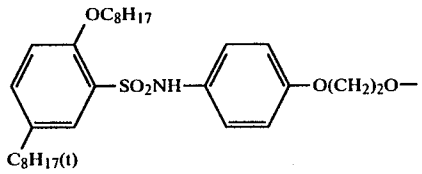 | 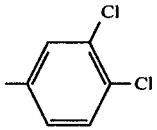 | 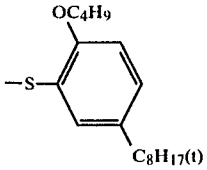 |
| M'-10 | 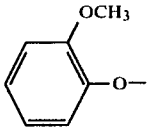 | 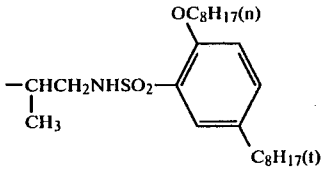 | Cl |
| M'-11 | $CH_3$— | 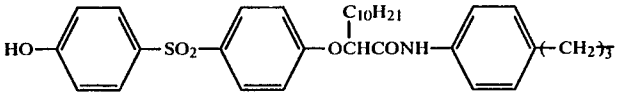 | Cl |
| M'-12 | $CH_3$— | 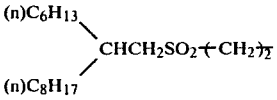 | Cl |
| M'-13 | 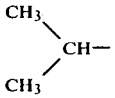 | 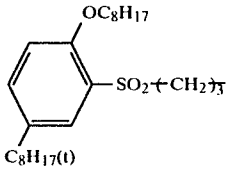 | Cl |

-continued
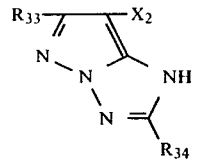
| Compound | $R_{33}$ | $R_{34}$ | $X_2$ |
|---|---|---|---|
| M'-14 | 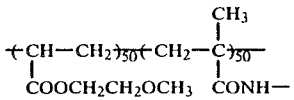 | 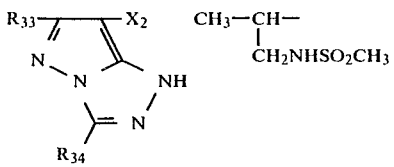 | Cl |
| M'-15 | 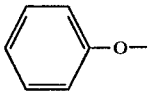 | 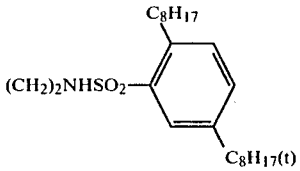 | Cl |
| M'-16 | 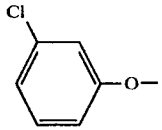 | 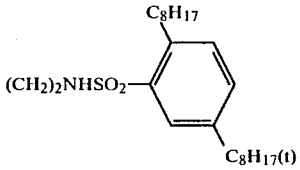 | 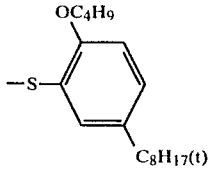 |
(The monomer ratio is shown by weight.)

The most representative cyan couplers are phenolic cyan couplers and naphtholic cyan couplers.

Phenolic cyan couplers comprise the couplers (including the polymer couplers) disclosed in U.S. Pat. Nos. 2,369,929, 4,518,687, 4,511,647 and 3,772,002 which have an acylamino group in the 2 position and an alkyl group in the 5 position of a phenol nucleus. Representative specific examples of these couplers include the coupler of Example 2 disclosed in Canadian Patent No. 625,822, Compound (1) disclosed in U.S. Pat. No. 3,772,002, Compounds (I-4) and (I-5) disclosed in U.S. Pat. No. 4,564,590, Compounds (1), (2), (3) and (24) disclosed in JP-A-61-39045 and Compound (C-2) disclosed in JP-A-62-70846.

Phenolic cyan couplers also include the 2,5-diacylaminophenolic couplers disclosed in U.S. Pat. Nos. 2,772,162, 2,895,826, 4,334,011 and 4,500,653 and JP-A-59-164555 and representative specific examples of these couplers include Compound (V) disclosed in U.S. Pat. No. 2,895,826, Compound (17) disclosed in U.S. Pat. No. 4,557,999, Compounds (2) and (12) disclosed in U.S. Pat. No. 4,565,777, Compound (4) disclosed in U.S. Pat. No. 4,124,396 and Compound (I-19) disclosed in U.S. Pat. No. 4,613,564.

Additional examples of phenolic cyan couplers include those couplers disclosed in U.S. Pat. Nos. 4,327,173, 4,564,586 and 4,430,423, and JP-A-62-257158 in which the nitrogen-containing heterocyclic rings are fused to phenol nuclei. Representative specific examples of these couplers that may be cited include Couplers (1) and (3) disclosed in U.S. Pat. No. 4,327,173, Compounds (3) and (16) disclosed in U.S. Pat. No. 4,564,586, Compounds (1) and (3) disclosed in U.S. Pat. No. 4,430,423 and the following compounds:

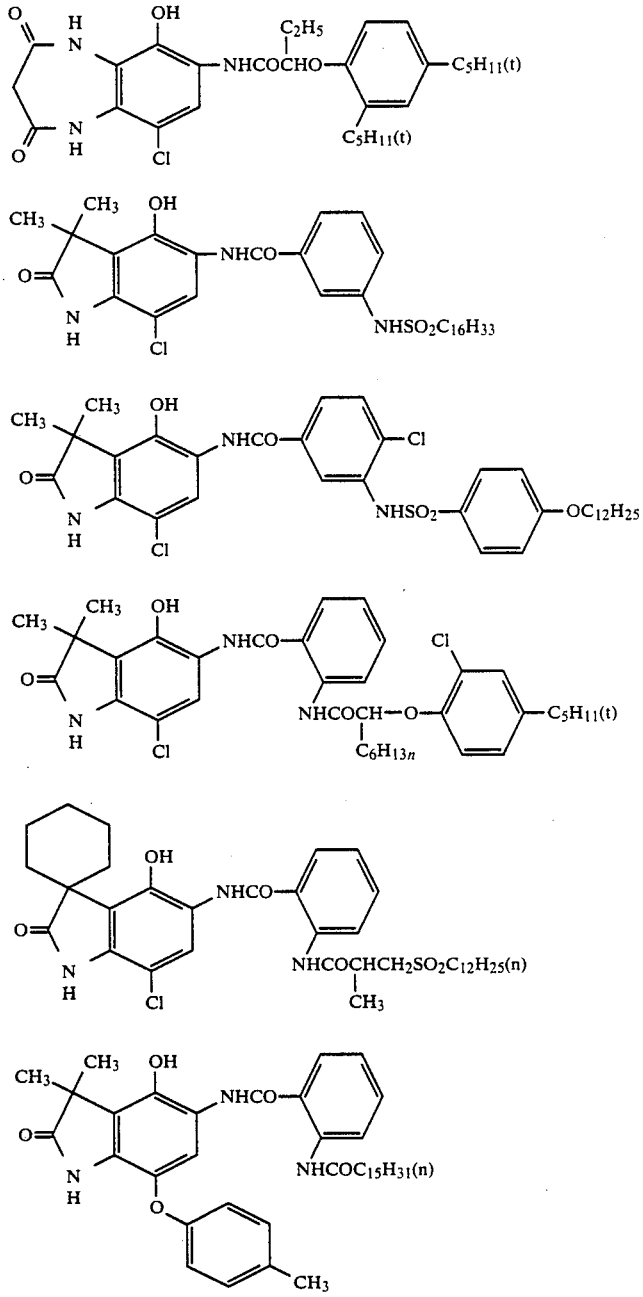

-continued
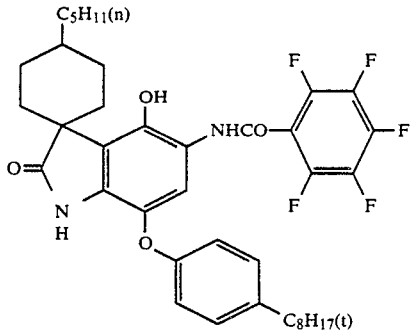
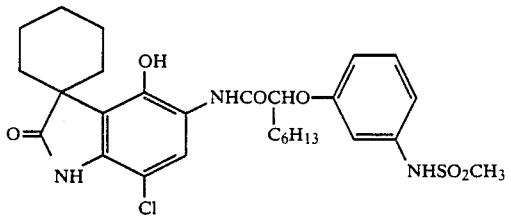
Apart from the abovenoted types of cyan couplers, one may also use, for instance, the diphenylimidazole cyan couplers disclosed in Laid-open European Patent No. EPO,249,453A2.
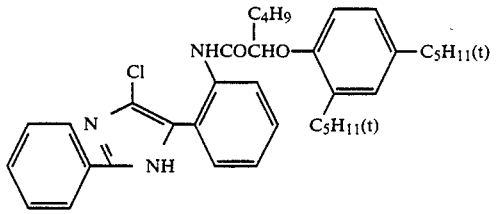
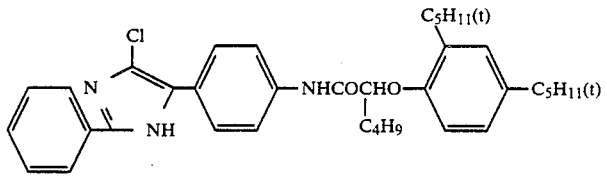
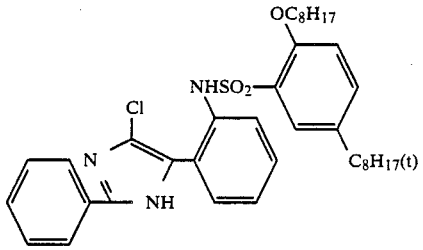
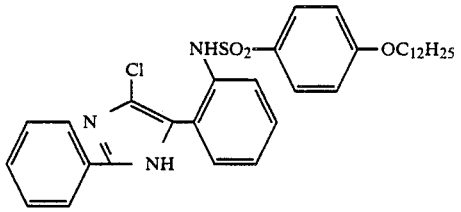

-continued

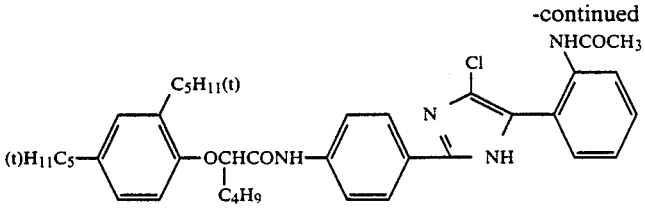

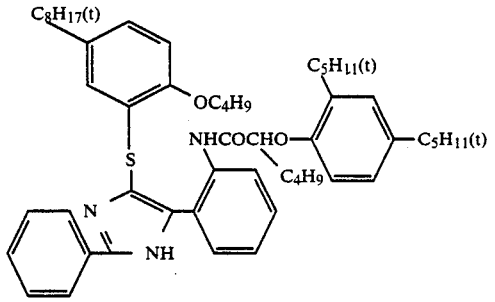

Phenolic cyan couplers further include the ureido couplers disclosed in U.S. Pat. Nos. 4,333,999, 4,451,559, 4,444,872, 4,427,767 and 4,579,813 and European Patent (EP) No. 067,689B1. Representative specific examples of these couplers that may be cited include Coupler (7) disclosed in U.S. Pat. No. 4,333,999, Coupler (1) disclosed in U.S. Pat. No. 4,451,559, Coupler (14) disclosed in U.S. Pat. No. 4,444,872, Coupler (3) disclosed in U.S. Pat. No. 4,427,767, Couplers (6) and (24) disclosed in U.S. Pat. No. 4,609,619, Couplers (1) and (11) disclosed in U.S. Pat. No. 4,579,813, Couplers (45) and (50) disclosed in European patent (EP) No. 067,689B1 and Coupler (3) disclosed in JP-A-61-42658.

Naphtholic cyan couplers include couplers which have an N-alkyl-N-arylcarbamoyl group in the 2 position of their naphthol ring (as in, e.g., U.S. Pat. No. 2,313,586), couplers with an alkylcarbamoyl group in the 2 position (as in, e.g., U.S. Pat. Nos. 2,474,293 and 4,282,312), couplers with an arylcarbamoyl group in the 2 position (as in, e.g., JP-B-50-14523 (the term "JP-B" as used herein means an "examined Japanese patent publication"), couplers with a carbonamido or sulfonamido group in the 5 position (as in, e.g., JP-A-60-237448, JP-A-61-145557 and JP-A-61-153640), couplers with aryloxy elimination groups (as in, e.g., U.S. Pat. No. 3,476,563), couplers with substituted alkoxy elimination groups (as in, e.g., U.S. Pat. No. 4,296,199) and couplers with glycolic acid elimination groups (as in, e.g., JP-B-60-39217).

These couplers can be included in a dispersed emulsion layer in the presence of at least one high boiling point organic solvent. Preferably, high boiling point organic solvents represented by the following formulas (A) to (D) are used:

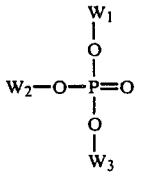

Formula (A)

$W_1—COO—W_2$ Formula (B)

-continued

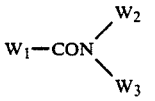

Formula (C)

$W_1—O—W_2$ Formula (D)

In formulas (A) to (D), $W_1$, $W_2$ and $W_3$ each represent substituted or unsubstituted alkyl groups, cycloalkyl groups, alkenyl groups, aryl groups or heterocyclic groups, $W_4$ represents $W_1$, $OW_1$ or $S—W_1$ and n is an integer in the range of 1 to 5. When n is 2 or more, the $W_4$'s may be the same or different and $W_1$ and $W_2$ in general formula (E) may fOrm condensed rings.

Details of these high boiling point organic solvents are disclosed on page 137, lower right-hand column to page 144, upper right-hand column of the Specification of JP-A-62-215272.

The above couplers can also be impregnated in a loadable latex polymer (as in, e.g., U.S. Pat. No. 4,203,716) in the presence or the absence of a high boiling point organic solvent or they may be dissolved in a polymer that is insoluble in water but soluble in an organic solvent and emulsified and dispersed in a hydrophilic colloid.

Preferably, use is made of the homopolymers or copolymers disclosed on page 12 to page 30 of the Specification of Laid-open International Patent No. WO88/00723, and from the point of view of characteristics such as the stabilization of color images, use of acrylamide polymers is particularly preferred.

Antifoggants in the form of hydroquinone derivatives, aminophenol derivatives, gallic acid derivatives or ascorbic acid derivatives, etc. may be included in the photosensitive material used in the invention.

A variety of color fading preventives may be used in the photographic material of the invention. Representative examples of organic color fading preventives for cyan, magenta and/or yellow images include hydroquinones, 6-hydroxycromans, 5-hydroxycoumarans, spirocromans, hindered phenols, mainly p-alkoxyphenols and bisphenols, gallic acid derivatives, methylenedioxybenzenes, aminophenols, hindered amines and ether or ester derivatives in which the phenolic hydroxyl groups of these various compounds are silylated or alkylated. Metal complexes, etc. such as typified by (bis-salicylaldoximato) nickel complexes and (bis-N,N-dialkyldithiocarbamato) nickel complexes may also be used.

Specific examples of organic color fading preventives are disclosed in the Specifications of the following patents. Hydroquinones are disclosed in, e.g., U.S. Pat. Nos. 2,360,290, 2,418,613, 2,700,453, 2,701,197, 2,728,659, 2,732,300, 2,735,765, 3,982,944 and 4,430,425, UK Patent No. 1,363,921 and U.S. Pat. Nos. 2,710,801 and 2,816,028; 6-hydrocromans, 5-hydroxycoumarans and spirocromans in e.g., U.S. Pat. Nos. 3,432,300, 3,573,050, 3,574,627, 3,698,909 and 3,764,337 and JP-A-52-152225; spiroindanes in U.S. Pat. No. 4,360,589; p-alkoxyphenols in, e.g., U.S. Pat. No. 2,735,765, UK Patent No. 2,066,975, JP-A-59-10539 and JP-B-57-19765; hindered phenols in, e.g., U.S. Pat. No. 3,700,455, JP-A-52-72224, U.S. Pat. No. 4,228,235 and JP-B-52-6623; gallic acid derivatives, methylenedioxybenzenes and aminophenols in patents such as U.S. Pat. Nos. 3,457,079 and 4,332,886 and JP-B-56-21144; hindered amines in, e.g., U.S. Pat. Nos. 3,336,135 and 4,268,593, UK Patents Nos. 1,326,889, 1,354,313 and 1,410,846, JP-B-51-1420, JP-A-58-114036, JP-A-59-53846 and JP-A-59-78344; phenolic hydroxyl group ether and ester derivatives in, e.g., U.S. Pat. Nos. 4,155,765, 4,174,220, 4,254,216 and 4,264,720, JP-A-54-145530, JP-A-55-6321, JP-A-58-105147 and JP-A-59-10539, JP-B-57-37856, U.S. Pat. No. 4,279,990 and JP-B-53-3263; and, metal complexes in, e.g., U.S. Pat. Nos. 4,050,938 and 4,241,155 and UK Patent No. 2,027,731(A). The objects can be achieved by the addition to a photosensitive layer after co-emulsification of these various compounds with couplers in amounts that are normally 5 to 100 wt % relative to the color couplers to which they correspond. Deterioration of cyan dye images due to heat and especially due to light can be more effectively prevented by the introduction of an ultraviolet ray absorption agent into the adjacent layers on both sides of the cyan coloring layer.

Particularly preferred color fading preventive agents among the abovenoted color fading preventives include spiroindanes and hindered amines.

Preferably in the invention, the compounds noted below are used together with the abovenoted couplers, especially with the pyrazoloazole couplers.

The use, alone or simultaneously, of compound (F) which bonds chemically with aromatic amine developing agents remaining after color development processing to form a compound that is chemically inert and essentially colorless and/or a compound (G) which bonds chemically with the oxides of the aromatic amine developing agent remaining after color development processing to form a chemically inert and essentially colorless compound is desirable from the point of view of preventing the occurrence of stains and other side effects due, for example, to a reaction between couplers and the residual developing agents or oxides thereof in the film during post-processing storage.

Preferred examples of compound (F) are compounds whose rate constant k2 of the secondary reaction with p-anisidine (in trioctyl phosphate at 80° C.) is in the range of 1.0 l/mol·sec–$1\times10^{-5}$ l/mol·sec.

If k2 is above this range, the compound itself becomes unstable and may decompose through reaction with gelatin and water. On the other hand, if k2 is below the above-mentioned range, the reaction with the residual aromatic amine developing agents is slow. Consequently, there may be failure to achieve the object of the invention which is to prevent side effects from such residual aromatic amine developing agents.

Preferred forms of compound (F) can be represented by the following general formulas (FI) and (FII):

$$R_1-(A)_n-X \quad \text{(FI)}$$

$$R_2-\underset{\underset{B}{|}}{C}=Y \quad \text{(FII)}$$

wherein $R_1$ and $R_2$ are each aliphatic, aromatic or heterocyclic groups; X represents a group which is eliminated by the reaction with an aromatic amine developing agent; A represents a group which forms a chemical bond by the reaction with the aromatic amine developing agent; n is 1 or 0. B is a hydrogen atom or an aliphatic, aromatic, heterocyclic, acyl or sulfonyl group; Y represents a group which accelerates the addition of the aromatic amine developing agent to the compound of general formula (FII); $R_1$ and X may bond together and Y may bond with $R_2$ or B to form ring structures.

Typical modes of chemical bonding with residual aromatic amine developing agents are bonding through a substitution reaction and bonding through an addition reaction.

Specific examples of compounds represented by general formulas (FI) and (FII) are given in Japanese Patent Applications No. 62-158342, 62-158643, 62-212258, 62-216481, 62-228034 and 62-279843.

Details concerning combinations of the abovenoted compound (G) and Compound (F) are given in Japanese Patent Application No. 63-18439.

Hydrophilic colloid layers in the photosensitive material produced by the invention may contain water soluble dyes as filter dyes or for the purpose of blocking irradiation or for a variety of other purposes. Examples of such dyes include oxonol dyes, hemioxonol dyes, styryl dyes, merocyanine dyes, cyanine dyes and azo dyes. Among these dyes, oxonol, hemioxonol and merocyanine dyes are especially useful.

Furthermore, it is advantageous to use gelatin as a binder or as a protective colloid in the emulsion layers of the photographic material of the invention, although hydrophilic colloids other than gelatin may be used alone or together with gelatin.

The gelatin used in the invention may be either lime treated gelatin or gelatin that has been treated with acid. Details of gelatin manufacture are given in "The Macromolecular Chemistry of Gelatin" by Arthur Weiss (Academic Press, 1964).

Nitrocellulose film, or polyethylene terephthalate, or other such transparent film, or a reflecting support such as normally employed for photographic light-sensitive materials may be used as a support in the invention. From the point of view of the objects of the invention, the use of a reflecting support is preferred.

What is meant by a "reflecting support" as used in the invention is a support which increases the reflectivity and thereby makes dye images formed in the silver halide emulsion layers sharper. These supports comprise elements in which a hydrophobic resin containing a dispersed reflecting substance such as titanium oxide, zinc oxide, calcium carbonate or calcium sulfate, etc. is coated on a support and elements in which a hydrophobic resin containing a dispersed reflecting substance is used as a support. There are, for example, supports making the joint use of a reflecting layer, and baryta paper, polyethylene coated paper or polypropylene synthetic paper, and transparent supports making the joint use of reflecting materials, e.g., glass plates, polyethylene terephthalate, cellulose triacetate, cellulose nitrate and similar polyester film, polyamide film, polycarbonate film, polystyrene film and vinyl chloride resin and one may select different supports in accordance with the intended use.

Reflecting materials are suitably materials into which a white pigment has been thoroughly kneaded in the presence of a surfactant. Preferably, use is made of materials in which the surfaces of the pigment grains have been treated with a divalent- tetravalent alcohol.

With regard to the occupied area ratio (%) per unit area defined by the fine white pigment grains, the most representative way of determining this is to divide the area that is under observation into the continuous unit areas of 6 $\mu m \times 6$ $\mu m$ and measure the ratio (%) ($R_1$) of the projected area of the fine grains in these unit areas. The coefficient of variation of the occupied area ratio (%) can be determined by $s/\overline{R}$ which is the ratio of $R_1$'s standard deviation s to the average value ($\overline{R}$) of $R_1$. The number (n) of unit areas considered is preferably at least 6. The coefficient of variation $s/\overline{R}$ can be determined as follows:

$$\sqrt{\frac{\sum_{i=1}^{n}(R_1 - R)^2}{n-1}} \Big/ \frac{\sum_{i=1}^{n} R_1}{n}$$

In the invention, the coefficient of variation of the fine pigment grains occupied area ratio (%) is preferably 0.15 or less, 0.12 or less being particularly preferred. If this value is 0.08 or less, the dispersion characteristics of the grains are considered to be essentially uniform.

Known primary aromatic amine color developing agents are included in the color developing solutions used in the invention. Preferred examples are p-phenylenediamine derivatives, representative examples of which will now be given although there is no limitation to these agents.

D-1: N,N-Diethyl-p-phenylenediamine
D-2: 2-Amino-5-diethylaminotoluene
D-3: 2-Amino-5-(N-ethyl-N-laurylamino)toluene
D-4: 4-(N-Ethyl-N-(β-hydroxyethyl)amino)aniline
D-5: 2-Methyl-4-(N-ethyl-N-(β-hydroxyethyl-)amino)aniline
D-6: 4-Amino-3-methyl-N-ethyl-N-(β-(methanesulfonamido)ethyl)-aniline
D-7: N-(2-Amino-5-diethylaminophenylethyl)methanesulfonamide
D-8: N,N-Dimethyl-p-phenylenediamine
D-9: 4-Amino-3-methyl-N-ethyl-N-methoxyethyl aniline
D-10: 4-Amino-3-methyl-N ethyl-N-β-ethoxyethyl aniline
D-11: 4-Amino-3-methyl-N-ethyl-N-β-butoxyethyl aniline A particularly preferred derivative among these p-phenylenediamine derivatives is compound (D-6), that is, 4-amino-3-methyl-N-ethyl-N-(β-(methanesulfonamido)ethyl)-aniline.

These p-phenylenediamine derivatives may also be in the form of salts such as sulfates, hydrochlorides, sulfites or p-toluenesulfonates, etc. The amount of the primary aromatic amine developing agent preferably used is such an amount as to give a concentration of about 0.1 g to about 20 g or more preferably, about 0.5 g to about 10 g per 1 liter of developing solution.

If required, the color developing solution may also include a carbonyl sulfite adduct or a sulfite such as sodium sulfite, potassium sulfite, sodium bisulfite, potassium bisulfite, sodium metasulfite or potassium metasulfite, etc. as a preservative. However, in order to improve the color forming properties of the color developing solution in cases in which the benzyl alcohol is eliminated and in order to reduce the environmental pollution load, etc., it is preferable that the solution be essentially free of sulfite ions. Moreover, the advantages of the invention are particularly marked in systems such as this. What is meant here by "essentially free" is an amount that, converted to the amount of sodium sulfite per 1 liter of color developing solution, is not more than 0.5 g/l and is preferably not more than 0.2 g/l or more preferably is zero.

Various types of hydroxylamines are preferably added for the direct preservation of the color developing agent, including the hydroxams described in JP-A-63-43138, the hydrazines and hydrazides described in Japanese Patent Application No. 61-170756, the phenols described in JP-A-63-44657 and JP-A-63-58443, the α-hydroxyketones and α-aminoketones described in JP-A-63-44656 and/or the various saccharides described in JP-A-63-36244. It is preferable to use together with these compounds monoamines such as described in Japanese Patent Applications No. 61-164515, JP-A-63-4235, JP-A-63-24254, JP-A-63-21647, JP-A-63-27841, or JP-A-63-25654, diamines such as described in Japanese Patent Applications No. 61-164515, JP-A-63-30845 or JP-A-63-43139, the polyamines described in JP-A-63-21647 and JP-A-63-26655, the polyamines described in JP-A-63-44655, the nitroxy radicals described in JP-A-63-53551, the alcohols described in JP-A-63-43140 and JP-A-63-53549, the oximes described in JP-A-63-56654 and the tertiary amines described in Japanese Patent Application No. 61-265149.

Substances such as the various metals described in JP-A-57-44148 and JP-A-57-53749, the salicylic acids disclosed in JP-A-59-180588, the alkanolamines disclosed in JP-A-54-3532, the polyethyleneimines disclosed in JP-A-56-94349 and the polyhydroxy compounds disclosed in U.S. Pat. No. 3,746,544 may also be added as other preservatives if required. Addition of an alkanolamine such as triethanolamine, a dialkylhydroxylamine such as diethylhydroxylamine and an aromatic polyhydroxy compound is particularly desirable.

The pH of the color developing solution used in the invention is preferably 9 to 12 and more preferably 9 to 11.0. The solution may also contain other compounds that constitute known developing solution components.

Preferably, use is made of a buffering agent in order to maintain the abovenoted pH. Examples of buffering agents that may be used include carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts and lycine salts. Carbonates, phosphates, tetraborates, and hydroxybenzoates in particular have the advantages that they possess excellent solubility and buffering capability in the high pH region of 9.0 or more, they have no adverse effects (fogging, etc.) on photographic performance when they are added to color developing solutions and they are low-cost and the use of these buffering agents is therefore especially preferred.

Specific examples of buffering agents that may be cited include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the invention is not limited to these compounds.

The amount of buffering agent added to the color developing solution is preferably 0.1 mol/l or more, and a particularly preferred amount is 0.1 to 0.4 mol/l.

In addition, various chelating agents may be used in the color developing solution such as calcium and magnesium precipitation preventive agents or agents to improve stability of the solution.

Examples of such agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, glycol ether diaminetetraacetic acid, ethylenediamineorthohydroxyphenylacetic acid, 2-phosphonobutane-1,2,4-tricarboxylic acid, 1-hydroxyethylidene-1,1-diphosphonic acid and N,N'-bis(2-hydroxybenzyl)ethylenediamine-N,N'-diacetic acid.

The joint use of two or more of these chelating agents may be made if required.

A suitable amount of such chelating agents to be added is an amount sufficient to block the metal ions in the color developing solution and the amount is, for example, around 0.1 to 10 g per 1 liter.

Any development accelerator may be added to the color developing solution as required. A typical development accelerator that can be used is benzyl alcohol. However, from the point of view of environmental pollution, the solution preparation characteristics and the prevention of color stains, it is preferable that the color developing solution of the invention contain essentially no benzyl alcohol. What is meant by the phrase "essentially" is that there is no more than 2 ml per 1 liter of developing solution and preferably no benzyl alcohol at all is present. Examples of other development accelerators include the thioether compounds disclosed in JP-B-37-16088, JP-B-37-5987, JP-B-38-7826, JP-B-44-12380 and U.S. Pat. No. 3,813,247, etc., the p-phenylenediamine compounds disclosed in JP-A-52-49829 and JP-A-50-15554, the quaternary ammonium salts disclosed in JP-A-50-137726, JP-B-44-30074, JP-A-56-156826 and JP-A-52-43429 etc., the amine compounds disclosed in U.S. Pat. Nos. 2,494,903, 3,128,182, 4,230,796 and 3,253,919, JP-B-41-11431, U.S. Pat. Nos. 2,482,546, 2,596,926 and 3,582,346, etc. and the polyalkylene oxides disclosed in JP-B-37-16088, JP-B-42-25201, U.S. Pat. No. 3,128,183, JP-B-41-11431, JP-B-42-23883 and U.S. Pat. No. 3,532,501, etc., in addition to which 1-phenyl-3-pyrazolidones or imidazoles may be added if required.

In the present invention, any antifoggant may be added if required. Examples of antifoggants that can be used include alkali metal halides such as sodium chloride, potassium bromide or potassium iodide and organic antifoggants. Representative examples of organic antifoggants that may be cited include benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine, adenine and similar nitrogen-containing heterocyclic compounds.

Brightening agents may be included in the color developing solution that is used in the present invention. 4,4'-diamino-2,2'-disulfostilbene compounds are preferred as brightening agents. The amount to be added is 0 to 5 g/l and preferably 0.1 to 4 g/l.

Also, various surfactants such as alkylsulfonic acids, arylphosphonic acids, aliphatic carboxylic acids and aromatic carboxylic acids may be added if required.

The processing temperature of the color developing solution of the invention is 20 to 50° C and preferably 30 to 40° C. The processing time is 20 seconds to 5 minutes and preferably 30 seconds to 2 minutes. The amount of replenishment is preferably on the low side and is 20 to 600 ml and preferably 50 to 300 ml per 1 $m^2$ of the photographic material. 60 to 200 ml is even more preferable and 60 to 150 ml is the most preferable amount.

Next, the desilvering process in the invention will be described. Generally, it is satisfactory if a process containing a bleaching step-fixing step, a fixing step-bleach-fixing step, a bleaching step-bleach-fixing step or a bleach-fixing step is used for the desilvering process.

There now follows a description of the bleaching solutions, bleach-fixing solutions and the fixing solutions that are employable in the invention.

Any bleaching agent may used in the bleaching solution or in the bleach-fixing solution of the invention but materials such as organic ferric (III) complex salts (e.g., complex salts of aminopolycarboxylic acids such as ethylenediaminetetraacetic acid, diethylenetriaminepentaacetic acid, aminopolyphosphonic acids, phosphonocarboxylic acids and organic phosphonic acids), organic acids such as citric acid, tartaric acid and malic acid, etc., persulfates and hydrogen peroxide are preferred.

Among these materials, organic ferric(III) complex salts are particularly preferable from the point of view of speed of processing and prevention of environmental pollution. Examples that can be given include aminopolycarboxylic acids, aminopolyphosphonic acids, organic phosphonic acids and salts thereof that are useful for forming organic ferric (III) complex salts are ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid and glycol ether diaminetetraacetic acid. These compounds may be in the form of sodium, potassium, lithium or ammonium salts. Among the compounds, ferric (III) complex salts of ethylenediaminetetraacetic acid, diethylenetriaminepentaacetic acid, cyclohexanediaminetetraacetic acid, 1,3-diaminopropanetetraacetic acid and methyliminodiacetic acid are particularly preferred since they have high bleaching power. These ferric ion complex salts, may be used in the form of complex salts or ferric ion complex salts may be formed in solution using a ferric salt, e.g., ferric sulfate, ferric chloride, ferric nitrate, ferric ammoniumsulfate or ferric phosphate, and a chelating agent such as an aminopolycarboxylic acid, aminopolyphosphonic acid or phosphonocarboxylic acid. Also, the chelating agent may be used in an amount that is in excess of the amount needed for forming a ferric ion complex salt. Among iron complexes, aminopolycarboxylic acid iron complexes are preferred and the amount thereof which may be added is preferably 0.01 to 1.0 mol/l and more preferably 0.05 to 0.50 mol/l.

A variety of compounds may be employed as bleaching accelerators in the bleaching solution, bleach-fixing solution or in their prebaths. Materials that are suitable because they have excellent bleaching power are, e.g., the compounds possessing mercapto groups or disulfide bonds that are disclosed in the Specification of U.S. Pat. No. 3,893,858, the Specification of German Patent No. 1,290,812, JP-A-53-95630 and *Research Disclosure*, Volume 17129 (July 1978) and thiourea compounds and iodine and bromine ions and other halogen compounds disclosed in JP-B-45-8506, JP-A-52-20832, JP-A-53-32735 and U.S. Pat. No. 3,706,561.

In addition, the bleaching solution or bleach-fixing solution used in the invention may also contain a rehalogenation agent such as a bromide (e.g., potassium bromide, sodium bromide, ammonium bromide), a chloride (e.g., potassium chloride, sodium chloride, ammonium chloride) or an iodide (e.g., ammonium iodide). If required, one or more inorganic or organic acids or alkali metal or ammonium salts thereof with pH buffering capabilities such as borax, sodium metaborate, acetic acid, sodium acetate, sodium carbonate, potassium carbonate, phosphorous acid, phosphoric acid, sodium phosphate, citric acid, sodium citrate and tartaric acid and corrosion preventives such as ammonium nitrate and guanidine may be added.

The fixing agents used in the bleach-fixing solution or fixing solution according to the invention are known fixing agents, i.e., water-soluble silver halide solvents such as sodium thiosulfate, ammonium thiosulfate and similar thiosulfates; sodium thiocyanate, ammonium thiocyanate and similar thiocyanates; ethylenebisthioglycolic acid, 3,6-dithia-1,8-octane diol and similar thioether compounds and thioureas. One or a mixture of two or more of these substances may be used. It is also possible to use, for example, special bleach fixing solutions containing combinations of a large amount of a halide such as potassium iodide and the fixing agents disclosed in JP-A-55-155354. In the invention, the use of thiosulfates, especially ammonium thiosulfate is preferred. The amount of fixing agent per 1 liter is preferably 0.3 to 2 moles and is more preferably in the range of 0.5 to 1.0 mole. The pH region of the bleach-fixing solution or the fixing solution is preferably 3 to 10 and more preferably is 5 to 9.

In addition, various brightening agents, antifoaming agents, surfactants, organic solvents such as methanol, and polyvinylpyrrolidone, etc. may be included in the bleach-fixing solution.

A preservative in the form of a sulfite ion releasing compound such as a sulfite (e.g., sodium sulfite, potassium sulfite, ammonium sulfite), a bisulfite (e.g., ammonium bisulfite, sodium bisulfite, potassium bisulfite) or a metabisulfite (e.g., potassium metabisulfite, sodium metabisulfite, ammonium metabisulfite) may be included in the bleach-fixing solution or fixing solution in the invention. Converted to sulfite ions, the amount of such compounds included is preferably 0.02 to 0.05 mol/l and is more preferably 0.04 to 0.40 mol/l.

Normally, sulfites are added as preservatives but one may also add substances such as ascorbic acid, carbonyl bisulfite adducts and carbonyl compounds.

Further, brightening agents, chelating agents, antifoaming agents and mold preventives may be added if required.

Generally, the silver halide color photographic light-sensitive material of the invention is washed with water and/or given a stabilization treatment after the desilvering treatment comprising fixing or bleach-fixing, etc.

The amount of water in the washing stage or step can be set over a wide range depending on the characteristics of the photographic material (which depends on, e.g., the materials used as couplers, etc.), the intended use and a variety of conditions such as the temperature of the washing water, the number of washing tanks (the number of stages) and whether the replenishment system is a counter-flow or a direct flow system, etc. Among these various factors, the relationship between the amount of water and the number of washing tanks in a multistage counter-flow system can be determined by the method described in the Journal of the Society of Motion Picture and Television Engineers, Vol. 64, p. 248 to 253 (May 1955 number). Normally, the number of stages in a multistage counterflow system is preferably 2 to 6, 2 to 4 being particularly preferred.

A multistage counterflow system permits considerable reduction of the amount of washing water, which can be made, for instance, less than 0.5 to 1 liter per $lm^2$ of photographic material. However, although the advantages of the invention are very marked there can be problems such as the proliferation of bacteria and adhesion of suspended matter to the photographic material as the in-tank dwell time of the water increases. A very effective measure which can be employed for resolving such problems during processing of the photosensitive material of the invention is the method of reducing calcium and magnesium described in JP-A-62-288838. One can also make use of the isothiazolone compounds and the thiabendazole compounds disclosed in JP-A-57-8542, the chlorinated sodium isocyanurate and other chlorinated bactericides disclosed in JP-A-61-120145, the benzotriazoles described in JP-A-61-267761, copper ions and other bactericides such as described in "Antibacterial, Antimold Chemistry" by Hiroshi Horiguchi, "Microorganism Disinfection, Bactericidal, Antimold Technology" edited by the Eisei Gijutsukai (Hygiane Technology Society) and the "Dictionary of Antibacterial Antimold Agents" edited by the Nihon Bokinbobai Gakkai (Japan Bacteria/Mold Prevention Institute).

The washing water may also contain a surfactant as a draining agent and a chelating agent, typically EDTA, as a hard water softener.

Moreover, it is also possible to effect treatment in a stabilization solution following the washing stage or to effect this treatment without going through a washing stage. A stabilization solution contains compounds having the ability to stabilize the image. Examples of such compounds include aldehydes as typified by formalin, buffering agents for adjusting the pH of the film to a value suitable for dye stabilization and ammonium compounds. It is also possible to use the various abovenoted bactericides and antimold agents in the solution in order to prevent proliferation of bacteria and impart mold resistance to the photo sensitive material after processing.

In addition, surfactants, brightening agents and hardeners may also be added. Any known method such as disclosed in, for example, JP-A-57-8543, JP-A-58-14834 and JP-A-60-220345 may be employed if stabilization is effected directly without going through a washing stage in the processing of the photographic material of the invention.

Another suitable procedure is to use 1-hydroxyethylidene-1,1-diphosphonic acid, ethylenediaminetetramethylenephosphonic acid or a similar chelating agent and magnesium or bismuth compounds.

Similarly, a so-called rinse solution may also be used as the stabilization solution or the washing solution that is used after the desilvering treatment in the invention.

The pH in the washing or the stabilization stage in the invention is preferably 4 to 10 and more preferably is 5 to 8. The temperature can be set to a variety of values depending on the intended use and characteristics, etc. of the photographic material but generally it is preferably 15 to 45° C. and more preferably it is 20 to 40° C. The time can be set to any duration but a short duration is desirable from the point of view of reducing the processing time and preferably the time is 15 seconds to 1 minute 45 seconds or more preferably 30 seconds to 1 minute 30 seconds. From the point of view of aspects such as running costs, reduction of the amount of discharged material and handling, the amount of replenishment is preferably kept low.

A specifically preferred replenishment quantity per unit area of the photographic material is 0.5 to 50 times and preferably 3 to 40 times the amount carried in from the prebath, or not more than 1 liter and preferably not more than 500 ml per 1 $m^2$ of the photographic material. Replenishment may be conducted continuously or intermittently.

The solutions used in the washing and/or stabilization stage can also be used in the preceding stage. An example is the reduction of the amount of waste solution by a multistage counterflow system in which reduced washing water overflow is forced to run into the preceding bleach-fixing bath and a supplementary supply of concentrated solution is supplied into this bath.

The total of the desilvering stage and the washing and the stabilization stage times preferably is not more than 2 minutes and more preferably is 30 seconds to 1 minute 30 seconds. What is meant by the total time is the time from when the silver halide color photographic light-sensitive material comes into contact with the first bath in the desilvering stage to when it exits from the last bath of the washing or the stabilization stage and it includes the waste time for intermediate transport.

What is meant by the statement that the sum of the desilvering treatment and the washing and the stabilization treatment times is not more than 2 minutes is that the sum of the times required for the desilvering treatment and the treatment effected up to the drying stage (more specifically the washing and/or stabilizing stage) is not more than 2 minutes. For example, the sum for the processes such as (1) desilvering→Washing
(2) desilvering→stabilization
(3) desilvering→washing→stabilization is not more than 2 minutes.

EXAMPLE 1

6.8 g of the magenta coupler noted below (Ref-1) was dissolved by the addition of 6.8 ml of tricresyl phosphate and 15 ml of ethyl acetate, then added to 100 ml of a gelatin aqueous solution containing 1 g of sodium dodecylbenzenesulfonate and 10 g of gelatin and mechanically converted to a fine emulsified dispersion.

The entirety of this emulsified dispersion was added to 100 g of a silver chlorobromide emulsion (containing 50 mol% of AgBr and 6.5 g of Ag), 10 ml of a 2% 2,4-dihydroxy-6-chloro-S-triazine sodium salt was added as a hardener immediately before coating and the material was coated to give a coated silver quantity of 330 mg/$m^2$ on a support of paper laminated on both sides by polyethylene. A sample was prepared by providing a layer of gelatin as a protective layer on top of this coating layer. This sample is designated as Sample 01.

Samples using the combinations noted in Table 1 were prepared in the same way with equimolar replacement of the couplers by couplers of the invention and with addition of the compounds of general formulas (A) and (B). These samples are designated as 02 to 29.

The following tests were conducted in order to evaluate the photographic performance of the samples thus prepared.

First, the samples were subjected to graduated exposure for sensitometry using a sensitometer (FWH model, manufactured by Fuji Film KK, light source color temperature 3,200° K.). This exposure was effected with an exposure light quantity of 500 CMS at an exposure time of 0.1 second.

After exposure, color development processing was effected using the processing stages and processing solution compositions noted below.

| Processing stage | Temperature (°C.) | Time |
|---|---|---|
| Color development | 37 | 3 min. 30 sec. |
| Bleach-fixing | 33 | 1 min. 30 sec. |
| Washing | 24 to 34 | 3 min. |
| Drying | 70 to 80 | 1 min. |

Magenta coupler (Ref-1)

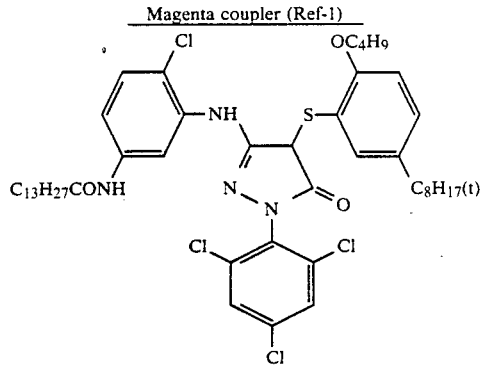

The compositions of the various processing solutions were as follows:

| Color developing solution (A) | |
|---|---|
| Water | 800 ml |
| Diethylenetriaminepentaacetic acid | 1.0 g |
| Nitrilotriacetic acid | 2.0 g |
| Benzyl alcohol | 15 ml |
| Diethylene glycol | 10 ml |
| Sodium sulfite | 2.0 g |
| Potassium bromide | 1.0 g |
| Potassium carbonate | 30 g |
| N-Ethyl-N-(β-methanesulfonamidoethyl)-3-methyl-4-aminoaniline sulfate | 4.5 g |

-continued

| | |
|---|---|
| Hydroxylamine sulfate | 3.0 g |
| Brightening agent (WHITEX 4B, made by Sumitomo Kagaku) | 1.0 g |
| Water added to give | 1000 ml |
| pH (25° C.) | 10.25 |
| Bleach-fixing solution | |
| Water | 400 ml |
| Ammonium thiosulfate (70% aqueous solution) | 150 ml |
| Sodium sulfite | 18 g |
| Ferric (III) ammonium ethylenediaminetetraacetate | 55 g |
| Disodium ethylenediaminetetraacetate | 5 g |
| Water added to give | 1000 ml |
| pH (25° C.) | 6.70 |

Next, a color developing solution was prepared by leaving out the diethylenetriaminepentaacetic acid and nitrilotriacetic acid components of color developing solution A and adding $Ca(NO_3)_2 \cdot 4H_2O$ to make the $Ca^{2+}$ ion concentration 300 ppm but otherwise making no changes. This solution is designated color developing solution B.

This color developing solution B was used in processing and was executed in exactly the same way as before.

The magenta image densities obtained as a result of the abovenoted processing were measured and the characteristic curves of the samples were produced.

In order to compare the photographic performance and in particular the color development characteristics on the basis of these characteristic curves, evaluations were made with the characteristic value defined as follows.

$$\text{Color development characteristic} = \frac{\text{Density value at the amount of exposure given in the denominator on characteristic curve obtained with color developing solution B}}{\text{Density value on exposure equivalent to } +0.5 \text{ of the log } E \text{ value giving fogging } +0.5 \text{ density obtained with color developing solution A}}$$

The results for the characteristic values (color development characteristics) thus determined are shown in Table 1.

TABLE 1

| Sample | Coupler | General formulas (A) and (B) | Amount added (mol % relative to coupler) | Color development characteristic | Remarks |
|---|---|---|---|---|---|
| 01 | Ref-1 | — | — | 0.81 | Comparison |
| 02 | " | A-1 | 20 | 0.85 | " |
| 03 | " | A-6 | " | 0.84 | " |
| 04 | " | A-20 | " | 0.86 | " |
| 05 | " | A-26 | " | 0.88 | " |
| 06 | " | A-43 | " | 0.88 | " |
| 07 | " | B-2 | 50 | 0.81 | " |
| 08 | " | " | 100 | 0.81 | " |
| 09 | " | B-19 | 100 | 0.82 | " |
| 10 | M-1 | — | — | 0.91 | " |
| 11 | " | A-1 | 20 | 0.97 | The invention |
| 12 | " | A-6 | " | 0.97 | " |
| 13 | " | A-20 | " | 0.98 | " |
| 14 | " | A-26 | " | 0.99 | " |
| 15 | " | A-43 | " | 0.99 | " |
| 16 | " | B-2 | 100 | 0.91 | Comparison |
| 17 | " | A-1/B-2 | 20/100 | 0.99 | The invention |
| 18 | " | A-20/B-2 | 20/100 | 0.99 | " |
| 19 | " | A-26/B-2 | 20/100 | 1.00 | " |
| 20 | M-10 | — | — | 0.90 | Comparison |
| 21 | " | A-1 | 20 | 0.98 | The invention |
| 22 | " | A-6 | " | 0.97 | " |
| 23 | " | A-20 | " | 0.97 | " |
| 24 | " | A-26 | " | 0.99 | " |
| 25 | " | A-43 | " | 0.99 | " |
| 26 | " | B-2 | 100 | 0.90 | Comparison |
| 27 | " | A-1/B-2 | 20/100 | 0.99 | The invention |
| 28 | " | A-20/B-2 | 20/100 | 0.99 | " |
| 29 | " | A-26/B-2 | 20/100 | 1.00 | " |

Going from the abovenoted definition of the color development characteristic, the color development characteristics are better as the value is higher.

It is seen from Table 1 that with the comparison couplers there was a large fall in the color development characteristic value of the samples processed with color developing solution B and that even when a compound of the invention represented by general formula (A) or (B) was used for the comparison couplers, although a slight improvement in the color development characteristic is observed it is not sufficient. It is seen that in contrast to this, the use of a compound of the invention represented by general formula (I) together with a compound of the invention represented by general formula(A) resulted in practically complete inhibition of deterioration of the color development characteristic due to processing involving color developing solution B's calcium ion concentration of 300 ppm and gave excellent color development capacity. Further, these effects were still greater when joint use of a compound represented by general formula (B) was made.

A comparison of the maximum densities reached ($D_{max}$) in photographic performance by Sample 2 with that of Samples 11, 17 and 21 showed that the densities of Samples 11, 17 and 21 were greater than that of Sample 2 by 0.12 to 0.18.

Next, using the samples that had been processed by color developing solution A, the light fastness and the staining of white ground portions were evaluated by placing a Fuji Film filter that cuts out short wavelengths of 400 nm or less in front of each sample and exposing the samples for 3 months in a fluorescent light discoloration tester (15,000 lux). The results are shown in Table 2.

TABLE 2

| Sample | Coupler | General formulas (A) and (B) | Amount added (mol % relative to coupler) | Color image fastness (Fluorescent lamp) | Stains $\Delta D_B$ | Stains $\Delta D_G$ | Remarks |
|---|---|---|---|---|---|---|---|
| 01 | Ref-1 | — | — | 55 | 0.13 | 0.11 | Comparison |
| 02 | " | A-1 | 20 | 45 | 0.23 | 0.13 | " |
| 03 | " | A-6 | " | 46 | 0.24 | 0.13 | " |
| 04 | " | A-20 | " | 40 | 0.25 | 0.13 | " |
| 05 | " | A-26 | " | 43 | 0.23 | 0.13 | " |
| 06 | " | A-43 | " | 45 | 0.23 | 0.13 | " |
| 07 | " | B-2 | 50 | 67 | 0.14 | 0.09 | " |
| 08 | " | " | 100 | 75 | 0.15 | 0.07 | " |
| 09 | " | B-19 | 100 | 74 | 0.14 | 0.07 | " |
| 10 | M-1 | — | — | 66 | 0.11 | 0.09 | " |
| 11 | " | A-1 | 20 | 72 | 0.09 | 0.08 | The invention |
| 12 | " | A-6 | " | 74 | 0.09 | 0.08 | " |
| 13 | " | A-20 | " | 70 | 0.09 | 0.08 | " |
| 14 | " | A-26 | " | 71 | 0.09 | 0.08 | " |
| 15 | " | A-43 | " | 73 | 0.09 | 0.08 | " |
| 16 | " | B-2 | 100 | 92 | 0.08 | 0.07 | Comparison |
| 17 | " | A-1/B-2 | 20/100 | 94 | 0.04 | 0.02 | The invention |
| 18 | " | A-20/B-2 | " | 93 | 0.04 | 0.02 | " |
| 19 | " | A-26/B-2 | " | 94 | 0.04 | 0.02 | " |
| 20 | M-10 | — | — | 67 | 0.11 | 0.09 | Comparison |
| 21 | " | A-1 | 20 | 73 | 0.09 | 0.08 | The invention |
| 22 | " | A-6 | " | 75 | 0.09 | 0.08 | " |
| 23 | " | A-20 | " | 70 | 0.09 | 0.08 | " |
| 24 | " | A-26 | " | 73 | 0.09 | 0.08 | " |
| 25 | " | A-43 | " | 74 | 0.09 | 0.08 | |
| 26 | " | B-2 | 100 | 93 | 0.08 | 0.07 | Comparison |
| 27 | " | A-1/B-2 | 20/100 | 95 | 0.04 | 0.02 | The invention |
| 28 | " | A-20/B-2 | " | 94 | 0.04 | 0.02 | " |
| 29 | " | A-26/B-2 | " | 95 | 0.04 | 0.02 | " |

*Light fastness: Indicates the percentage ratio of residual density after the decoloration test to the initial density $D_o = 1.5$ before the decoloration test.
*Stains $D_B$: Indicates the difference between the white ground's B density after the decoloration test and B density before the decoloration test.
*Stains $D_G$: Indicates the difference between the white ground's G density after the decoloration test and G density before the decoloration test.

* Light fastness: Indicates the percentage ratio of residual density after the decoloration test to the initial density $D_o=1.5$ before the decoloration test. * Stains $D_B$: Indicates the difference between the white ground's B density after the decoloration test and B density before the decoloration test. * Stains $D_G$: Indicates the difference between the white ground's G density after the decoloration test and G density before the decoloration test.

It is seen from the results of Table 2 that with the comparison couplers the light fastness is inferior to that obtained with the couplers of the invention and it becomes even worse when a compound of the invention represented by general formula (A) is added. Further, when a compound of the invention represented by general formula (A) is added, the density of yellow stains increases. In contrast, it was found that, surprisingly, the light fastness improves when a compound represented by general formula (A) is used in the coupler of the invention. Also, the light fastness is improved still further when a compound represented by general formula (B) is used. This unforeseen desirable trend is also observable in the stains $\Delta D_B$ and $\Delta D_G$ and one notes that this complements the above-noted color development characteristic, to give excellent results.

EXAMPLE 2

14.4 g of the above-noted magenta coupler (Ref-1) was dissolved by the addition of 14.4 ml of tricresyl phosphate and 20 ml of ethyl acetate, added to 100 ml of a gelatin aqueous solution containing 1 g of sodium dodecylbenzenesulfonate and 10 g of gelatin, and mechanically converted to a fine emulsified dispersion.

The entirety of this dispersion was added to 100 g of a pure silver chloride emulsion (containing 6.5 g of Ag) and a Sample 31 was prepared in the same manner as in Example 1.

Samples using the combinations noted in Table 3 were prepared by the same procedure. These samples are designated as 32 to 57.

The photographic performance of these samples was evaluated in the following manner.

Exposure of the samples was effected using the same sensitometer as in Example 1 in a manner such as to give an exposure of 1,000 CMS at an exposure time of 0.1 second. Exposure was followed by color development processing in the following stages using the following processing solution compositions.

| Processing stage | Temperature (°C.) | Processing Time |
|---|---|---|
| Color development | 35 | 45 sec. |
| Bleach-fixing | 35 | 45 sec. |
| Washing (1) | 35 | 30 sec. |
| Washing (2) | 35 | 30 sec. |
| Washing (3) | 35 | 30 sec. |
| Drying | 75 | 60 sec. |

| Color developing solution C | |
|---|---|
| Water | 800 ml |
| Ethylenediamine-N,N,N',N'-tetra-methylenephosphonic acid | 3.0 g |
| Triethanolamine | 8.0 g |

-continued

| | |
|---|---|
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,N-Bis(carboxymethyl)hydrazine | 5.0 g |
| Brightening agent (WHITEX4B, made by Sumitomo Kagaku) | 1.0 g |
| Water added to give | 1000 ml |
| pH (25° C.) | 10.05 |
| Bleach-fixing solution | |
| Water | 700 ml |
| Ammonium thiosulfate solution (700 g/l) | 100 ml |
| Ammonium sulfite | 18 g |
| Ferric ammonium ethylenediaminetetra-acetate dihydrate | 55 g |
| Disodium ethylenediaminetetraacetate | 3 g |
| Ammonium bromide | 40 g |
| Glacial acetic acid | 8 g |
| Water added to give | 1000 ml |
| pH (25° C.) | 5.5 |
| Washing solution | |
| Service water | |

Next, a color developing solution was prepared by leaving out the ethylenediamine-N,N,N',N'-tetramethylenephosphonic acid of color developing solution C and adding $Ca(NO_3)_2 \cdot 4H_2O$ as in Example 1 to make the $Ca^{2+}$ ion concentration 300 ppm, but otherwise making no changes. This solution is designated color developing solution D.

This color developing solution D was used in processing executed in exactly the same way as before. The resulting magenta image densities were measured and the characteristic curves obtained were used to evaluate the color development characteristics as defined in Example 1. The results are shown in Table 3.

TABLE 3

| Sample | Coupler | General formulas (A) and (B) | Amount added (mol % relative to coupler) | Color development characteristic | Remarks |
|---|---|---|---|---|---|
| 31 | Ref-1 | — | — | 0.79 | Comparison |
| 32 | " | A-3 | 20 | 0.82 | " |
| 33 | " | A-14 | " | 0.82 | " |
| 34 | " | A-21 | " | 0.83 | " |
| 35 | " | A-46 | " | 0.84 | " |
| 36 | " | B-1 | 100 | 0.79 | " |
| 37 | " | A-3/B-1 | 20/100 | 0.83 | " |
| 38 | " | A-21/B-1 | " | 0.83 | " |
| 39 | " | A-46/B-1 | " | 0.85 | " |
| 40 | M-2 | — | — | 0.86 | " |
| 41 | " | A-3 | 20 | 0.96 | The invention |
| 42 | " | A-14 | " | 0.96 | " |
| 43 | " | A-21 | " | 0.97 | " |
| 44 | " | A-46 | " | 0.98 | " |
| 45 | " | B-1 | 100 | 0.86 | Comparison |
| 46 | " | A-3/B-1 | 20/100 | 0.97 | The invention |
| 47 | " | A-21/B-1 | " | 0.98 | " |
| 48 | " | A-46/B-1 | " | 0.98 | " |
| 49 | M-9 | — | — | 0.85 | Comparison |
| 50 | " | A-3 | 20 | 0.95 | The invention |
| 51 | " | A-14 | " | 0.95 | " |
| 52 | " | A-21 | " | 0.96 | " |
| 53 | " | A-46 | " | 0.97 | " |
| 54 | " | B-1 | 100 | 0.85 | Comparison |
| 55 | " | A-3/B-1 | 20/100 | 0.96 | The invention |
| 56 | " | A-21/B-1 | " | 0.97 | " |
| 57 | " | A-46/B-1 | " | 0.98 | " |

It is clear from the results of Table 3 that using couplers of the present invention and a compound of the present invention represented by general formula (A) gives an excellent performance without any deterioration of color development characteristics, even in a color developing solution in which there is an excess of $Ca^{2+}$ ions. Further, if one compares the results with those obtained in Example 1, one not only sees that use of couplers of the present invention and a compound of the invention represented by general formula (A) is effective in all cases; but also that the color development characteristics are better with a silver chloride emulsion system wherein processing with a color developing solution that does not contain benzyl alcohol occurs, than they are with a silver chlorobromide emulsion system wherein processing with a color developing solution that does contain benzyl alcohol occurs.

It was further observed that in processing in this example, the couplers of the invention gave a higher $D_{max}$ than the comparison couplers, and when Sample 31 was compared with Samples 40 and 49 it was found that the density of Sample 31 was lower by about 0.6.

Next, the samples which had been processed with color developing solution C were given a 3 minute treatment in a 5% potassium ferricyanide aqueous solution followed by a 3 minute washing treatment and the resulting samples were used in evaluation of stains and light fastness under a fluorescent lamp in the same way as in Example 1. The results are shown in Table 4.

TABLE 4

| Sample | Coupler | General formulas (A) and (B) | Amount added (mol % relative to coupler) | Color image fastness (Fluorescent lamp) | Stains $\Delta D_B$ | Stains $\Delta D_G$ | Remarks |
|---|---|---|---|---|---|---|---|
| 31 | Ref-1 | — | — | 57 | 0.11 | 0.09 | Comparison |
| 32 | " | A-3 | 20 | 47 | 0.21 | 0.11 | " |
| 33 | " | A-14 | " | 48 | 0.22 | 0.11 | " |
| 34 | " | A-21 | " | 42 | 0.23 | 0.11 | " |
| 35 | " | A-46 | " | 49 | 0.23 | 0.11 | " |

TABLE 4-continued

| Sample | Coupler | General formulas (A) and (B) | Amount added (mol % relative to coupler) | Color image fastness (Fluorescent lamp) | Stains $\Delta D_B$ | Stains $\Delta D_G$ | Remarks |
|---|---|---|---|---|---|---|---|
| 36 | " | B-1 | 100 | 68 | 0.13 | 0.09 | " |
| 37 | " | A-3/B-1 | 20/100 | 71 | 0.13 | 0.07 | " |
| 38 | " | A-21/B-1 | " | 70 | 0.14 | 0.08 | " |
| 39 | " | A-46/B-1 | " | 73 | 0.14 | 0.08 | " |
| 40 | M-2 | — | — | 68 | 0.09 | 0.07 | " |
| 41 | " | A-3 | 20 | 74 | 0.08 | 0.06 | The invention |
| 42 | " | A-14 | " | 76 | 0.08 | 0.06 | " |
| 43 | " | A-21 | " | 72 | 0.09 | 0.07 | " |
| 44 | " | A-46 | " | 77 | 0.08 | 0.07 | " |
| 45 | " | B-1 | 100 | 82 | 0.07 | 0.05 | Comparison |
| 46 | " | A-3/B-1 | 20/100 | 91 | 0.04 | 0.03 | The invention |
| 47 | " | A-21/B-1 | " | 90 | 0.05 | 0.02 | " |
| 48 | " | A-46/B-1 | " | 93 | 0.05 | 0.02 | " |
| 49 | M-9 | — | — | 69 | 0.09 | 0.07 | Comparison |
| 50 | " | A-3 | 20 | 75 | 0.08 | 0.06 | The invention |
| 51 | " | A-14 | " | 77 | 0.08 | 0.06 | " |
| 52 | " | A-21 | " | 73 | 0.09 | 0.07 | " |
| 53 | " | A-46 | " | 79 | 0.08 | 0.06 | " |
| 54 | " | B-1 | 100 | 82 | 0.07 | 0.06 | Comparison |
| 55 | " | A-3/B-1 | 20/100 | 92 | 0.04 | 0.02 | The invention |
| 56 | " | A-21/B-1 | " | 91 | 0.05 | 0.02 | " |
| 57 | " | A-46/B-1 | " | 95 | 0.05 | 0.02 | " |

The evaluations of light fastness and stains are the same as in Example 1. It is seen from the results of Table 4 that the results both for light fastness and for stains are the same as in Example 1 and that in this example too the joint use of couplers of the invention and a compound of the invention represented by general formula (A) gives the unexpected excellent result that, unlike in the case with the, comparison couplers, there is improvement both with respect to light fastness and with respect of stains. It is also apparent that, as in the instance of color development characteristics, the performance was superior with a silver chloride system and processing with a color developing solution that does not contain benzyl alcohol.

EXAMPLE 3

A multilayer color photographic paper with the following layer configuration was prepared on a paper support laminated with polyethylene on both sides. The coating solutions were prepared in the following manner. Preparation of 1st layer coating solution 19.1 g of a yellow coupler (ExY), 4.4 g of a color image stabilizer (Cpd-1) and 0.7 g of another color image stabilizer (Cpd-7) were dissolved by addition of 27.2 ml of ethyl acetate and 8.2 g of a solvent (Solv-3), and the resulting solution was emulsified and dispersed in 185 ml of a 10% gelatin aqueous solution containing 8 ml of 10% sodium dodecylbenzenesulfonate. Meanwhile, a silver chlorobromide emulsion (employing cubic grains with a grain size of 0.85 $\mu$ and a coefficient of variation of 0.07 and containing silver bromide locally present on the grain surface in an amount of 1 mol% relative to the totality of the grain) were added the two types of blue-sensitive sensitization dyes indicated below, the additions being $2.0\times10^{-4}$ moles per 1 mole of silver in each case, and then the silver chlorobromide emulsion was given a sulfur sensitization treatment. This emulsion and the emulsified dispersion, described above, were then mixed and dissolved to give a 1st layer coating solution with the composition noted below. The 2nd layer to 7th layer coating solutions also were prepared by the same procedure as for the 1st layer coating solution. 1-oxy-3,5-dichloro-s-triazine sodium salt was used as a gelatin hardener for all the layers.

The following substances were used as spectral sensitization dyes for the various layers.

Blue-Sensitive Emulsion Layer:

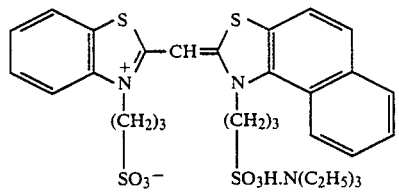

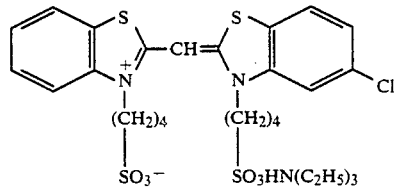

-continued ($2.0 \times 10^{-4}$ moles of each of the two substances above per 1 mole of silver halide)

Green-Sensitive Emulsion Layer:

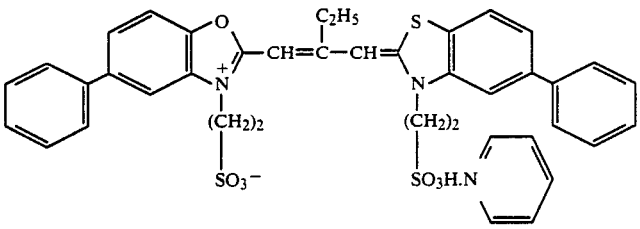

($4.0 \times 10^{-4}$ moles per 1 mole of silver halide)

and

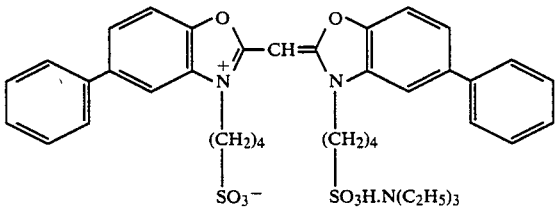

($7.0 \times 10^{-5}$ moles per 1 mole of silver halide)

Red-Sensitive Emulsion Layer:

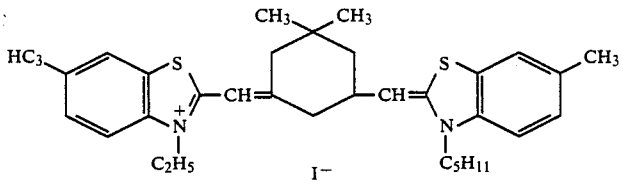

($0.9 \times 10^{-4}$ moles per 1 mole of silver halide)

$2.6 \times 10^{-3}$ moles of the following compound per 1 mole of silver halide were added to the red-sensitive emulsion layer.

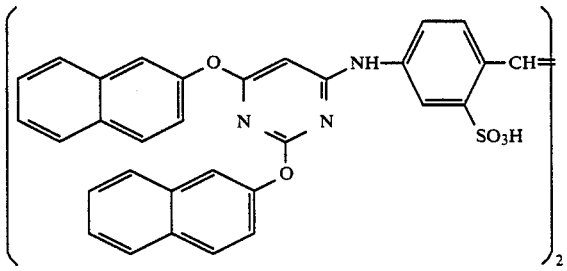

Further, to the blue-sensitive emulsion layer, green-sensitive emulsion layer and red-sensitive emulsion layer were added $8.5 \times 10^{-5}$ moles, $7.7 \times 10^{-4}$ moles and $2.5 \times 10^{-4}$ moles, respectively, of 1-(5-methylureidopohenyl)-5-mercaptotetrazole per 1 mole of silver halide.

The following dyes were added to the emulsion layers to prevent irradiation:

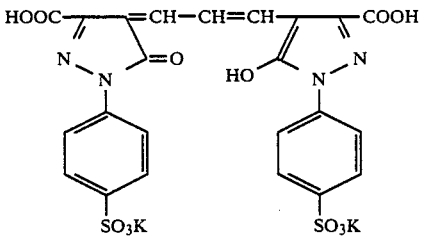

-continued and

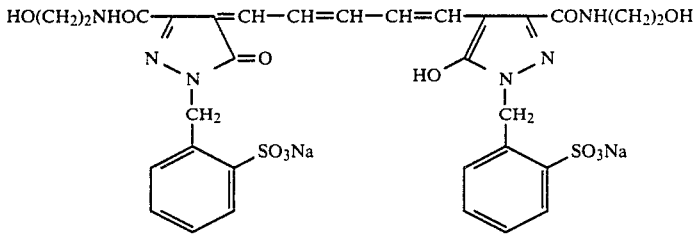

Layer configuration

The compositions of the various layers will now be given. The FIGURES indicate the coating quantities ($g/m^2$). The silver halide emulsion coating quantities are expressed as coating quantities converted to silver.

| | |
|---|---|
| Support | |
| Polyethylene laminated paper (Polyethylene on 1st layer side contains a white pigment ($TiO_2$) and a blue dye (ultramarine).) | |
| 1st layer (blue-sensitive layer) | |
| The above-noted silver chlorobromide emulsion | 0.30 |
| Gelatin | 1.86 |
| Yellow coupler (ExY) | 0.82 |
| Color image stabilizer (Cpd-1) | 0.19 |
| Color image stabilizer (Cpd-7) | 0.03 |
| Solvent (Solv-3) | 0.35 |
| 2nd layer (color mixing prevention layer) | |
| Gelatin | 0.99 |
| Color mixing prevention agent (Cpd-5) | 0.08 |
| Solvent (Solv-1) | 0.16 |
| Solvent (Solv-4) | 0.08 |
| 3rd layer (green-sensitive layer) | |
| Silver chlorobromide emulsion (cubic grains with a grain size of 0.40 μ and a coefficient of variation of 0.09; containing, relative to the totality of the grain, 1 mol % of silver bromide locally present on part of the grain surface) | 0.20 |
| Gelatin | 1.24 |
| Magenta coupler (Ref-1) | 0.29 |

-continued

| | |
|---|---|
| Color image stabilizer (Cpd-3) | 0.09 |
| Color image stabilizer (Cpd-4) | 0.06 |
| Solvent (Solv-2) | 0.32 |
| Solvent (Solv-7) | 0.16 |
| 4th layer (ultraviolet ray absorption layer) | |
| Gelatin | 1.58 |
| Ultraviolet ray absorber (UV-1) | 0.47 |
| Color mixing prevention agent (Cpd-5) | 0.05 |
| Solvent (Solv-5) | 0.24 |
| 5th layer | |
| Silver chlorobromide emulsion (cubic grains with a grain size of 0.36 μ and a coefficient of variation of 0.11; containing, relative to the totality of the grain, 1.6 mol % of silver bromide locally present on part of the grain surface) | 0.21 |
| Gelatin | 1.34 |
| Cyan coupler (ExC) | 0.34 |
| Color image stabilizer (Cpd-6) | 0.17 |
| Color image stabilizer (Cpd-7) | 0.34 |
| Color image stabilizer (Cpd-9) | 0.04 |
| Solvent (Solv-6) | 0.37 |
| 6th layer (ultraviolet ray abosrption layer) | |
| Gelatin | 0.53 |
| Ultraviolet ray absorber (UV-1) | 0.16 |
| Color mixing prevention agent (Cpd 5) | 0.02 |
| Solvent (Solv-5) | 0.08 |
| 7th layer (protective layer) | |
| Gelatin | 1.33 |
| Acryl-modified copolymer of polyvinyl alcohol (modification degree 17%) | 0.17 |
| Liquid paraffin | 0.03 |

Yellow coupler (ExY)

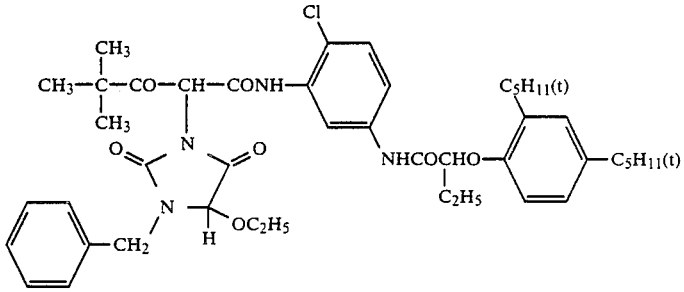

(Ref-1) magenta coupler

-continued
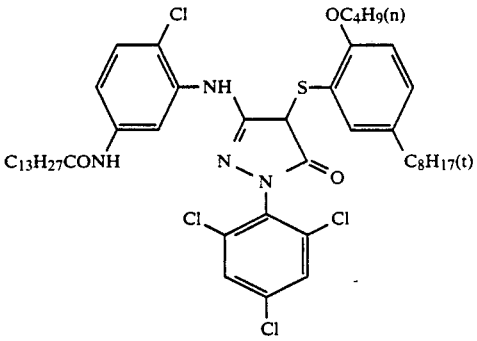
(ExC) cyan coupler
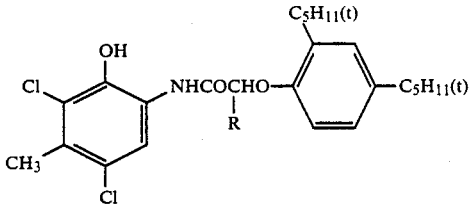
1:3:6 mixture (weight ratio) of R = H, $C_2H_5$, $C_4H_9$
(Cpd-1) Color image stabilizer
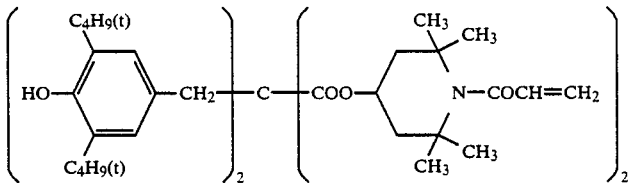
(Cpd-3) Color image stabilizer
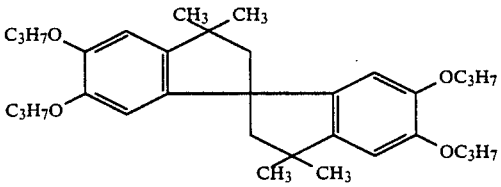
(Cpd-4) Color image stabilizer
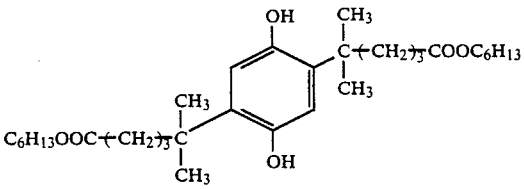
(Cpd-5) color mixing preventing agent
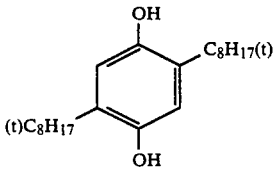
(Cpd-6) Color image stabilizer
2:4:4 mixture (weight ratio) of -continued
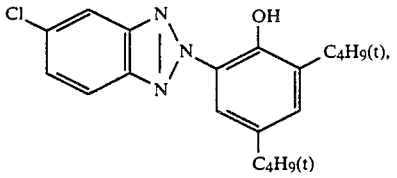
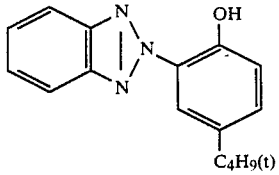
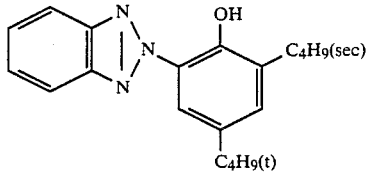
(Cpd-7) Color image stabilizer
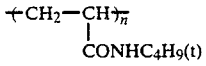
Molecular weight 60,000
(UV-1) Ultraviolet ray absorber
4:2:4 mixture (weight ratio) of
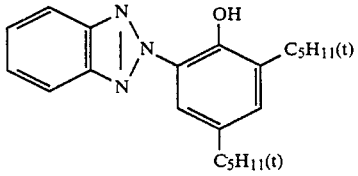
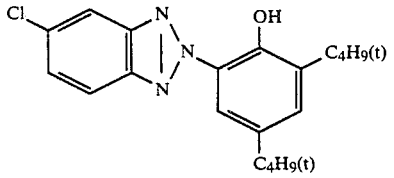
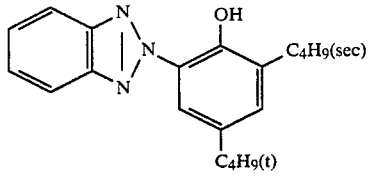
(Solv-1) Solvent
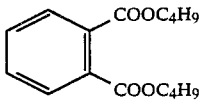
(Solv-2) Solvent
3:7 mixture (by volume) of -continued

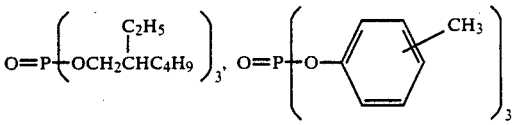

(Solv-3) Solvent $O{=}P{+}O{-}C_9H_{19}(iso))_3$ (Solv-4) Solvent

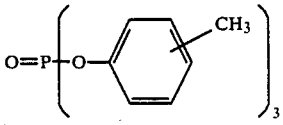

(Solv-5) Solvent $COOC_8H_{17}$
|
$(CH_2)_8$
|
$COOC_8H_{17}$ (Solv-6) Solvent

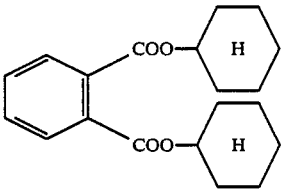

(Solv-7) Solvent

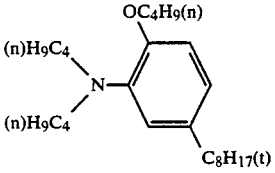

The silver halide color photographic light-sensitive material thus prepared is designated Sample 61.

Samples with the combinations indicated in Table 5 were similarly prepared. The photographic performance of these samples was evaluated in the following manner.

Exposure of the samples were effected using the same sensitometer as in Example 1 in a manner such as to give an exposure of 250 CMS at an exposure time of 0.1 second. In this process, wedge exposure for sensitometry was effected via a trichromatic filter. After exposure, continuous processing (a running test) comprising the following processing stages was performed using a paper processing unit until 2 times the volume of the color development tank had been replenished.

| Processing Stage | Temperature (°C.) | Time | Replenishment Quantity* (ml) | Tank Capacity (l) |
|---|---|---|---|---|
| Color development | 35 | 45 sec. | 161 | 17 |
| Bleach-fix | 30 to 35 | 45 sec. | 215 | 17 |
| Rinse (1) | 30 to 35 | 20 sec. | — | 10 |
| Rinse (2) | 30 to 35 | 20 sec. | — | 10 |
| Rinse (3) | 30 to 35 | 20 sec. | 350 | 10 |

-continued

| Processing Stage | Temperature (°C.) | Time | Replenishment Quantity* (ml) | Tank Capacity (l) |
|---|---|---|---|---|
| Drying | 70 to 80 | 60 sec. | | |

*per 1 $m^2$ of photosensitive material (A rinse (3) → (1) 3-tank counterflow system was used.)

The compositions of the processing solutions were as follows:

| | Tank Solution | Replenishment Solution |
|---|---|---|
| Color developing solution (E) | | |
| Water | 800 ml | 800 ml |
| Ethylenediamine-N,N,N',N'-tetramethylenephosphonic acid | 1.5 g | 2.0 g |
| Triethanolamine | 8.0 g | 12.0 g |
| Sodium chloride | 1.4 g | |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)-hydrazine | 5.5 g | 7.0 g |
| Brightening agent (WHITEX4B, made by Sumitomo Kagaku) | 1.0 g | 2.0 g |

-continued

| | Tank Solution | Replenishment Solution |
|---|---|---|
| Water added to give | 1000 ml | 1000 ml |
| pH (25° C.) | 10.05 | 10.45 |
| Bleach-fixing solution (tank solution and replenishment solution were identical) | | |
| Water | 400 ml | |
| Ammonium thiosulfate solution (70% aqueous solution) | 100 ml | |
| Sodium sulfite | 17 g | |
| Ferric (III) ammonium ethylenediamine-tetraacetate | 55 g | |
| Disodium ethylenediaminetetraacetate | 5 g | |
| Ammonium bromide | 40 g | |
| Water added to give | 1000 ml | |
| pH (25° C.) | 6.0 | |
| Rinse solution (tank solution and replenishment solution were identical) | | |
| Ion exchange water (both calcium and magnesium 3 ppm or less) | | |

Next, a color developing solution was prepared with the ethylenediamine-N,N,N',N'-tetramethylenephosphonic acid of color developing solution (E) left out and additions made to bring the $Ca^{2+}$ ion concentration to 300 ppm. This solution is designated color developing solution (F). This color developing solution (F) was used in processing executed in exactly the same way as before. The resulting magenta image densities were measured and the characteristic curves obtained were used to evaluate the color development characteristics as defined in Example 1. The results are shown in Table 5.

TABLE 5

| Sample | Coupler | General formulas (A) and (B) | Amount added (mol % relative to coupler) | Color development characteristic | Remarks |
|---|---|---|---|---|---|
| 61 | Ref-1 | — | — | 0.75 | Comparison |
| 62 | " | A-3 | 20 | 0.81 | " |
| 63 | " | A-19 | 20 | 0.82 | " |
| 64 | " | A-3/B-1 | 20/100 | 0.88 | " |
| 65 | " | A-19/B-1 | 20/100 | 0.89 | " |
| 66 | M-1 | — | — | 0.87 | " |
| 67 | " | A-3 | 20 | 0.94 | The invention |
| 68 | " | A-19 | 20 | 0.95 | " |
| 69 | " | A-3/B-1 | 20/100 | 0.99 | " |
| 70 | " | A-19/B-1 | 20/100 | 0.99 | " |
| 71 | M-10 | — | — | 0.86 | Comparison |
| 72 | " | A-3 | 20 | 0.93 | The invention |
| 73 | " | A-19 | 20 | 0.94 | " |
| 74 | " | A-3/B-1 | 20/100 | 0.99 | " |
| 75 | " | A-19/B-1 | 20/100 | 0.99 | " |
| 76 | M-43 | — | — | 0.87 | Comparison |
| 77 | " | A-3 | 20 | 0.94 | The invention |
| 78 | " | A-19 | 20 | 0.95 | " |
| 79 | " | A-3/B-1 | 20/100 | 0.99 | " |
| 80 | " | A-19/B-1 | 20/100 | 0.99 | " |

It is clear from the results of Table 5 that, compared to what is achieved by comparison couplers, use of the compounds represented by general formula (A) and the couplers that are structural elements of the invention gives very great improvement with respect to deterioration of color development characteristics and results in satisfactory color development characteristics being displayed in a color developing solution which contains a large amount of $Ca^{2+}$ ions Also, there is still greater improvement if joint use of a compound represented by general formula (B) is made.

Next, the samples that had been processed with color developing solution (E) were given 3 minutes treatment in a 5% potassium ferricyanide aqueous solution followed by 3 minutes washing treatment and the resulting samples were used in evaluation of stains and light fastness under a fluorescent lamp in the same way as in Example 1. The results are shown in Table 6.

TABLE 6

| Sample | Coupler | General formulas (A) and (B) | Amount added (mol % relative to coupler) | Color image fastness (Fluorescent lamp) | Stains $\Delta D_B$ | Stains $\Delta D_G$ | Remarks |
|---|---|---|---|---|---|---|---|
| 61 | Ref-1 | — | — | 62 | 0.14 | 0.12 | Comparison |
| 62 | " | A-3 | 20 | 60 | 0.23 | 0.14 | " |
| 63 | " | A-19 | 20 | 59 | 0.24 | 0.14 | " |
| 64 | " | A-3/B-1 | 20/100 | 75 | 0.11 | 0.12 | " |
| 65 | " | A-19/B-1 | 20/100 | 74 | 0.11 | 0.12 | " |
| 66 | M-1 | — | — | 72 | 0.12 | 0.10 | " |
| 67 | " | A-3 | 20 | 81 | 0.10 | 0.08 | The invention |
| 68 | " | A-19 | 20 | 83 | 0.10 | 0.08 | " |
| 69 | " | A-3/B-1 | 20/100 | 92 | 0.07 | 0.05 | " |
| 70 | " | A-19/B-1 | 20/100 | 91 | 0.07 | 0.05 | " |
| 71 | M-10 | — | — | 73 | 0.12 | 0.10 | Comparison |
| 72 | " | A-3 | 20 | 85 | 0.10 | 0.08 | The invention |
| 73 | " | A-19 | 20 | 84 | 0.10 | 0.08 | " |
| 74 | " | A-3/B-1 | 20/100 | 93 | 0.07 | 0.04 | " |
| 75 | " | A-19/B-1 | 20/100 | 92 | 0.07 | 0.04 | " |
| 76 | M-43 | — | — | 72 | 0.12 | 0.10 | Comparison |
| 77 | " | A-3 | 20 | 81 | 0.10 | 0.08 | The invention |
| 78 | " | A-19 | 20 | 83 | 0.10 | 0.08 | " |
| 79 | " | A-3/B-1 | 20/100 | 92 | 0.07 | 0.05 | " |

TABLE 6-continued

| Sample | Coupler | General formulas (A) and (B) | Amount added (mol % relative to coupler) | Color image fastness (Fluorescent lamp) | Stains $\Delta D_B$ | Stains $\Delta D_G$ | Remarks |
|---|---|---|---|---|---|---|---|
| 80 | " | A-19/B-1 | 20/100 | 91 | 0.07 | 0.05 | " |

The same procedure as is Example 1 was followed for evaluation of light fastness and stains.

It is clear from the results of Table 6 that the joint use of the compounds represented by general formula (A) and the couplers that are structural elements of the invention gives marked improvement both with respect to light fastness and with respect to stains. These results are the same as the result obtained in the previous examples and confirm the effectiveness even in a sensitive material with a multilayer structure as in this example.

The fastness of the color images was further investigated by investigating the heat fastness and damp heat fastness in the following conditions.

| | |
|---|---|
| Heat fastness: | 100° C., 7 days |
| Damp heat fastness: | 80° C., 70%, 20 days |

The results of this investigation are shown in Table 7.

TABLE 7

| Sample | Coupler | General formulas (A) and (B) | Amount added (mol % relative to coupler | Color image fastness: Heat fastness: Fastness | Heat fastness: Stains $\Delta D_B$ | Damp heat fastness: Fastness | Damp heat fastness: Stains $\Delta D_B$ | Remarks |
|---|---|---|---|---|---|---|---|---|
| 61 | Ref-1 | — | — | 91 | 0.18 | 90 | 0.17 | Comparison |
| 62 | " | A-3 | 20 | 90 | 0.18 | 90 | 0.17 | " |
| 63 | " | A-19 | 20 | 90 | 0.18 | 90 | 0.17 | " |
| 64 | " | A-3/B-1 | 20/100 | 95 | 0.14 | 96 | 0.13 | " |
| 65 | " | A-19/B-1 | 20/100 | 95 | 0.14 | 96 | 0.13 | " |
| 66 | M-1 | — | — | 93 | 0.15 | 94 | 0.14 | " |
| 67 | " | A-3 | 20 | 94 | 0.13 | 96 | 0.12 | The invention |
| 68 | " | A-19 | 20 | 94 | 0.13 | 96 | 0.12 | " |
| 69 | " | A-3/B-1 | 20/100 | 98 | 0.06 | 99 | 0.05 | " |
| 70 | " | A-19/B-1 | 20/100 | 98 | 0.06 | 99 | 0.05 | " |
| 71 | M-10 | — | — | 94 | 0.15 | 94 | 0.14 | Comparison |
| 72 | " | A-3 | 20 | 95 | 0.13 | 96 | 0.12 | The invention |
| 73 | " | A-19 | 20 | 95 | 0.13 | 96 | 0.12 | " |
| 74 | " | A-3/B-1 | 20/100 | 99 | 0.06 | 99 | 0.05 | " |
| 75 | " | A-19/B-1 | 20/100 | 99 | 0.06 | 99 | 0.05 | " |
| 76 | M-43 | — | — | 93 | 0.15 | 94 | 0.14 | Comparison |
| 77 | " | A-3 | 20 | 94 | 0.13 | 96 | 0.12 | The invention |
| 78 | " | A-19 | 20 | 94 | 0.13 | 96 | 0.12 | " |
| 79 | " | A-3/B-1 | 20/100 | 98 | 0.06 | 99 | 0.05 | " |
| 80 | " | A-19/B-1 | 20/100 | 98 | 0.06 | 99 | 0.05 | " |

The same procedure as in Example 1 was followed for evaluation of the color image fastness and stains $\Delta D_B$.

It is seen from Table 7 that combinations of the compounds represented by general formula (A) and the couplers that are structural elements of the invention give excellent results with respect to heat and damp heat fastness and stain.

Further, the color image fastness of samples that had been processing using color developing solution (F) was investigated and the findings of this investigation were the same as those noted in Table 6 and Table 7.

EXAMPLE 4

Samples 61 to 80 that were prepared in Example 3 were taken and given the same exposure as in Example 3 and processing as follows was effected:

| Processing stage | Temperature (°C.) | Time |
|---|---|---|
| Color development | 35 | 45 sec. |
| Bleach-fixing | 30 to 36 | 45 sec. |
| Stabilization (1) | 30 to 37 | 20 sec. |
| Stabilization (2) | 30 to 37 | 20 sec. |
| Stabilization (3) | 30 to 37 | 20 sec. |
| Stabilization (4) | 30 to 37 | 30 sec. |
| Drying | 70 to 85 | 60 sec. |

(A Stabilization (4) → (1) 4-tank counterflow system was used.)

The compositions of the processing solutions were as follows.

| | |
|---|---|
| Color developing solution (G) | |
| Water | 800 ml |
| Ethylenediaminetetraacetic acid | 2.0 g |
| Triethanolamine | 8.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,N-Diethylhydroxylamine | 4.2 g |
| 5,6-Dihydroxybenzene-1,2,4-trisulfonic acid | 0.3 g |
| Brightening agent (4,4'-diaminostilbene-based) | |
| Water added to give | 1000 ml |
| pH (25° C.) | 10.10 |
| Bleach-fixing solution | |
| Water | 400 ml |
| Ammonium thiosulfate (70% aqueous solution) | 100 ml |
| Sodium sulfite | 18 g |
| Ferric(III) ammonium ethylenediamine-tetraacetate | 55 g |
| Disodium ethylenediaminetetraacetate | 3 g |
| Glacial acetic acid | 8 g |

-continued

| | |
|---|---|
| Water added to give | 1000 ml |
| pH (25° C.) | 5.5 |
| Stabilization solution | |
| Formalin (37% aqueous solution) | 0.1 g |
| Formalin-sulfurous acid adduct | 0.7 g |
| 5-Chloro-2-methyl-4-isothiazolin-3-one | 0.02 g |
| 2-Methyl-4-isothiazolin-3-one | 0.01 g |
| Copper sulfate | 0.005 g |
| Water added to give | 1000 ml |
| pH (25° C.) | 4.0 |

Also, the ethylenediaminetetraacetic acid component was left out from the composition of color developing solution (G) and addition was made to bring the $Ca^{2+}$ concentration to 300 ppm. Exposure was effected in exactly the same way as before and processing was carried out using this color developing solution (H). When the color development characteristics of the resulting samples of the two lots of processing were compared using the same evaluation procedure as in Example 1, it was found that the results were the same as those achieved in Example 3 (Table 6). Also, the findings for fastness to light, heat and damp heat were the same as those noted in Table 6 and Table 7, thus showing that marked improvements are achieved by the use of the compounds represented by general formula (A) and the couplers that are structural elements of the invention.

EXAMPLE 5

Multilayer color photographic paper with the following layer configuration was prepared on a paper support laminated with polyethylene on both sides. The coating solutions were prepared in the following manner. Preparation of the first layer coating solution 19.1 g of a yellow coupler (ExY), 4.4 g and 1.8 g respectively of color image stabilizers (Cpd-1) and (Cpd-7) were dissolved by addition of 27.2 ml of ethyl acetate and 4.1 g each of a solvent (Solv-3) and another solvent (Solv-6) and the resulting solution was emulsified and dispersed in 185 ml of a 10% gelatin aqueous solution containing 8 ml of 10% sodium dodecylbenzenesulfonate. Meanwhile, a silver chlorobromide emulsion (mixture of a silver bromide 80.0 mol %, cubic, average grain size 0.85 μ, coefficient of variation 0.08 emulsion and a silver bromide 80.0 mol %, cubic, average grain size 0.62 μ, coefficient of variation 0.07 emulsion in the proportions 1:3 (Ag mole ratio) was sulfur sensitized and to the resulting material was added $5.0\times10^{-4}$ mol of the blue-sensitive sensitization dye indicated below per 1 mole of silver. This emulsion and the emulsified dispersion described above were mixed and dissolved to give a first layer coating solution with the composition noted below. The second layer to seventh layer coating solutions also were prepared by the same procedure as for the first layer coating solution. 1-oxy-3,5-dichloro-s-triazine sodium salt was used as a gelatin hardener for all the layers.

The following substances were used as spectral sensitization dyes for the layers.

Blue-sensitive emulsion layer

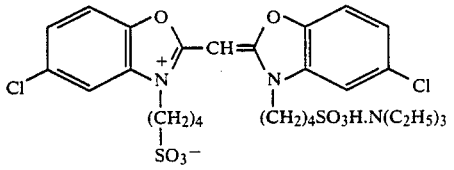

($5.0\times10^{-4}$ moles per 1 mole of silver halide)

Green-sensitive emulsion layer

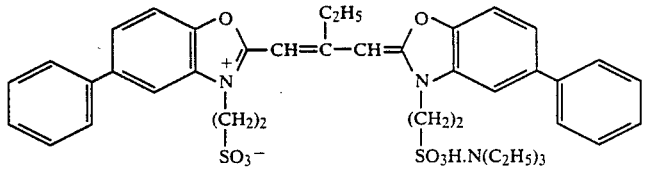

($4.0\times10^{-4}$ moles per 1 mole of silver halide)

and

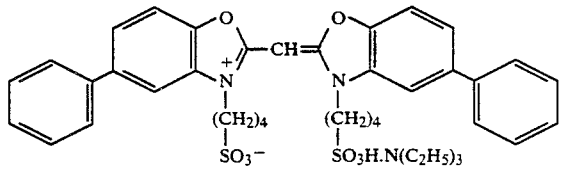

($7.0\times10^{-4}$ moles per 1 mole of silver halide)

Red-sensitive emulsion layer

-continued

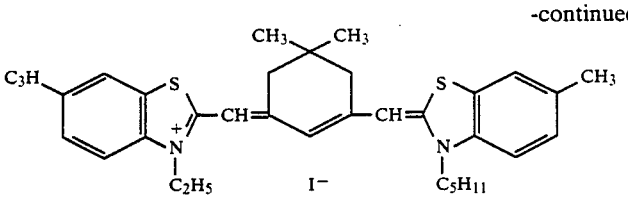

(0.9 × $10^{-4}$ moles per 1 mole of silver halide)

$2.6\times10^{-3}$ moles of the following compound per 1 mole of silver halide was added to the red-sensitive emulsion layer.

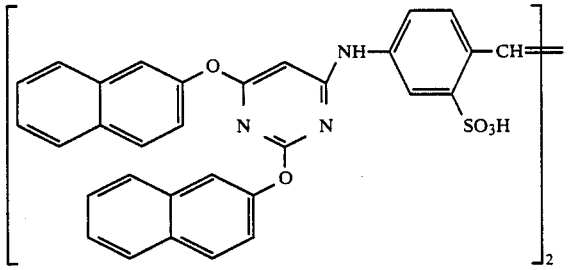

Further, the blue-sensitive emulsion layer, the green-sensitive emulsion layer and the red-sensitive emulsion layer were given respective additions of $4.0\times10^{-6}$ moles, $3.0\times10^{-5}$ moles and $1.0\times10^{-5}$ moles of 1-(5-methylureidophenyl)-5-mercaptotetrazole and $8\times10^{-3}$ moles, $2\times10^{-2}$ moles and $2\times10^{-2}$ moles of 2-methyl-5-t-octylhydroquinone per 1 mole of silver halide.

The blue-sensitive emulsion layer and the green-sensitive emulsion layer were further given respective additions of $1.2\times10^{-2}$ moles and $1.1\times10^{-2}$ moles of 4-hydroxy-6-methyl-1,3,3a,7-tetraazaindene per 1 mole of silver halide.

The following dyes were added to the emulsion layers to prevent irradiation:

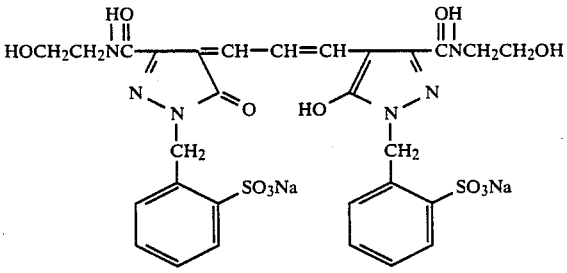

and

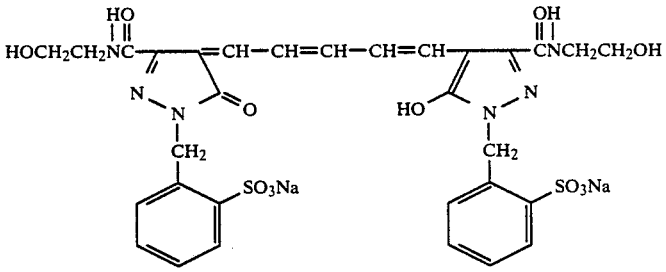

Layer configuration

The compositions of the various layers will now be given. The figures indicate the coating quantities (g/m²). The silver halide emulsion coating quantities are expressed as coating quantities converted to silver.

| | |
|---|---|
| Support | |
| Polyethylene laminated paper (Polyethylene on 1st layer side contains a white pigment ($TiO_2$) and a blue dye (ultramarine).) | |
| 1st layer (blue-sensitive layer) | |
| The above noted silver chlorobromide emulsion (AgBr: 80 mol %) | 0.26 |
| Gelatin | 1.83 |
| Yellow coupler (ExY) | 0.83 |
| Color image stabilizer (Cpd-1) | 0.19 |
| Color image stabilizer (Cpd-7) | 0.08 |
| Solvent (Solv-3) | 0.18 |
| Solvent (Solv-6) | 0.18 |
| 2nd layer (color mixing prevention layer) | |
| Gelatin | 0.99 |
| Color mixing prevention agent (Cpd-6) | 0.08 |
| Solvent (Solv-1) | 0.16 |
| Solvent (Solv-4) | 0.08 |
| 3rd layer (green-sensitive layer) | |
| Silver chlorobromide emulsion (1:3 (Ag mole ratio) mixture of an AgBr 90 mol %, cubic, average grain size 0.47 μ, coefficient of variation 0.12 emulsion and an AgBr 90 mol %, cubic, average grain size 0.36 μ, coefficient of variation 0.09 emulsion) | 0.16 |
| Gelatin | 1.79 |
| Magenta coupler (Ref-1) | 0.32 |
| Color image stabilizer (Cpd-3) | 0.20 |
| Color image stabilizer (Cpd-4) | 0.01 |
| Solvent (Solv-2) | 0.65 |
| 4th layer (ultraviolet ray absorption layer) | |
| Gelatin | 1.58 |

-continued

| | |
|---|---|
| Ultraviolet ray absorbent (UV-1) | 0.47 |
| Color mixing prevention agent (Cpd-5) | 0.05 |
| Solvent (Solv-5) | 0.24 |
| uz,3/17 5th layer (red-sensitive layer) | |
| Silver chlorobromide emulsion (1:2 (Ag mole ratio) mixture of an AgBr 70 mol %, cubic, average grain size 0.49 μ, coefficient of variation 0.08 emulsion and an AgBr 70 mol %, cubic, average grain size 0.34 μ, coefficient of variation 0.10 emulsion) | 0.23 |
| Gelatin | 1.34 |
| Cyan coupler (ExC) | 0.30 |
| Color image stabilizer (Cpd-6) | 0.17 |

-continued

| | |
|---|---|
| Color image stabilizer (Cpd-7) | 0.40 |
| Solvent (Solv-6) | 0.20 |
| 6th layer (ultraviolet ray absorption layer) | |
| Gelatin | 0.53 |
| Ultraviolet ray absorbent (UV-1) | 0.16 |
| Color mixing prevention agent (Cpd-5) | 0.02 |
| Solvent (Solv-5) | 0.08 |
| 7th layer (protective layer) | |
| Gelatin | 1.33 |
| Polyvinyl alcohol acrylic modified copolymer (modification degree 17%) | 0.17 |
| Liquid paraffin | 0.03 |

(Cpd-1) color image stablizer

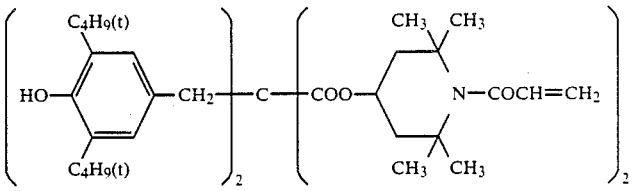

(Cpd-3) color image stabilizer

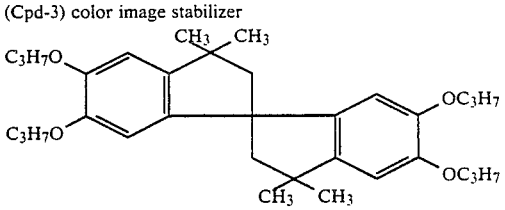

(Cpd-4) color image stabilizer

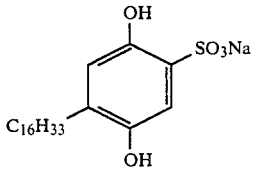

(Cpd-5) color mixing prevention agent

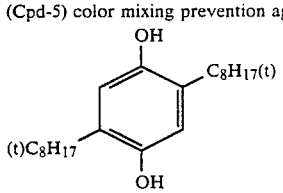

(Cpd-6) color image stabilizer 2:4:4 mixture (weight ratio) of

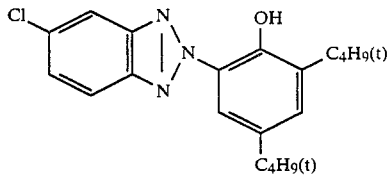

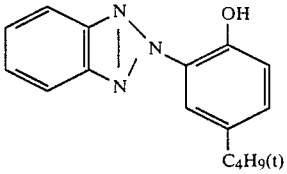

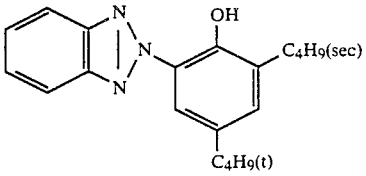

(Cpd-7) color image stabilizer

-continued $$\left(CH_2-\underset{\underset{CONHC_4H_9(t)}{|}}{CH}\right)_n$$

Molecular weight 80,000

(UV-1) ultraviolet ray absorber 4:2:4 mixture (weight ratio) of

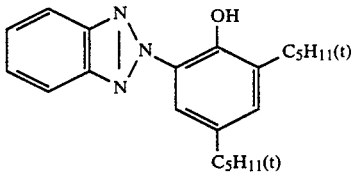

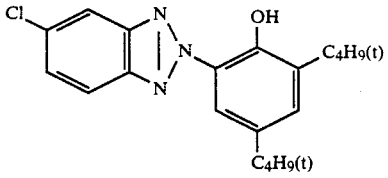

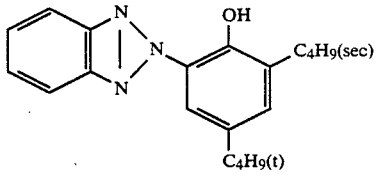

(Solv-1) solvent

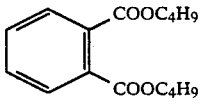

(Solv-2) solvent 2:1 mixture (by volume) of

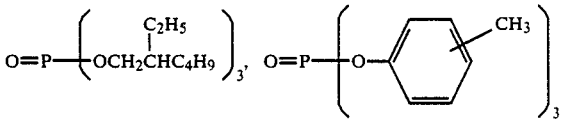

(Solv-3) solvent $O{=}P\left(O-C_9H_{19}(iso)\right)_3$ (Solv-4) solvent

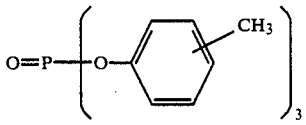

(Solv-5) solvent $$\begin{array}{l} COOC_8H_{17} \\ | \\ (CH_2)_8 \\ | \\ COOC_8H_{17} \end{array}$$

(Solv-6) solvent $$C_8H_{17}\underset{\underset{O}{\diagdown\ \diagup}}{CHCH}(CH_2)_7COOC_8H_{17}$$

(ExY) yellow coupler

-continued

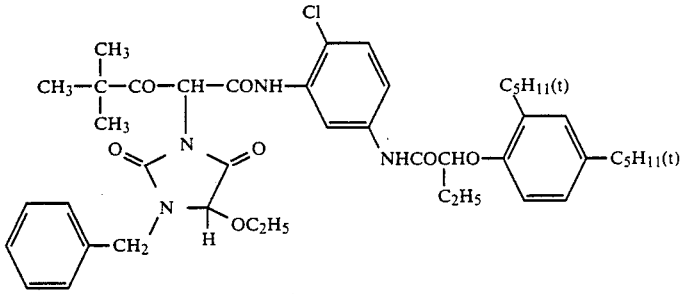

(Ref-1) megenta coupler

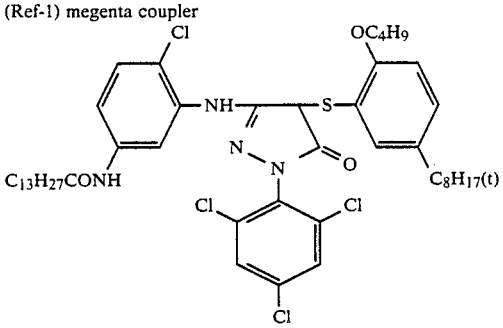

(ExC) Cyan coupler 1:1 mixture (molar ratio) of

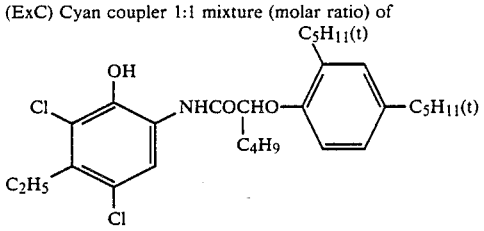

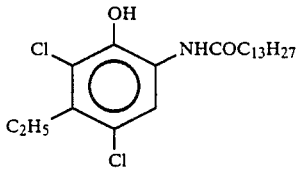

The multilayer silver halide color photographic light-sensitive material thus prepared is designated Sample 81.

Next, Samples 82 to 109 were prepared by adding the magenta coupler of the third layer (the green-sensitive layer) and compounds represented by general formulas (A) and (B), as was done for Samples 02 to 29 in Example 1.

These samples were exposed in the same exposure conditions as in Example 3 and continuous processing (a running test) comprising the following processing stages was performed using a paper processing unit until 2 times the volume of the color development tank had been replenished.

| Processing Stage | Temperature (°C.) | time | Replenishment Quantity* (ml) | Tank Capacity (l) |
|---|---|---|---|---|
| Color development | 35 | 45 sec. | 161 | 17 |
| Bleach-fix | 30 to 35 | 45 sec. | 215 | 17 |
| Rinse (1) | 30 to 35 | 20 sec. | — | 10 |
| Rinse (2) | 30 to 35 | 20 sec. | — | 10 |
| Rinse (3) | 30 to 35 | 20 sec. | 350 | 10 |

-continued

| Processing Stage | Temperature (°C.) | time | Replenishment Quantity* (ml) | Tank Capacity (l) |
|---|---|---|---|---|
| Drying | 70 to 80 | 60 sec. | | |

*per 1 $m^2$ of photosensitive material (A rinse (3) → (1) 3-tank counterflow system was used.)

The compositions of the processing solutions were as follows.

| Color developing solution (J) | Tank Solution | Replenishment Solution |
|---|---|---|
| Water | 800 ml | 800 ml |
| Ethylenediamine-N,N,N',N'-tetramethylenephosphonic acid | 1.5 g | 2.0 g |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)-hydrazine | 5.5 g | 7.0 g |
| Brightening agent | 1.0 g | 2.0 g |

-continued

| | | |
|---|---|---|
| (WHITEX4B, made by Sumitomo Kagaku) | | |
| Water added to give | 1000 ml | 1000 ml |
| pH (25° C.) | 10.05 | 10.45 |
| Bleach-fixing solution (tank solution and replenishment solution were identical) | | |
| Water | | 400 ml |
| Ammonium thiosulfate solution (70% aqueous solution) | | 100 ml |
| Sodium sulfite | | 17 g |
| Ferric (III) ammonium ethylenediamine-tetraacetate | | 55 g |
| Disodium ethylenediaminetetraacetate | | 5 g |
| Ammonium bromide | | 40 g |
| Water added to give | | 1000 ml |
| pH (25° C.) | | 6.0 |
| Rinse solution (tank solution and replenishment solution were identical) | | |
| Ion exchange water (both calcium and magnesium 3 ppm or less) | | |

Next, processing was performed in the same way but leaving out the ethylenediamine-N,N,N',N'-tetramethylenephosphonic acid of the color developing solution (J) and making additions and also adjusting the replenishment quantity so as to make the $Ca^{2+}$ ion concentration 300 ppm.

On evaluation of the color development characteristics of the samples produced in this manner by the same procedure as described earlier, it was found that, as was the case with the results in Example 1 shown in Table 1, the use of the compounds represented by general formula (A) and the couplers that are structural elements of the invention gives marked improvement effects. Further, when the joint use of compounds represented by general formula (B) was made, even, greater improvements were observed. Similar improvements were observed with respect to light fastness too.

EXAMPLE 6

A multilayer color photographic paper having the following layer configurations on a paper support laminated with polyethylene on both sides was prepared. The coating solutions were prepared in the following manners.

Preparation of 1st layer coating solution

In 150 ml of ethyl acetate, 3.0 ml of a solvent (Solv-1), and 1.5 ml of a solvent (Solv-2) were dissolved 60.0 g of a yellow coupler (ExY) and 28.0 g of a fading inhibitor (Cpd-1) and the resulting solution was dispersed in 450 ml of an aqueous 10% gelatin solution containing sodium dodecylbenzenesulfonate using a ultrasonic homogenizer. The dispersion obtained was mixed with 420 g of a silver chlorobromide emulsion (silver bromide 90.0 mol %) containing the blue-sensitive sensitizing dye shown below and dissolved to give a 1st layer coating solution.

The coating solutions for the 2nd layer to the 7th layer were also prepared by the similar manners to the aforesaid manner for the 1st layer coating solution.

For each layer was used 1,2-bis(vinylsulfonyl)ethane as a gelatin hardener.

The following dye was used as a spectral sensitizing dye for each emulsion layer.

Blue-Sensitive Emulsion Layer

Anhydro-5-methoxy-5-methyl-3,3'-disulfopropylselenacyanine hydroxide

Green-Sensitive Emulsion Layer

Anhydro-9-ethyl-5,5'-diphenyl-3,3'-disulfoethyloxacarbocyanine hydroxide

Red-Sensitive Emulsion Layer 3,3'-Diethyl-5-methoxy-9,9'-(2,2'-dimethyl-1,3-propano)thiacarbocyanine iodide Also, for each emulsion layer, the following compound was used as a stabilizer.

1-Methyl-2-mercapto-5-acethylamino-1,3,4-triazole

Also, the following compounds were used as irradiation inhibiting dyes.

[3-Carboxy-5-hydroxy-4-(3-(3-carboxy-5 -oxo-1-(2,5-disulfonaphthophenyl)-2-pyrazolin-4-iridene)-1-propenyl) -1-pyrazolyl]benzene-2,5-disulfonate disodium salt N,N'-(4,8-Dihydroxy-9,10-dioxo-3,7-disulfonatoanthracene-1,5-diyl) -bis(aminomethanesulfonate) tetrasodium salt Layer configuration The composition of each layer is shown below. The figures indicate the coating amounts ($g/m^2$), wherein, however, the figures for silver halide emulsions are expressed as coating amounts converted to silver.

| | |
|---|---|
| Support | |
| Paper support laminated by polyethylene on both sides. | |
| 1st Layer (Blue-Sensitive Layer) | |
| Silver halide emulsion (Br: 90%) | 0.29 |
| Gelatin | 1.80 |
| Yellow coupler (ExY) | 0.60 |
| Fading inhibitor (Cpd-1) | 0.28 |
| Solvent (Solv-1) | 0.03 |
| Solvent (Solv-2) | 0.015 |
| 2nd Layer (Color Mixing Prevention Layer) | |
| Gelatin | 0.80 |
| Color Mixing Prevention Agent (Cpd-2) | 0.055 |
| Solvent (Solv-1) | 0.03 |
| Solvent (Solv-2) | 0.015 |
| 3rd Layer (Green-Sensitive Layer) | |
| Silver halide emulsion (Br: 74%) | 0.185 |
| Gelatin | 0.85 |
| Magent coupler (M-60) | 0.36 |
| Fading inhibitor (Cpd-3) | 0.10 |
| Fading inhibitor (Cpd-4) | 0.05 |
| Solvent (Solv-1) | 0.33 |
| Solvent (Solv-2) | 0.03 |
| 4th Layer (Color Mixing Prevention Layer) | |
| Gelatin | 1.70 |
| Color mixing prevention agent (Cpd-2) | 0.065 |
| Ultraviolet absorber (UV-1) | 0.45 |
| Ultraviolet absorber (UV-2) | 0.23 |
| Solvent (Solv-1) | 0.05 |
| Solvent (Solv-2) | 0.05 |
| 5th Layer (Red-Sensitive Layer) | |
| Silver halide emulsion (Br: 74%) | 0.21 |
| Gelatin | 1.80 |
| Cyan Coupler (ExC-1) | 0.26 |
| Cyan Coupler (ExC-2) | 0.12 |
| Fading inhibitor (Cpd-1) | 0.20 |
| Solvent (Solv-1) | 0.16 |
| Solvent (Solv-2) | 0.09 |
| 6th Layer (Ultraviolet Absorption Layer) | |
| Gelatin | 0.70 |
| Ultraviolet absorber (UV-1) | 0.26 |
| Ultraviolet absorber (UV-2) | 0.07 |
| Solvent (Solv-1) | 0.30 |
| Solvent (Solv-2) | 0.09 |
| 7th Layer (Protective Layer) | |
| Gelatin | 1.07 |

The compounds used for the aforesaid color photographic material are as follows.

(ExY) Yellow Coupler

α-Pivalyl-α-(3-benzyl-1-hidantoinyl)-2-chloro -5(γ-(2,4-di-tert-amylphenoxy)butylamido]acetanilide (ExM) Magenta Coupler (Coupler of the invention M-60)

(ExC-1) Cyan Coupler 2-Pentafluorobenzmaido-4-chloro-5[2-(2,4-di -tert-amylphenoxy)-3-methylbutylamidophenol (ExC-2) Cyan Coupler 2,4-Dichloro-3-methyl-6-[α-(2,4-di-tert -amylphenoxy)-butylamido]phenol (Cpd-1) Fading Inhibitor 2,5-Di-tert-amylphenyl-3,5-di-tert-butylhydroxy benzoate (Cpd-2) Color Mixing Prevention Agent 2,5-Di-tert-octylhydroquinone (Cpd-3) Fading Inhibitor 1,4-Di-tert-amyl-2,5-dioctyloxybenzene (Cpd-4) Fading Inhibitor 2,2-Methylenebis(4-methyl-6-tert-butylphenol)

(UV-1) Ultraviolet Abserber 2-(2-Hydroxy-3,5-di-tert-amylphenyl)benzotriazole (UV-2) Ultraviolet Abserbent 2-(2-Hydroxy-3,6-di-tert-butylphenyl)benzo -triazole (Solv-1)Solvent Di(2-ethylhexyl)phthalate (Solv-2)Solvent Dibuytyl phthalate The silver halide color photographic material thus prepared is designated Sample 111.

Then, Samples 112 to 124 were prepared by following the same procedure as above except that the magenta coupler for the 3rd layer (green-sensitive layer), a compound of formula (A) and a compound of formula (B) were changed or added to the 3rd layer as shown in Table 8 (the substituted amount of the coupler was an equimolar amount).

Furthermore, Sample 125 was prepared by following the same procedure as the case of preparing Sample 111 except that the coupler in the third layer, a compound of formula (A) and a compound of formula (B) were changed as shown in Table 8 and also the composition of the 6th layer (ultraviolet absorption layer) was changed as shown below.

| 6th Layer (Ultraviolet Absorption Layer) | |
|---|---|
| Gelatin | 1.35 |
| Ultraviolet Absorber (UV-1) | 0.26 |
| Ultraviolet Absorber (UV-2) | 0.07 |
| Solvent (Solv-1) | 0.55 |
| Solvent (Solv-1) | 0.17 |
| Compound (A-3) of the invention | 0.25 |

Each of the samples was subjected to a wedge exposure of 250 CMS at an exposure time of 0.1 second with a three color separation filter of B-G-R (blue, green, and red) attached to front face of the wedge and then processed by the following processing steps using a paper processor.

| Processing step | Temperature | Time |
|---|---|---|
| Color Development | 38° C. | 3 min. 30 sec. |
| Bleach-fix | 30 to 35° C. | 1 min. 30 sec. |
| Stabilization (1) | 30 to 35° C. | 1 min. 00 sec. |
| Stabilization (2) | 30 to 35° C. | 1 min. 00 sec. |
| Stabilization (3) | 30 to 35° C. | 1 min. 00 sec. |
| Drying | 70 to 80° C. | 1 min. 30 sec. |

(A stabilization (3)-(1) three-tank counter-flow system was used.)

The composition of each processing solution was as follows.

| Color Developer (K) | |
|---|---|
| Water | 800 ml |
| Hydroxyethoxyiminodiacetic acid | 4.0 g |
| 1-Hydroxyethylidence-1,1-diphosphonic acid (60% aqueous solution) | 1.0 g |
| Magnesium Chloride | 0.8 g |
| Benzyl alcohol | 15 ml |
| Diethylene glycol | 15 ml |
| Potassium Sulfite | 2.0 g |
| Potassium bromide | 1.1 g |
| Potassium Carbonate | 30 g |
| N-Ethyl-N-(β-methanesulfonamidoethyl)-3-methyl-4-aminoaniline sulfate | 5.5 g |
| Hydroxylamine sulfate | 3.0 g |
| Optical Whitening Agent (whitex 48, trade name, made by Sumitomo Chemical Company, Limited) | 1.0 g |
| Water to make | 1000 ml |
| pH (25° C.) | 10.20 |
| Bleach-Fix Solution | |
| Water | 400 ml |
| Ammonium thiosulfate (70% aqueous solution) | 100 ml |
| Ammonium sulfite (40% aqueous solution) | 27.5 ml |
| Ethylenediaminetetraacetic acid Ion (III) ammonium | 60 g |
| Ethylenediaminetetraacetic acid di-sodium | 3 g |
| Water to make | 1000 ml |
| pH (25° C.) | 7.10 |
| Stabilization Solution | |
| 1-Hydroxyethylidene-1, 1-diphosphonic acid (6% aqueous solution) | 1.6 ml |
| Bismuth chloride | 0.3 g |
| Polyvinylpyrolidone | 0.3 g |
| Aqueous ammonia (26% aqueous solution) | 2.5 ml |
| Nitrilotriacetic acid | 1.0 g |
| 5-Chloro-2-methyl 4 isothiazolin -3-one | 0.05 g |
| 2-Octyl-4-isothiazolin 3-one | 0.05 g |
| Optical whitening agent (Whitex 4B, trade name, made by Sumitomo Chemical Company, Limited) | 1.0 g |
| Water to make | 1000 ml |
| pH (25° C.) | 7.5 |

Then, hydroxyethoxyiminiodiacetic acid and 1-hydroxy-ethylidene-1,1-diphosphonic acid from the color developer (K) and $Ca^{2+}$ ions were added so that the concentration thereof became 300 ppm to provide Color Developer (L). Each sample was light exposed in the same manner as above and then processed by the aforesaid processing process except that Color Developer (L) was used.

On each of the samples thus processed using Color Developer (K) or Color Developer (L), the coloring property of magenta color images depending upon the concentration of $Ca^{2+}$ ions of the color developer was evaluated according to the method described in Example 1. The results obtained are shown in Table 8 below.

TABLE 8

| Sample No. | Coupler | Compound of Formula (A) or (A) & (B) | Addition Amount* (mol % to coupler) | Coloring Property | Remarks |
|---|---|---|---|---|---|
| 111 | M-60 | — | — | 0.83 | Comparison |
| 112 | M-60 | A-3 | 10 | 0.94 | Invention |
| 113 | " | " | 20 | 0.96 | Invention |

TABLE 8-continued

| Sample No. | Coupler | Compound of Formula (A) or (A) & (B) | Addition Amount* (mol % to coupler) | Coloring Property | Remarks |
|---|---|---|---|---|---|
| 114 | " | " | 50 | 0.98 | Invention |
| 115 | " | " | 100 | 0.99 | Invention |
| 116 | " | A-16 | 20 | 0.96 | Invention |
| 117 | " | A-3/B-3 | 20/100 | 0.98 | Invention |
| 118 | Ref-2** | — | — | 0.72 | Comparison |
| 119 | Ref-2 | A-3 | 10 | 0.75 | Comparison |
| 120 | — | — | 20 | 0.77 | Comparison |
| 121 | — | — | 50 | 0.80 | Comparison |
| 122 | — | — | 100 | 0.81 | Comparison |
| 123 | — | A-16 | 20 | 0.77 | Comparison |
| 124 | — | A-3/B-3 | 20/100 | 0.80 | Comparison |
| 125 | M-60 | A-3/B-3 | 10/100 | 0.98 | Invention |

*The amount of the compound of formula (A) or the compounds of formulae (A) and (B).

**Ref-2:

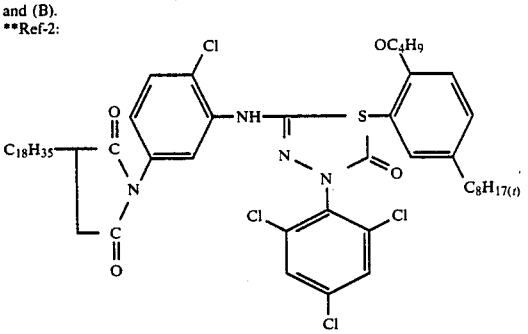

From the results shown in Table 8, it is clear that by using the coupler of this invention and the compound shown by formula (A), the reduction of coloring property by, $Ca^{2+}$ ions can be restrained and the color photographic material shows excellent coloring property. Furthermore, it can be seen that coloring property is more improved as the increase of the amount thereof. Also, it can be seen that by using together the compound of formula (A) and the compound of formula (B) for use in this invention, the coloring property is further improved.

On the other hand, in the case of using the comparison coupler, there is surely a tendency of improving the coloring property thereof by using the compound of formula (A) for use in this invention but the improving effect is clearly weak and it can be also seen that the combination of the compound of formula (A) with the coupler for use in this invention gives a larger effect for improving the coloring property.

Also, the coloring improving effect was observed in the case of adding the compound shown by formula (A) for use in this invention to the insensitive layer of the color photographic paper.

Furthermore, when the light fastness of magenta color images by fluoresecent lamp was determined on each sample thus processed, it was confirmed that in the case of using the coupler of this invention, the light fastness was greatly improved by the use of the compound of formula (A) and the compound of formula (B) for use in this invention as compared with the case of using the comparison coupler. In particular, it was also confirmed as in the aforesaid example that the improvement effect become more excellent by the use of the compound of formula (A) and the compound of formula (B) together. It was further confirmed that the combination of these compounds were excellent on the stain in the unexposed portion.

Then, each of the samples 111 to 125 was exposed as above and processed by the processing process shown below.

| Processing step | Temperature | Time |
|---|---|---|
| Color Development | 33° C. | 3 min. 30 sec. |
| Bleach-fix | 33° C. | 1 min. 30 sec. |
| Wash | 24 to 34° C. | 3 min. 30 sec. |
| Drying | 70 to 80° C. | 1 min. |

The composition of each processing solution was as follows.

| | |
|---|---|
| Color Developer (M) | |
| Water | 800 ml |
| 1-Hydroxyethyliene-1,1-diphosphonic acid (60% aqueous solution) | 2.0 g |
| Triethanolamine | 11 ml |
| Benzyl alcohol | 15 ml |
| Diethylene glycol | 0.2 ml |
| Potassium sulfite | 1.8 g |
| Potassium bromide | 0.6 g |
| Potassium carbonate | 28 g |
| N-Ethyl-N-(β-methanesulfonamido-ethyl)-3-methyl-4-aminoaniline Sulfate | 4.5 g |
| Hydroxylamine sulfate | 3.0 g |
| Optical whitening agent (Whitex 4B, Sumitomo Chemical Company, Limited) | 0.5 g |
| Lithium chloride | 2.0 g |
| Water to make | 1000 ml |
| pH (25° C) | 10.10 |
| Bleach-Fix Solution | |
| Water | 400 m |
| Ammonium thiosulfate (70% aqueous solution) | 120 ml |
| Sodium sulfite | 18 g |
| Ethylenediaminetetraacetic acid iron(III) ammonium | 60 g |
| Diethylenediaminetetraacetic acid di-sodium | 5 g |
| Water to make | 1000 ml |
| pH (25° C.) | 6.70 |

Then, 1-hydroxyethylidene-1,1-diphosphonic acid was removed from the composition of the color developer (M) and $Ca^{2+}$ ions were added thereto so that the content became 300 ppm to provide Color Developer (N). Each sample was exposed and processed in the same manner as above except that Color Developer (N) was used and then the coloring property of the samples thus processed was evaluated as described above.

The results are almost the same as those shown in Table 8 above and it was confirmed that the case of using the coupler of this invention together with the compound of formula (A) and the compound of formula (B) showed a greatly excellent improving effect as compared with the case of using the comparison coupler. It was further confirmed that the use of the compound of formula (A) and the compound of formula (B) together gave a particularly preferred result.

In addition, by following the same procedures for preparing Samples 111 to 125 except that an equimolar amount of the yellow coupler shown below was used in place of the yellow coupler in each sample, samples were prepared and when the same experiments as above were followed using these samples, almost the same results were confirmed.

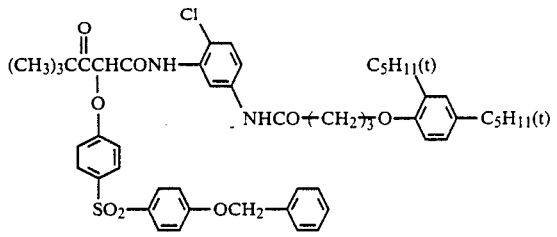

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material having a support and at least one silver halide light-sensitive emulsion layer coated thereon, wherein said photographic light-sensitive material comprises (i) at least one 5-pyrazolone magenta coupler possessing an elimination group represented by general formula (I) in coupling positions, and (ii) at least one compound represented by general formula (A):

Formula (I)

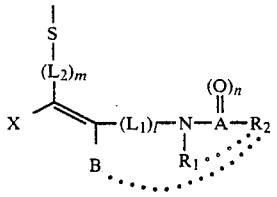

wherein $L_1$ and $L_2$ each represents a methylene group or an ethylene group;

l and m each represents 0 or 1;

$R_1$ represents a hydrogen atom, an alkyl group, an alkenyl group, an aryl group or a heterocyclic group;

$R^2$ represents a group linked to A by a carbon atom, an oxygen atom, a nitrogen atom or a sulfur atom;

A represents a carbon atom or a sulfur atom; n represents 1 when A is a carbon atom, and 1 or 2 when A s a sulfur atom;

B represents a carbon atom, an oxygen atom, a nitrogen atom or a sulfur atom;

X represents an atomic group necessary for forming a ring;

$R_1$ and $R_2$ may be mutually bonded and form a ring; and when B is a carbon atom or a nitrogen atom, B and $R_2$ may be mutually bonded and form a ring;

Formula (A)

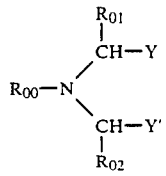

(A)

wherein $R_{00}$ represents an organic radical; and $R_{01}$ and $R_{02}$ may be the same or different and each represent a hydrogen atom or an alkyl group;

Y and Y' may be the same or different and each represents

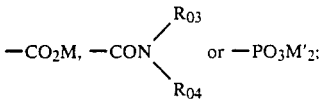

M represents a hydrogen atom, a sodium atom, a potassium atom, an ammonium ion, a quaternary amine, a protonated amine compound, an alkyl group, an aryl group or a heterocyclic group; M' represents a hydrogen atom, a sodium atom, a potassium atom, an ammonium ion, a quaternary amine or a protonated amine compound;

$R_{03}$ and $R_{04}$ may be the same or different and each represents a hydrogen atom or an alkyl, an aryl, an acyl, a sulfonyl group or a heterocyclic group; and $R_{03}$ and $R_{04}$ may be mutually bonded and form a 5–7 membered ring.

2. The silver halide color photographic light-sensitive material as in claim 1, wherein in formula (I), $L_1$ and $L_2$ each represents a substituted or an unsubstituted methylene or ethylene group.

3. The silver halide color photographic light-sensitive material as in claim 1, wherein in formula (I), $R_1$ represents a substituted or an unsubstituted aliphatic group having from 1–22 carbon atoms, a substituted or an unsubstituted aryl group selected from the group consisting of a phenyl group and a naphthyl group, and a substituted or an unsubstituted heterocyclic group selected from the group consisting of a 2-furyl group, a 2-thienyl group, a 2-pyrimidinyl group and a 4-pyridyl group.

4. The silver halide color photographic light-sensitive material as in claim 1, wherein in formula (I), $R_2$ is an alkyl group, an aryl group, a heterocyclic group (linked by a carbon atom), an acyl group, an alkoxycarbonyl group, a carbamoyl group, an alkoxy group, an aryloxy group, an alkylamino, an anilino group, an acylamino group, a ureido group, a sulfamoylamino group, an alkoxycarbonylamino group, a sulfonamido group, an alkylthio group or an arylthio group.

5. The silver halide color photographic light-sensitive material as in claim 1, wherein the groups represented by $L_1$, $L_2$, $R_1$, and $R_2$ in formula (A) each represents an unsubstituted group or a substituted group with a substituent selected from the group consisting of a halogen atom, an aliphatic group, an aryl group, a heterocyclic group, an alkoxy group, an aryloxy group, an alkylamino group, an alkoxycarbonyl group, a carbamoyl group, an anilino group, a sulfamoyl group, an alkylsulfonyl group, an arylsulfonyl group, an alkylthio group, an arylthio group, an acyl group, an acylamino group, an imido group, a ureido group, a sulfamoylamino group, an alkoxycarbonylamino group, a sulfonamido group, a hydroxyl group and a cyano group.

6. The silver halide color photographic light-sensitive material as in claim 1, wherein said 5-pyrazolone coupler is represented by the following general formula:

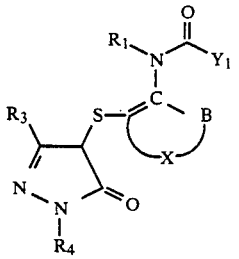

wherein $Y_1$ represents Ra or $Z_1$Rb; Ra represents a substituted or an unsubstituted aryl or a heterocyclic group or a substituent possessing a secondary or tertiary group represented by

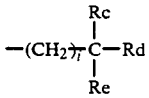

and i represents 0 or 1; $Z_1$ represents an oxygen atom, a sulfur atom or NRf; Rb is a substituted or an unsubstituted alkyl, aryl or heterocyclic group; Rc and Rd each represents halogen atoms or a group selected from the group consisting of Rb and $Z_2$Rg; Re is a hydrogen atom or a group as defined for Rc and Rd; Rf is a hydrogen atom or a group as defined for Rb; $Z_2$ represents an oxygen atom or a sulfur atom or NRh; Rg is a group as defined for Rf; Rh is a group as defined for Rf; Rc may bond with Rd and/or Re to form one or two carbon rings or hetero rings and these may also possess substituents; $R_1$, X and B signify the same groups, atomic groups and atoms as noted in formula (I) in claim 1; $R_3$ is an anilino group, an acylamino group, a ureido group, a carbamoyl group, an alkoxy group, an allyloxycarbonyl group, an alkoxycarbonyl group or an N-heterocyclic group; $R_4$ is a substituted or an unsubstituted aryl group.

7. The silver halide color photographic light-sensitive material as in claim 6, wherein said 5-pyrazolone coupler is represented by the following general formula:

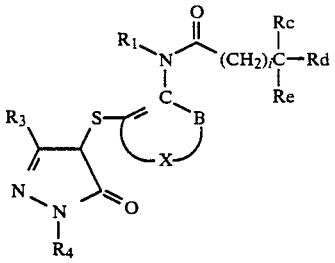

wherein $R_1$, $R_3$, $R_4$, Rc, Rd, Re, X, B and i signify the same atom or groups as noted in claim 6.

8. The silver halide color photographic light-sensitive material as in claim 6, wherein said 5-pyrazolone coupler is represented by the following general formula:

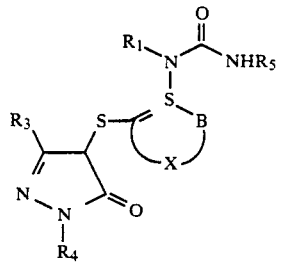

wherein $R_5$ represents a substituted or an unsubstituted alkyl, aryl or heterocyclic group; $R_1$, $R_3$, $R_4$, X and B signify the same groups, atomic groups, and atoms as noted in claim 6.

9. The silver halide color photographic light-sensitive material as in claim 6, wherein said 5-pyrazolone coupler is represented by the following general formula:

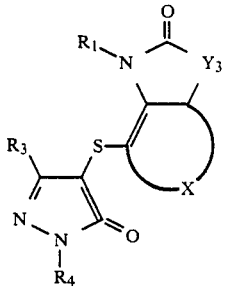

wherein $R_1$, $R_3$, $R_4$ and X signify the same atoms, groups and atomic groups as noted in claim 6; $Y_3$ represents a substituted or an unsubstituted methylene or ethylene group or

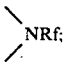

Rf signifies the same atoms and groups as noted as in claim 6.

10. The silver halide color photographic light-sensitive material as in claim 6, wherein said 5-pyrazolone coupler is represented by the following general formula:

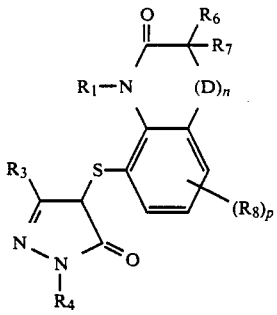

wherein $R_1$, $R_3$ and $R_4$ each signifies the same atoms and groups as noted in claim 6; $R_6$ and $R_7$ each represents an alkyl group or an aryl group; $R_8$ represents substituent groups a defined for $L_1$ and $L_2$; D represents a methylene group or an oxygen, nitrogen or sulfur atom; n represents an integer from 0 to 2 when D is a methylene group and is 1 in the other cases; and p is an integer from 0 to 3.

11. The silver halide color photographic light-sensitive material as in claim 1, wherein $R_{00}$ in claim 1 is a group represented by

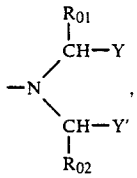

(wherein $R_{01}$, $R_{02}$, Y and Y' each has the same meaning as in formula (A)), a substituted or unsubstituted alkyl, aryl or heterocyclic group.

12. The silver halide color photographic light-sensitive material as in claim 1, wherein said compound represented by general formula (A) is a compound represented by formula (A-1):

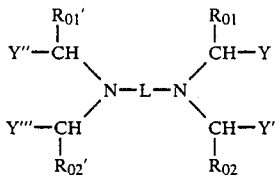

(A-1)

wherein $R_{01}$, and $R_{02}$, Y and Y' in general formula (A-1) have the same meanings as in general formula (A); $R'_{01}$ and $R'_{02}$ have the same meanings as $R_{01}$ and $R_{02}$; Y'' and Y''' have the same meanings as Y and Y'; L indicates a single bond or a divalent group which may have one or more groups represented by formula (C):

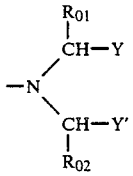

(C)

wherein each symbol has the same meanings as defined in formula (A).

13. The silver halide color photographic light-sensitive material as in claim 12, wherein said divalent group is selected from the group consisting of

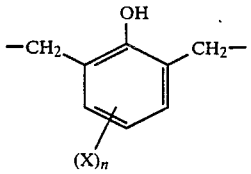

(wherein X represents an alkyl, aryl, acylamino, sulfonamido, heterocyclic amino, alkyloxycarbonyl, aryloxycarbonyl, sulfamoyl, carbamoyl, sulfonyl, urethane, ureido, heterocyclic, acyl, alkoxy, aryloxy, sulfo, carboxyl, hydroxy, nitro or cyano group or halogen atom (these groups may have one or more groups represented by the general formula (C)); n represents 0, 1 or 2; when n is 2, the two Xs may be the same or different), an alkylene group,

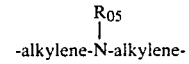

(wherein $R_{05}$ represents a substituted or unsubstituted alkyl, acyl or heterocyclic group); said compounds represented by formula (A-1) may be in a form of polymer obtained by polymerization at X.

14. The silver halide color photographic light-sensitive material as in claim 1, wherein said compound represented by general formula (A) is a compound represented by general formula (A-2):

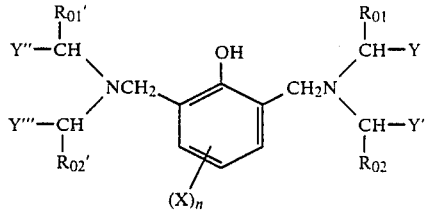

(A-2)

wherein $R_{01}$, $R_{02}$, Y and Y' in general formula (A-2) have the same meanings as in general formula (A); $R'_{01}$ and $R'_{02}$ have the same meanings as $R_{01}$ and $R_{02}$; Y'' and Y''' have the same meanings as Y and Y'; X represents an alkyl, aryl, acylamino, sulfonamido, heterocyclic amino, alkyloxycarbonyl, aryloxycarbonyl, sulfamoyl, carbamoyl, sulfonyl, urethane, ureido, heterocyclic, acyl, alkoxy, aryloxy, sulfo, carboxyl, hydroxy, nitro or cyano group or halogen atom (these groups may have one or more groups represented by the general formula (C)):

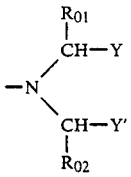

(C)

wherein each symbol has the same meanings as defined in formula (A); n represents 0, 1 or 2; when n is 2, the two Xs may be the same or different), said compounds represented by formula (A-2) may be in the form of a polymer obtained by polymerization at X.

15. The silver halide color photographic light-sensitive material as in claim 12, wherein said compound has from 2 to 6 of the group represented by formula (C).

16. The silver halide color photographic light-sensitive material of claim 1, further comprising at least one compound repersented by formula (B):

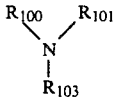

(B)

wherein $R_{100}$ represents a substituted or an unsubstituted alkyl or alkenyl group; $R_{101}$ represents a hydrogen atom or a substituted or an unsubstituted alkyl or alkenyl group; $R_{103}$ represents a substituted or an unsubstituted aryl group; $R_{100}$ and $R_{101}$ may be bonded together and form a 5- to 7-membered hydrocarbon or heterocyclic ring; $R_{100}$ and/or $R_{101}$ may bond to $R_{103}$ to form a 5- to 7-membered hydrocarbon or heterocyclic ring with the proviso that neither $R_{100}$ nor $R_{101}$ is a tertiary alkyl group.

17. The silver halide color photographic light-sensitive material as in claim 1, wherein said 5-pyrazolone magenta coupler is used in an amount of from $1\times10^{-3}$ to 1 mol per mol of silver halide in the silver halide emulsion.

18. The silver halide color photographic light-sensitive material as in claim 1, wherein said compound represented by formula (A) is used in an amount of from 0.01 to 5 g/m$^2$ of the photographic light-sensitive material.

19. The silver halide color photographic light-sensitive material as in claim 1, wherein said compound represented by formula (A) is incorporated into a hydrophilic colloid layer.

20. The silver halide color photographic light-sensitive material as in claim 16, wherein said compound represented by general formula (B) is used in an amount of from 5 to 500 mol % relative to the 5-pyrazolone magenta coupler.

21. The silver halide color photographic light-sensitive material as in claim 1, wherein said, compound represented by formula (A) is incorporated into at least one of the layer containing the 5-pyrazolone coupler and the layers adjacent thereto.

22. The silver halide color photographic light-sensitive material as in claim 1, wherein said silver halide comprises silver chloride or silver chlorobromide containing at least 90 mol % of silver chloride.

23. The silver halide color photographic light sensitive material as claimed in claim 8, wherein $R_3$ is a group represented by NH—$Y_2$ and wherein $Y_2$ is a substituted or an unsubstituted aryl, arylcarbonyl or arylaminocarbonyl group.

* * * * *